US006044764A

United States Patent [19]

Ogisu

[11] Patent Number: 6,044,764

[45] Date of Patent: Apr. 4, 2000

[54] PRINTING METHOD AND PRINTING PRESS

[75] Inventor: Toshio Ogisu, Aichi, Japan

[73] Assignee: Katsuya Industrial Co., Ltd., Aichi, Japan

[21] Appl. No.: 09/180,550

[22] PCT Filed: Aug. 29, 1997

[86] PCT No.: PCT/JP97/03032

§ 371 Date: Nov. 10, 1998

§ 102(e) Date: Nov. 10, 1998

[87] PCT Pub. No.: WO98/40215

PCT Pub. Date: Sep. 17, 1998

[30] Foreign Application Priority Data

Mar. 12, 1997 [JP] Japan ..... 9/058041

[51] Int. Cl.[7] ..... B41F 13/00; B41M 3/12; B44C 31/00; B05C 3/00

[52] U.S. Cl. ..... 101/492; 427/293; 118/679; 156/156; 156/384

[58] Field of Search ..... 101/492, 34, 35; 156/230, 384, 155; 427/262, 273, 293; 118/679

[56] References Cited

U.S. PATENT DOCUMENTS

| | | | |
|---|---|---|---|
| 3,554,834 | 1/1971 | Bennett et al. | 156/230 |
| 4,010,057 | 3/1977 | Nakanishi | 156/384 |
| 4,229,239 | 10/1980 | Arai et al. | 156/155 |
| 4,231,829 | 11/1980 | Marci et al. | 156/230 |
| 4,436,571 | 3/1984 | Nakanishi | 156/384 |
| 4,490,413 | 12/1984 | Stimson | 427/262 |
| 5,908,525 | 6/1999 | Zaher | 156/230 |
| 5,968,272 | 10/1999 | Tomono et al. | 118/679 |

*Primary Examiner*—Eugene Eickholt

*Attorney, Agent, or Firm*—McCormick, Paulding & Huber LLP

[57] ABSTRACT

While a transfer sheet 3 including a water-soluble base sheet on which a print layer is provided is floated on water, an adhesion is applied after the base sheet is dissolved, thereby to form a semi-fluidal print layer. An object is pressed against the print layer to achieve printing. In this technique, the present printing method and apparatus shorten the warm-up time required for dissolving the base sheet of the transfer sheet 3 to improve the working efficiency, and the transfer sheet 3 is previously cut at a predetermined length and is then floated on the water surface 5, so that wasteful consumption of the transfer sheet is reduced. The bottom of a water tank 11 is formed to be shallow in the left side than in the right side, so that the amount of water contained in the water tank 11 is reduced to shorten the warm-up time. In addition, the transfer sheet 3 is cut at a predetermined length of a range necessary for transfer before the transfer sheet 3 fed from the transfer sheet feed section 12 is shifted to the water surface 5, so that wasteful consumption of the transfer sheet 3 is prevented.

9 Claims, 33 Drawing Sheets

PRINTING METHOD AND PRINTING PRESS

TECHNICAL FIELD

The present invention relates to a printing technique in which printing is performed by transferring a print layer of a pattern printed on a water-soluble base sheet, onto a surface of an object, and particularly, to a printing technique in which work efficiency is improved and wasteful use of transfer sheets is eliminated.

BACKGROUND OF THE INVENTION

A printing method described in Japanese Patent Publication No. 52-41682 is known as a method of transferring a pattern onto a curved surface. In this printing method, a thin film having a pattern previously printed on its surface is let float on a liquid surface with the surface of the printed pattern facing upward, and an object is pressed against the surface so as to sink into the liquid. The pattern is thus transferred onto the object by the liquid pressure. After the transfer of the pattern, the thin film is removed from the surface of the object.

Japanese Patent Publication No. 57-50547 describes a printing method of transferring efficiently a pattern on a curved surface of an object by means of a liquid pressure. In this printing method, a water-soluble base sheet is used in a manner in which the base sheet is let float on a water surface and dissolved in water. An adhesion is sprayed onto a print layer remaining on the water surface after dissolving the base sheet, to form a semi-fluidal printing pattern is thus formed. An object is pressed against the printing pattern, thereby to transfer the pattern onto the surface of the object.

Meanwhile, Korean Patent Application Publication No. 95-17199 describes a printing apparatus which uses a liquid pressure to transfer a pattern onto a surface of an object by sequential steps and an apparatus used in the method. In this printing method, a transfer sheet having a base sheet on which a pattern is printed is let sequentially flow on the water surface in a water tank from a transfer sheet feed. While sequentially flowing the transfer sheet, the base sheet is dissolved. Thereafter, an adhesion is applied thereon and transfer printing is carried out. Together with the method, this Publication describes a printing apparatus provided with a long water tank used in the printing method.

Although the technique described in the Korean Patent Application Publication achieves a technique for mass-production in which a pattern is sequentially transferred to a great deal of objects, a large amount of water is required for the sequential steps including dissolving of base sheets, resulting in a new problem that a long time is required for increasing the temperature of water in the water tank so that starting of printing is delayed.

In addition to the above technical problem from the view point of the working efficiency, problems from the view point of saving materials are pointed out from the working side.

That is, according to a conventional printing method disclosed in the Korean Patent Application Publication, separation of a pattern printed on a transfer sheet is carried out in a step after the base sheet of the transfer sheet fed onto the water surface is dissolved and an adhesion is thereafter applied to form a semi-fluidal print pattern. Specifically, the base sheet is dissolved while the transfer sheet is being fed onto the water surface and conveyed in form of a band. After the dissolving of the base sheet, an adhesion is sprayed onto a pattern remaining on the water surface to form a semi-fluidal print pattern, and in this stage, a partition member is inserted from the upside of the water surface to separate the print patter for every area to be used in one time of transfer work.

In this working method, an adhesion is applied to a necessary range for the transfer sheet flowing in form of a band. It is however difficult to insert a partition member exactly at the boundary of the range, and therefore, the adhesion is applied to the range including a slight excessive margin for the partition member to be inserted. The portion corresponding to such a margin cannot be used for transfer to an object and may be said to be waste. Even such a small wasteful portion caused in only one time of transfer leads to enormous waste in the mass-production situation at present. Working fields demand technical developments in eliminating such wasteful margins for the separation member to be inserted. Thus, there is a demand for a technique capable of cutting the sheet into a minimum size necessary for transfer.

Further, since the working method described above requires sequential working while the sheet is flowing on the water surface, it is necessary to perform smooth and adept insertion of a partition member. To achieve manual application of an adhesion and manual insertion of a partition member, smooth and adept skill is required to some extent and is a significant burden for a person in the art. Hence, there is a demand for automation of such operation, and developments must be made as to a technique for cutting the transfer sheet in connection with the automation.

An object of the present invention is to shorten the time required for increasing the temperature of water, which is necessary to dissolve the base sheet, in a printing method capable of performing sequential and efficient printing onto surfaces of mass-products, and in an apparatus thereof.

Another object of the present invention is to eliminate wasteful portions which are conventionally caused when separating a pattern and which cannot be used for transfer, by cutting a transfer sheet before the transfer sheet is fed and reaches a water tank.

The above objects of the present invention and other objects than those described above will be clearly understood from the description of the present specification and from the drawings appended hereto.

SUMMARY OF THE INVENTION

The present invention provides a printing method of transferring a print layer having a pattern printed on a water-soluble base sheet, onto a surface of an object, and a printing apparatus used for the method.

In the printing method and printing apparatus according to the present invention, a transfer sheet including a base sheet having a surface where a print layer of a pattern is printed is conveyed toward the downstream side by a flow of water, with the transfer sheet kept floating on the surface of water in a water tank. The base sheet is dissolved in water as the transfer sheet is conveyed to the downstream side by water. After the base sheet is dissolved, an adhesion is applied onto the print layer while being conveyed. By thus applying an adhesion, the print layer becomes a semi-fluidal print pattern having adhesiveness, and is further conveyed to a predetermined position in the downstream side. Thereafter, objects are pressed against the print pattern. When thus pressing the objects, the objects are sunk in water to transfer the print pattern onto the objects by the water pressure.

Specifically, while moving the transfer sheet by means of the flow of the water surface with the transfer sheet kept floating on the water surface, the base sheet of the transfer sheet is dissolved in water. Therefore, the base sheet can be dissolved halfway during conveyance of the transfer sheet to a process step in which the print pattern is transferred to the objects. It is thus possible to perform transfer printing onto objects in comparison with a case in which the base sheet is dissolved with the transfer sheet is kept standstill.

In addition, in the printing method and apparatus according to the present invention, the transfer sheet is rolled up in form of a roll and the transfer sheet is fed out sequentially therefrom onto the water surface in the water tank. Further, while being conveyed in form of a band on the water surface, the base sheet of the transfer sheet is dissolved. After the dissolving of the base sheet, an adhesion is sprayed to form a semi-fluidal print pattern having adhesiveness and a partition member is inserted into the semi-fluidal print pattern from upside of the water surface, in order that the print layer conveyed in form of a band is cut for every area to be used one time of transfer operation. While being conveyed by a conveyer means, the partition member partitions the portion of the print pattern to be used for one time of transfer operation so that the other remaining portion of the print pattern might not be influenced, and the partition member also prevents the print pattern from spreading after application of an adhesion.

That is, the portion of the print pattern that is used for one time of transfer operation is partitioned by the partition member so that the end portions of the print pattern thus partitioned are separated sharply. In addition, it is possible to prevent the semi-fluidal print pattern from spreading after application of an adhesion, so that a high quality pattern can be transferred and printed onto objects without deforming the pattern.

Every time the portion of the print pattern that is to be transferred for one time of transfer operation is conveyed to the zone where transfer is carried out, the portion of the pattern can be transferred to objects. Therefore, the cycle time of transfer printing can be greatly shortened so that sequential printing can be performed on objects where mass-products are used as the objects.

Thus, the transfer sheet is conveyed, floated on a flowing water surface, while feeding out the transfer sheet rolled like a roll. Therefore, the water-soluble base sheet can be easily dissolved or swelled rapidly in conjunction with physical effects of the flow of water. The feeding speed of the transfer sheet is set to be slower than the speed of the flaw of the water surface, so that the transfer sheet being conveyed is applied with a tension which prevents formation of wrinkles. To transfer the pattern onto objects, an adhesion is applied onto the print layer. Even when the print layer is softened and spreads in form of a semi-fluidal print pattern by spraying the adhesion, the print pattern is prevented from spreading and deformation of the pattern is prevented. As a result, a high quality pattern can be transferred and printed onto surfaces of objects without deformation.

Also, since water for dissolving the base sheet arranged so as to flow as described above, it is easy to collect water at the downstream end. Water thus collected can be easily cleaned, and cleaned water can be circulated and used again. As a result, water containing no impurities can be used to transfer a high quality pattern onto objects without increasing consumption of water.

In addition, in the printing method and apparatus according to the present invention, the water tank is formed to be shallower in the side where the step of dissolving the base sheet of the transfer sheet is carried out than in the side where the step of transferring the pattern is carried out, in order that the capacity of the water tank can be reduced more in comparison with a water tank having a uniform depth without changing working steps. Therefore, the total quantity of water in the water tank can be smaller than in the water tank having a uniform depth, and the warm-up time can be accordingly shortened.

Further, in another structure of the printing method and apparatus according to the present invention, the transfer sheet is cut before it is shifted onto the water surface, in place of shifting the transfer sheet from a transfer sheet feed section onto the water surface, dissolving the base sheet, and thereafter applying an adhesion to form a semi-fluidal print pattern, and partitioning the print pattern.

That is, in this structure, the rolled transfer sheet is once sent to a cutting section and is cut at a predetermined length. Thereafter, every transfer sheet thus cut is shifted sequentially onto the water surface of the water tank. On the water surface, the base sheet of the transfer sheet is dissolved while the transfer sheet cut at a predetermined length is conveyed with each transfer sheet partitioned between partition members. In conjunction with the physical effects of the flow of water, the water-soluble base sheet is rapidly dissolved or swelled.

Since the transfer sheet fed onto the cutting section in form of a band must be cut for every area of a predetermined length of a range which is to be used for one time of transfer operation, the transfer sheet is fed not directly onto the water surface but is once sent onto a transfer sheet receiver member provided in the forward side of the transfer sheet feed section in the feeding direction. The top end of the transfer sheet thus fed out is detected by a top end detection means such as a photoelectric tube or the like, and the transfer sheet is cut at a position distant by a predetermined length in the backward direction from the top end detected.

In the printing method in which the transfer sheet is thus cut before being shifted to the water tank, a portion of a pattern used as a margin for insertion of a partition member, which must be created between two transfer ranges in the front and rear sides and cannot be used for transfer of the pattern, can be reduced more in comparison with a conventional printing method. Therefore, the transfer sheet can be greatly saved.

If the shifting speed of the transfer sheet shifted from the cutting section to the water surface is set to be slower than the speed of the flow of the water surface, the transfer sheet is tensioned in the step of shifting the sheet to the water surface, so that formation of wrinkles is prevented.

In addition, application of an adhesion to the print layer may be carried out in the same manner as in the structure described before. Since each transfer sheet cut at a predetermined length is partitioned by partition members, the-print layer is partitioned by the partition members and deformation of the print pattern can be thereby prevented, even if the print layer is softened and spreads over the water surface after spraying an adhesion after the base sheet of the transfer sheet is dissolved.

In comparison with a case in which transfer sheets each cut at a predetermined length are let flow sequentially without using partition members, it is possible to prevent deformation of patterns due to overlapping or close approach between transfer sheets each other. As a result, a high quality pattern can be transferred and printed onto surfaces of objects without deformation.

Further, by combining the structure described before in which the depth of water in the water tank is set to be shallow to shorten the warm-up period, with the present structure in which the transfer sheet is cut at a predetermined length by the cutting section and is then shifted to the water surface, the printing efficiency can be much more improved and the transfer sheet can be much more saved by a multiplier effect of both structures than in the case where each of the structures is singly used.

BRIEF DESCRIPTION OF THE DRAWING

FIG. 35(*b*) is a cross-sectional view of FIG. 35(*a*).

DESCRIPTION OF THE PREFERRED EMBODIMENT

Figure 1A:
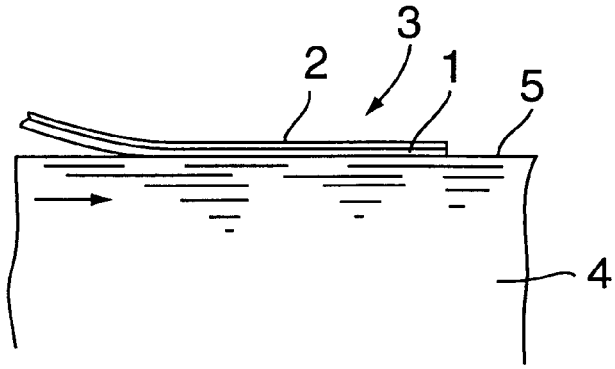
FIGS. 1(*a*)–1(*d*) are views showing printing steps of a printing method according to an embodiment of the present invention.
Figure 1B:
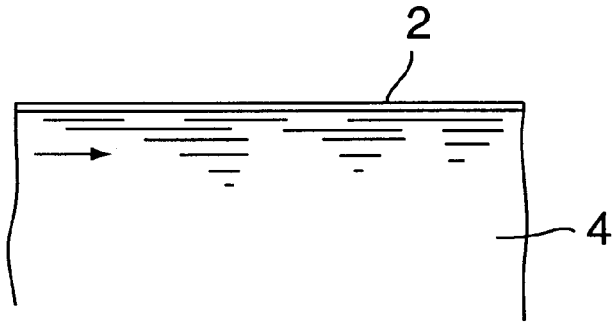
Figure 1C:
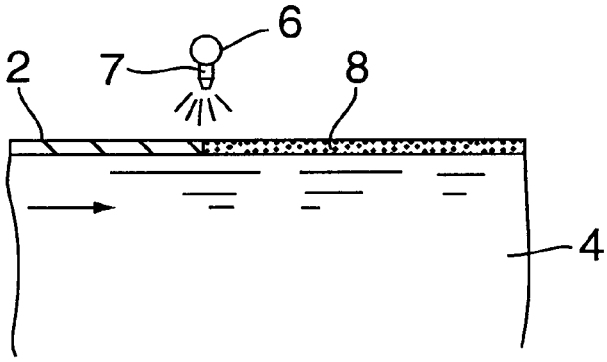
Figure 1D:
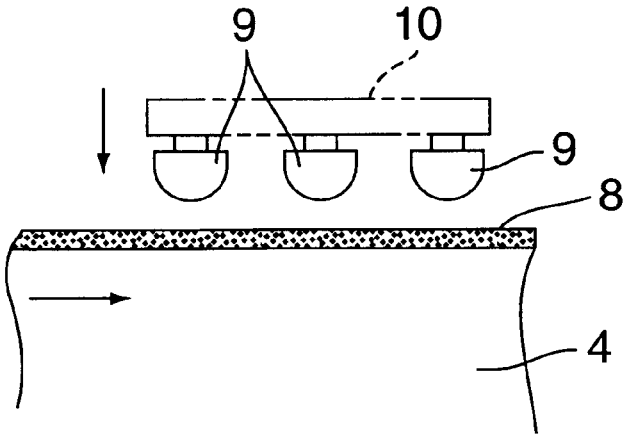

In the following, embodiments of the present invention will be described in details with reference to the drawings. Note that those components which have same functions are denoted at same reference symbols in all the drawings related to explanation of the embodiments, and reiterative explanation of those components will be partially omitted in several cases.

Among the embodiments, explanation will now be made of a printing apparatus and a printing method thereof in which the bottom depth of a water tank is reduced to shorten the warm-up period for water.

FIGS. 1(*a*) to 1(*d*) are views explaining principles which constitute the basic steps of printing. As shown in the figures, a print layer 2 having an arbitrary pattern is formed on the surface of a base sheet 1 by print ink or paint, and a transfer sheet 3 consists of the base sheet 1 and the print layer 2. The base sheet 1 is made of a material which is easily dissolved or swelled in water. In this case, the base sheet 1 is water-soluble. In the figures, a polyvinyl alcohol is used as the material forming the water-soluble base sheet 1. As the print ink, paint obtained by dissolving a vinyl chloride resin in a solvent is used.

The transfer sheet 3 is prepared in a manner in which printing is performed on the surface of the base sheet 1 with print ink or paint by a known printer to form a print layer 2 on the base sheet 1, which is thereafter rolled.

FIG. 1(*a*) shows a state in which the transfer sheet 3 is let float on the water surface 5 of water 4 such that the base sheet 1 is kept in contact with the water surface 5 and that the print layer 2 faces upward. As shown in the figures, the water 4 flows slowly in the direction indicated by an arrow, and the transfer sheet 3 being fed from the roll is let flow in the direction indicated by arrow, floating on the water surface 5.

FIG. 1(*b*) shows a state in which the base sheet 1 of the transfer sheet 3 is dissolved in the water 4. The base sheet 1 starts dissolving or swelling upon making contact with the water 4 and is then dissolved gradually as the time is elapsed while being fed to the downstream side. The flow of the water hastens the dissolving of the water-soluble base sheet 1.

FIG. 1(*c*) shows a state in which an adhesion made of an epoxy resin is sprayed onto the print layer 2 floating on the water surface 5 after the base sheet 1 is dissolved in the water. The adhesion is sprayed in form of a mist from a plurality of nozzles 7 provided on an adhesion feed pipe 6 at a predetermined interval in the width direction of the transfer sheet 3. By moving the nozzles 7 in the horizontal direction, the adhesion is applied uniformly on the surface of the print layer 2. A semi-fluidal print pattern 8 is formed on the surface of the print layer 2. Note that application of the adhesion may be carried out not only automatically but also manually by an operator.

FIG. 1(*d*) shows a state in which a plurality of objects 9 are held by a holder 10. By moving the objects 9 downward by the holder 10, the print pattern 8 is pressed against the objects 9, so that the print pattern is transferred onto the objects 9. As shown in the figure, even if the surface of each object 9 is curved, the print pattern 8 is uniformly pressed against the entire surfaces of the objects 9 by making the objects 9 sink down into the water 4. Thus, the print pattern can be transferred and printed on each curved surface without changing the pattern.

As shown in FIG. 1(*c*), the semi-fluidal print pattern 8 having adhesiveness is formed by applying an adhesion on the print layer 2, and thus, adhesiveness of the pattern to the objects 9 is obtained.

The adhesion may be applied not only to the print layer 2 but also to the surfaces of the objects 9 previously.

FIG. 1 show a principle of basic steps of printing. In the case of these figures, the adhesion is applied after the base sheet 1 is sufficiently dissolved in the water 4. However, the adhesion may be applied while feeding the transfer sheet 3 halfway in the step in which the base sheet 1 is dissolved by feeding the transfer sheet 3, i.e., before completion of dissolving of the base sheet 1. In this case, before the base sheet 1 is completely dissolved, i.e., while it is being dissolved, the objects 9 may be pressed against the print layer 2 to transfer the pattern.

The thickness of the water-soluble base sheet 1 is about 30 to 50 $\mu$m. If the base sheet 1 is too thin, it is not easy to print the pattern onto the base sheet 1. If the base sheet 1 is otherwise too thick, the base sheet 1 cannot be dissolved before it reaches to the downstream end flowing on the liquid surface in the water tank 11. Therefore, when polyvinyl alcohol is used as the material of the base sheet 1, the thickness is set as described above. On the base sheet 1 having the thickness described above, a print layer 2 having a thickness of 5 to 200 $\mu$m is formed with a pattern.

Any kind of adhesion may be used as long as it serves to adhere the print layer 2 onto the objects 9. In case where ink obtained by dissolving a vinyl chloride resin in a solvent is used as print ink as has been described above, thinner is sprayed as an adhesion to soften the print ink, and adhesion to the objects 9 is achieved due to the adhesion and due to the properties of the components of the resin itself.

Figure 2:
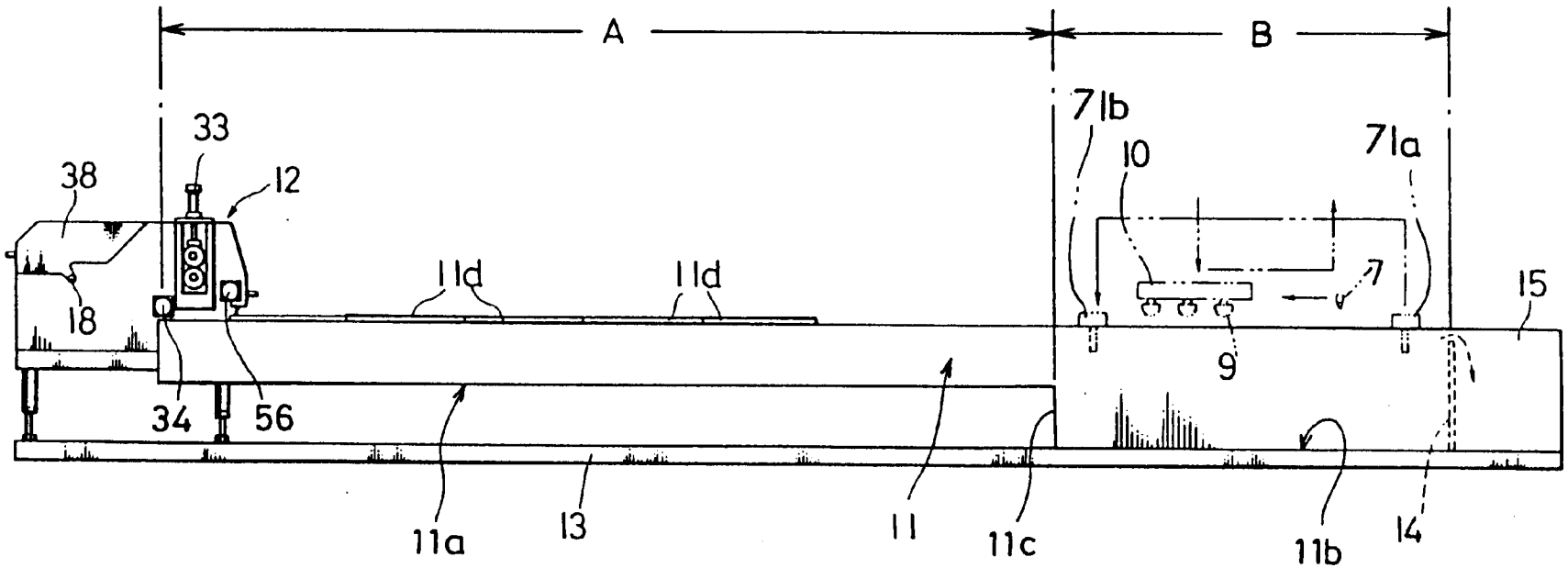
FIG. 2 is a front view showing a printing apparatus according to an embodiment of the present invention.
Figure 3:
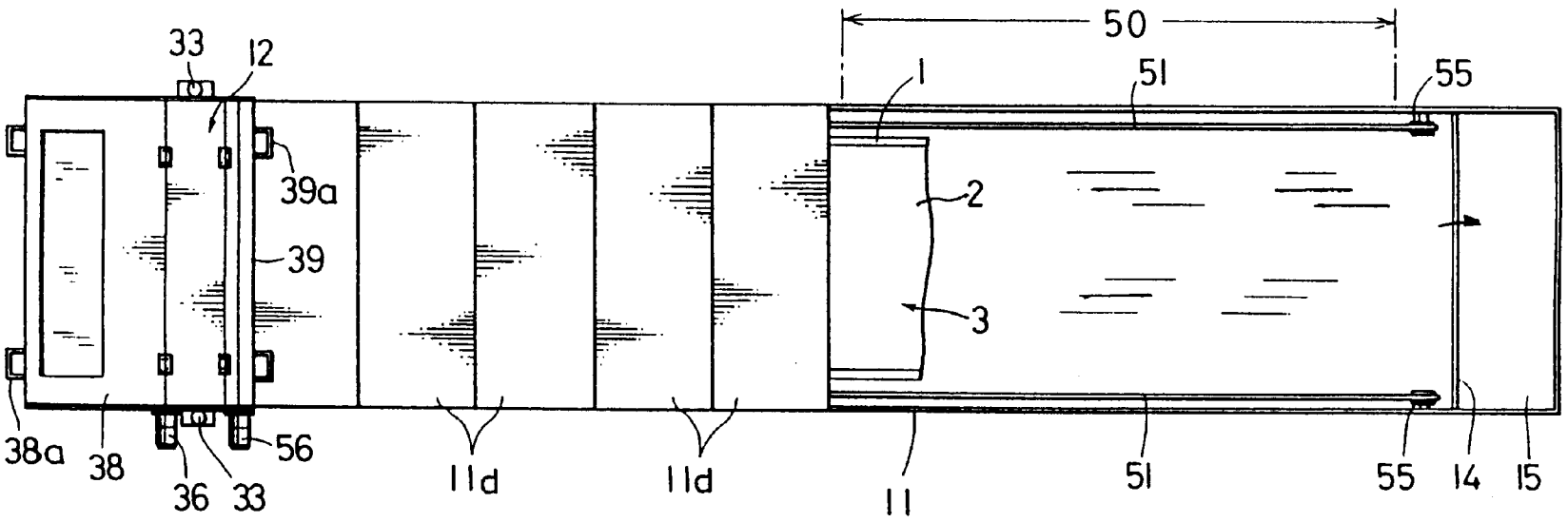
FIG. 3 is a plan view of the printing apparatus shown in FIG. 2.

FIG. 2 is a front view of a printing apparatus and FIG. 3 is a plan view thereof.

The printing apparatus has a water tank 11 having a rectangular shape in its plan view, and a transfer sheet supply section 12 provided at an end portion of the water tank. The tank 11 and section 12 are provided on a base 13. The water tank 11 is arranged to be shallower at a bottom 11*a* thereof in the left side A than at a bottom 11*b* thereof in the right side B. In the present embodiment, as shown in FIG. 2, the water tank is shallower at the bottom 11*a* in the left side A where the transfer sheet feed section 12 is provided than at the bottom 11*b* in the right side B where the transfer step described later is carried out. The depth in the left side A is set to be about half of the depth in the right side B. The bottom 11*a* is extended horizontally like a plane to a side plate 11*c* of the right side B having the deeper bottom 11*b*.

Note that the bottom 11*a* need not always be horizontal but may be formed to have a downward gradient toward the right side B, for example.

Further, an overflow tank 15 is partitioned by a partition wall 14 at the other end portion of the water tank 11. In the water tank 11, water 4 flows to the right side from the left side as an upstream side in FIGS. 1 and 2. The water surface 5 of the water 4 which is contained in the water tank 11 and flows from the upstream side to the downstream side is set depending on the position of the upper end surface of the partition wall 14. When adjusting the height of the water surface 5, the upper end position of the partition wall 14 is set such that the upper end side of a conveyer chain is slightly higher than the water surface 5, and the both ends of the transfer sheet 3 floating on the water surface 5 are situated between the conveyer chain running laterally.

The water 4 is set to a predetermined temperature of about 20 to 30° C., for example, so that the base sheet 1 is dissolved in a predetermined time period. An agent which hastens dissolving of the water-soluble base sheet may be mixed into this water.

Thus, in the water tank 11 constructed in the structure described above, since the depth is not arranged to be uniform from the left side A to the right side B, the capacity of the water tank 11 can be decreased to reduce the quantity of water filled in the water tank 11. Accordingly, it is possible to shorten the warm-up period required until the temperature of the water necessary for dissolving the base sheet 1 reaches the temperature set as described above. In addition, the time period required for changing the temperature can be shortened.

The water temperature may be adjusted by heating and circulating the entire water in the water tank 11, or a heater means may be provided in the left side A so that at least the flow of the water in the range of the left side A falls within the temperature range as described above. For example, it is possible to consider that a panel-like heater may be provided just under the bottom 11*a* in the left side A, making a surface contact therebetween.

Otherwise, a panel-like heater subjected to water-proof processing may be provided in parallel with the bottom 11*a*, so that the water flow in the left side A is heated from inside of the water tank 11 by the upper and lower surfaces of the panel-like heater. In this structure, however, the panel-like heater must be arranged so as to have no contact with such a partition member conveyer means which will be described later. For example, when a partition member conveyer means is constructed by providing an endless chain, such a means may be positioned in parallel with the moving direction of the chain, between a forward-moving range of the chain which is close to the water surface and a return-moving range of the chain which is close to the bottom 11*a*. If a panel-like heater is provided so as to divide the left side A of the water tank 11 which has a shallower bottom 11*a* into upper and lower two pieces, the water flow is heated from both the upper and lower surfaces of the panel-like heater, so that the heat can be smoothly transferred and efficient heating can be achieved. In addition, since the inside of the left side A is divided into upper and lower pieces, the water flow in the upper surface side of the panel-like heater is not influenced by a counterflow generated in the returning range of the chain, and therefore, the transfer sheet 3 can flow along with a stable water flow.

Otherwise, a heater may be equipped on a water supply pipe in a manner of a water boiler, so that water whose temperature is previously adjusted is supplied to the left side A.

Figure 4:
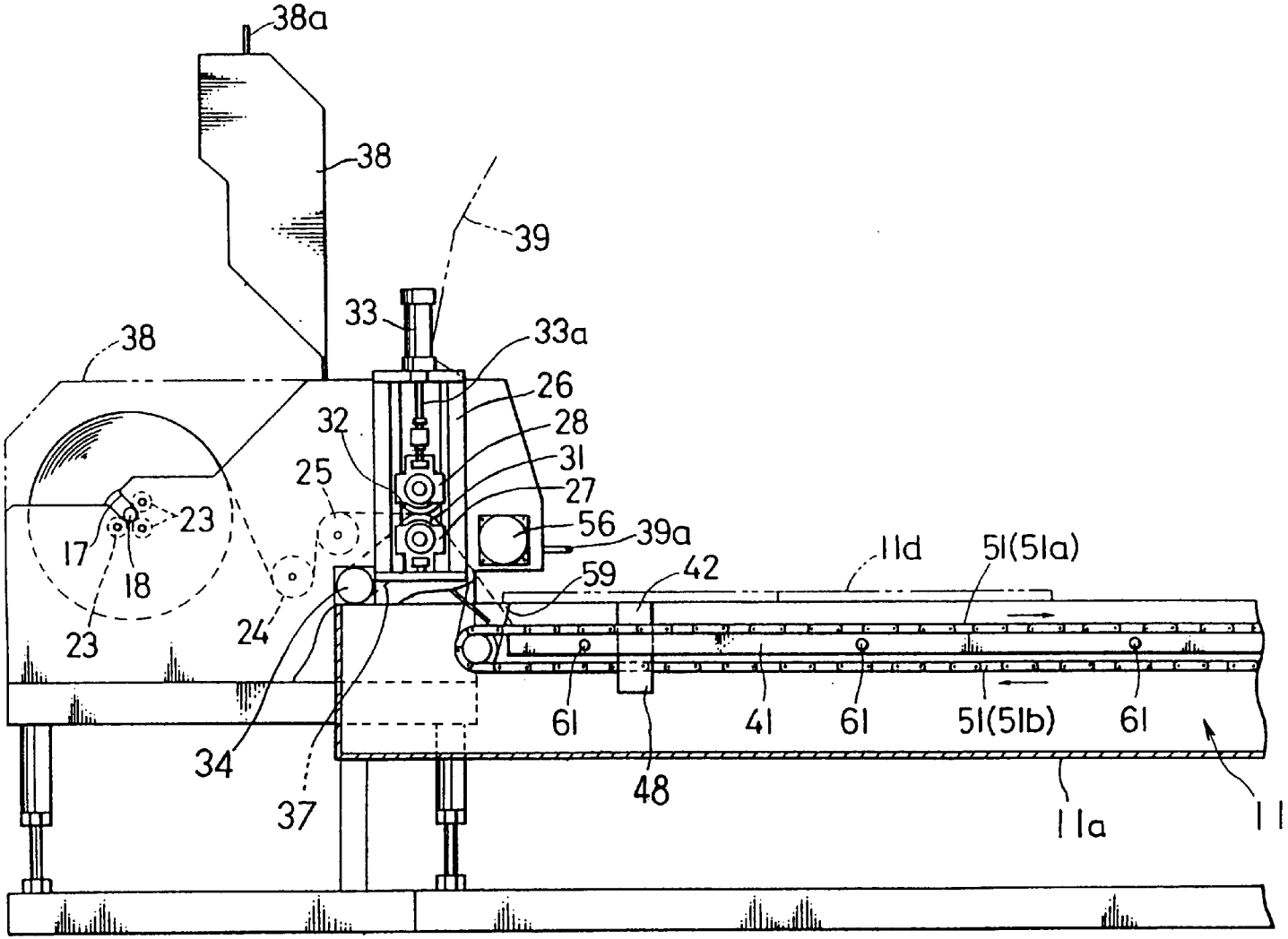
FIG. 4 is a front view showing a par of the printing apparatus shown in FIG. 2.
Figure 5:
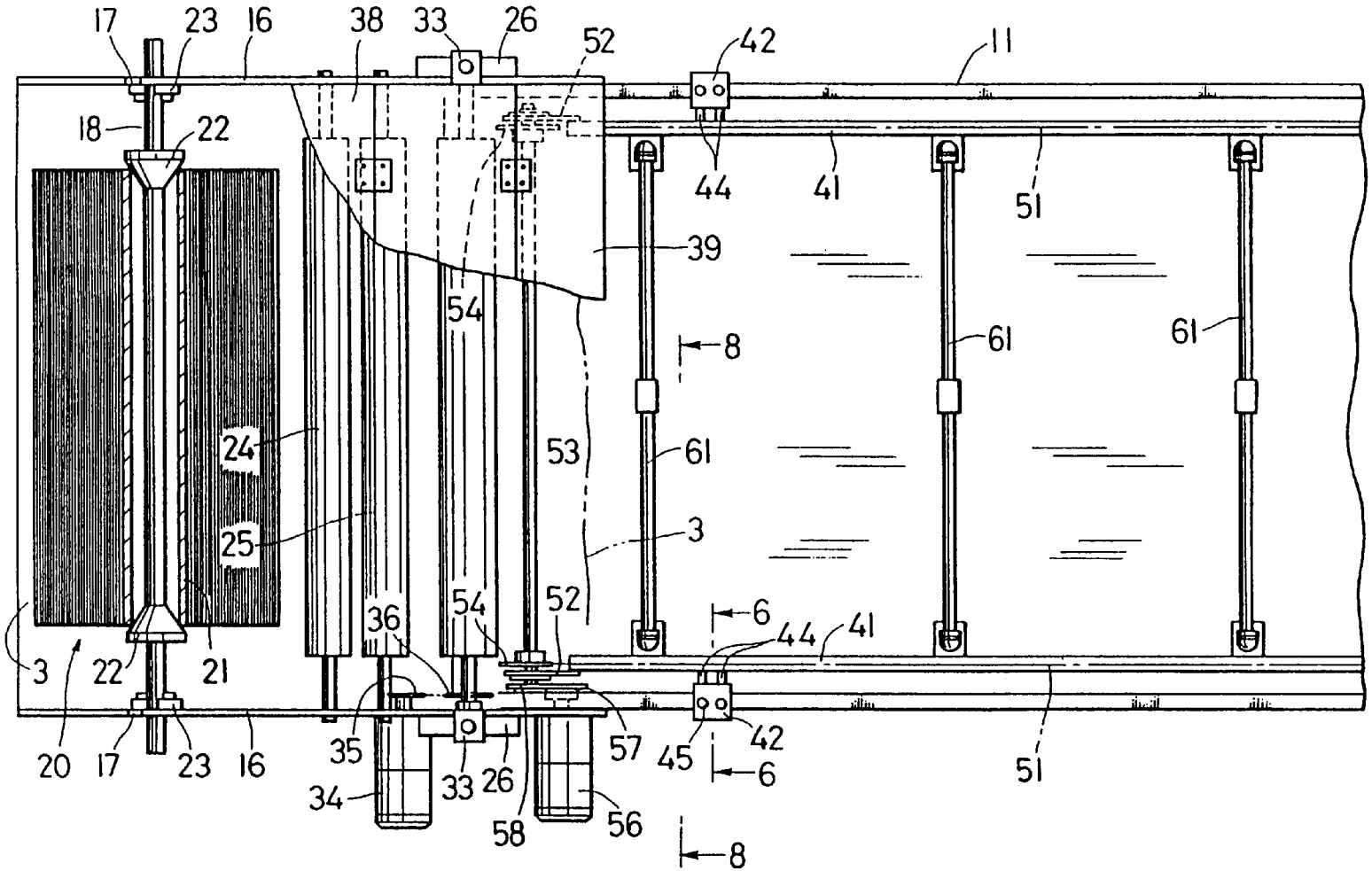
FIG. 5 is a plan view of FIG. 4.

In the next, the details of the transfer sheet feed section 12 shown in FIGS. 2 and 3 will be as shown in FIGS. 4 and 5.

Two support plates 16 parallel with each other are attached vertically to the water tank 11, as shown in the figures, and a roll shaft 18 is inserted to grooves 17 respectively formed in the support plates 16. The roll shaft 18 can be detachably supported on the support plates 16.

The roll shaft 18 serves to support a transfer roll 20 formed by winding a transfer sheet 3 around a roll core 21, and the transfer roll 20 is attached so as to make the center of the roll correspond to the center of the roll shaft 18 by an aligning member 22 having a tapered portion and detachably attached on the roll shaft 18. A plurality of rollers 23 for supporting the roll shaft 18 are attached on the inner surfaces of the support plates 16 so that rotation of the roll shaft 18 is smoothened.

Two auxiliary rollers 24 and 25 are attached to each of the support plates 16, in parallel with the roll shaft 18. Guide members 26 are respectively attached to the support plates 16, and a drive roller 31 is rotatably attached onto bearings 27 respectively provided for the guide members 26. Further, a bearing 28 is attached to each of the guide members 26 such that the guide members 26 are movable in the vertical direction, and a tension roller 32 is rotatably attached to the bearings 28.

Each of the guide members 26 is equipped with an air-pressure cylinder 33, and the top ends of rods 33*a* which are moved up and down by the air-pressure cylinders 33 are connected to the bearing 28, respectively. By operating the air-pressure cylinders 33, the tension roller 32 is moved to be close to or apart from the drive roller 31.

To rotate the drive roller 31, one of the support plates 16 is equipped with a drive motor 34, and a chain 37 is tensioned between a sprocket 35 attached to the shaft of the drive motor 34 and a sprocket 37 attached to the drive roller 31. Therefore, as the drive roller 31 is rotated by the drive motor 34, the transfer sheet 3 is conveyed toward the water tank 11, guided by the auxiliary rollers 24 and 25.

The transfer sheet feed section 12 is provided with an open/close cover 38 to attach and detach the transfer roll 20. In FIG. 4, a continuous line indicates a state in which the open/close cover 38 is opened and a two-dot chain line indicates a state in which the open/close cover 38 is closed. The transfer sheet feed section 12 is further provided with an open/close cover 39 used for maintenance. In FIG. 4, a two-dot chain line indicates a state in which the open/close cover 39 is opened. Reference numeral 39*a* denotes a handle.

Figure 6:
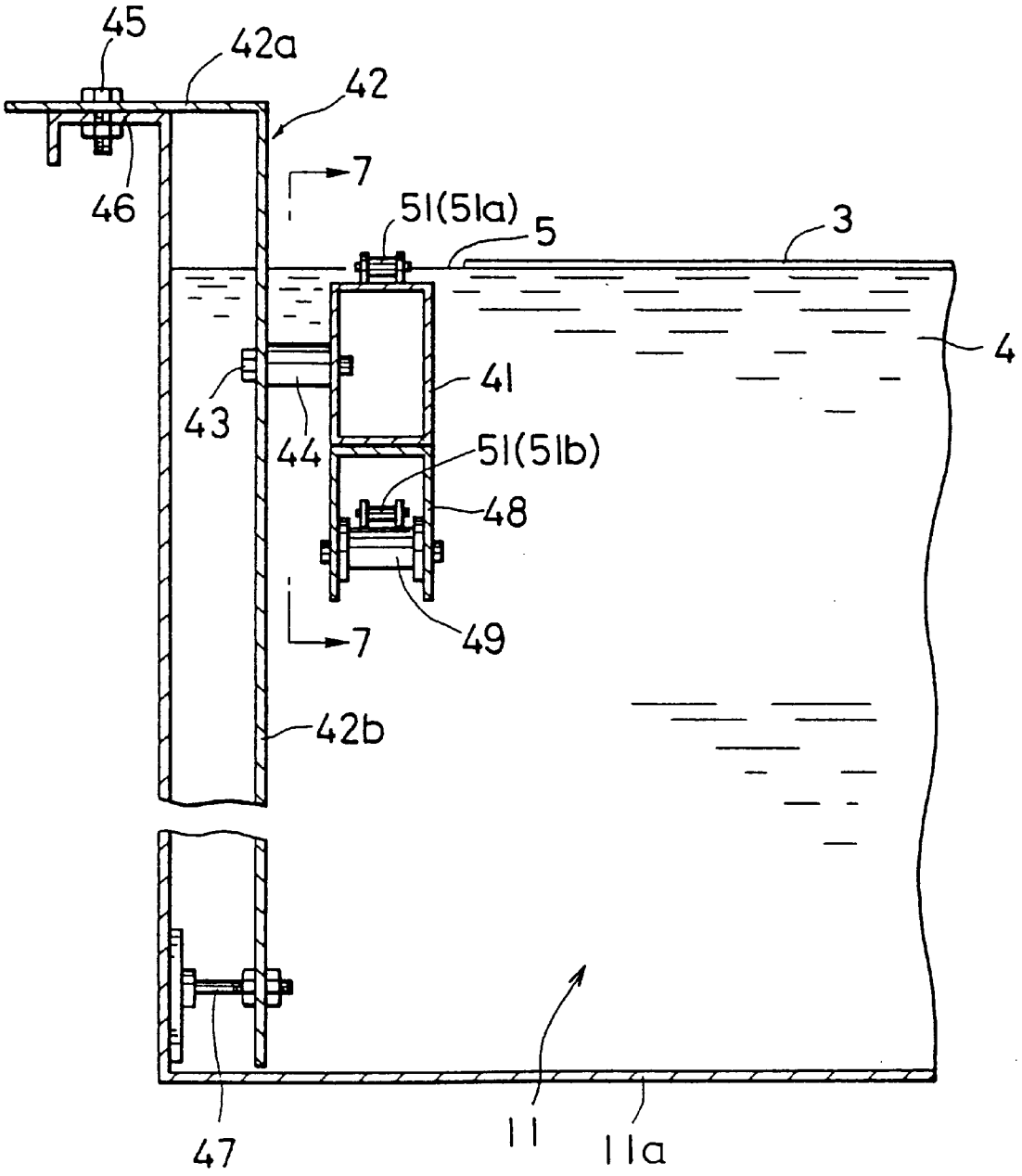
FIG. 6 is a cross-sectional view cut along the line 6—6 in FIG. 5.

Inside the water tank 11, chain receiver bases 41 are provided along both of the side walls of the water tank 11. Each of the chain receiver bases 41 is fixed to the water tank 11 by brackets 42 each having a horizontal portion 42*a* and a vertical portion 42*b*, as shown in FIG. 6. The brackets 42 and the chain receiver bases 41 are fastened by bolts 43. A plurality of brackets 42 are provided at a predetermined interval in the longitudinal direction of the water tank 11, and the distance between each chain receiver base 41 and the brackets 42 is set by spacers 44 which the bolts 43 penetrate. Since the water tank 11 is arranged to be shallower at the bottom 11*a* in the left side A than at the bottom 11*b* in the right side B, the lengths of the vertical portions 42*b* of the chain receiver bases 41 are set so as to correspond to the depth of the water tank in the left side A and that in the right side B.

Bolts 45 for fixing the brackets 42 to the water tank 11 are each elongated in the width direction of the water tank 11 and respectively penetrate long holes 46 formed in the horizontal portions 42*a*. By adjusting the positions of the brackets 42, the positions of the chain receiver bases 41 are adjusted in the width wise direction of the water tank 11. The distances between the water tank 11 and the lower ends of the vertical portions 42*b* of the brackets 42 are adjusted by adjust bolts 47.

Figure 7:
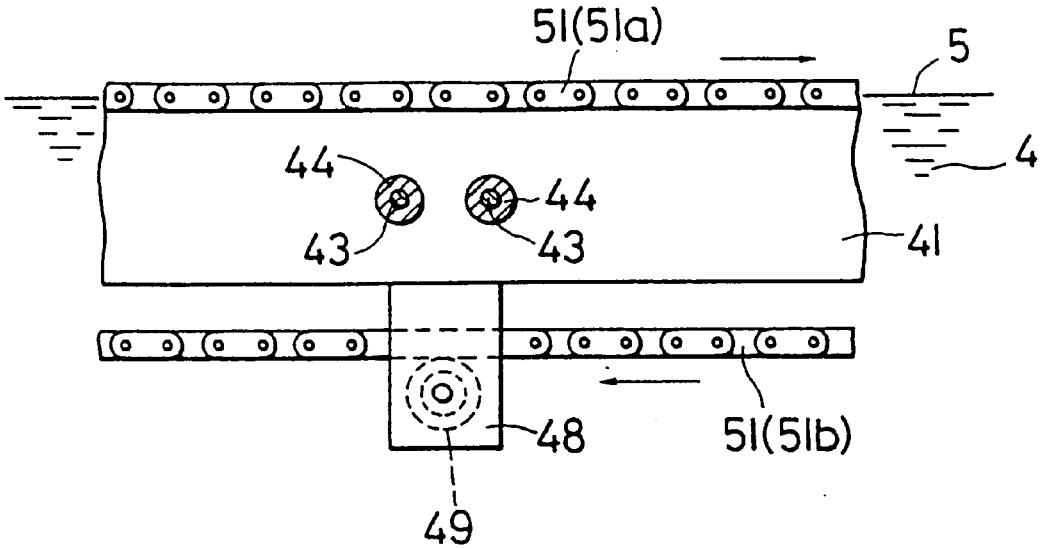
FIG. 7 is a cross-sectional view cut along the line 7—7 in FIG. 6.

The chain receiver bases 41 are respectively provided with endless chains 51 which constitute a partition member conveyer means. As shown in FIG. 7, in the forward section 51*a* of each chain 51 where the chain moves forward (the section where the chain moves in the same direction as the water surface 5 moves), the chain is guided by the chain receiver base 41, sliding on the upper surface of the chain receiver base 41. To support the chains 51 in their return sections, support rollers 49 are rotatably provided respectively for the brackets 48 provided at a predetermined interval on each chain receiver base 41, and the chains 51 are guided by the support rollers 49 in their return sections 51*b*.

In the upstream side, the water tank 11 is covered by a plurality of cover plates 11*d* which are detachable, as shown in FIGS. 2 and 3, and dust is prevented from sticking to the transfer sheet 3.

The portion of the water tank 11 that is in the downstream side of the cover plates 11*d* serves as a transfer zone denoted at reference 50 in FIG. 3, or a transfer area. In the present embodiment, the right side B where the bottom 11*b* is deeper is made correspond to the transfer zone 50. However, the bottom 11*a* in the left side Amay be shortened within a range in which the base sheet 1 can be dissolved. Inversely, the right side B can be shortened within a range in which the step of pressing the objects 9 against the print layer 2 by upward and downward movement of the holder 10 shown in FIG. 2.

As shown in FIG. 5, a drive shaft 53 is supported on an end portion of each chain receiver base 41 by a bracket 52. The chains 51 described above are tensioned between sprockets 54 provided on the drive shaft 53, and sprockets 55 rotatably attached to the chain bases 41 or the water tank 11. In place of the chains 51, rubber-made timing belts may be used.

To drive the chains 51, a chain 59 is tensioned between a sprocket 57 provided on the shaft of the drive motor 56 attached to a support plate 16, and a sprocket 58 attached to the drive shaft 53, as shown in FIGS. 4 and 5. The convey speed of the chains 51 is adjusted by inverter-controlling the drive motor 56.

The water 4 is contained in the water tank 11 such that the water surface 5 is positioned at the center portion of each of the chains 51 in the vertical direction in the forward section of the chain. That is, in the forward section of the chain 51, the upper portion of each chain 51 is exposed from the water surface 5 in the forward section 51*a*.

The surface portion of the water 4 contained in the water tank 11 forms a flow in the direction from an end portion of the water tank to the other end portion thereof, e.g., a flow from the left end portion in FIG. 2 toward the over flow tank 15 at the right end portion. To form this flow, a plurality of water feed pipes 61 extending in the width direction of the water tank 11 are provided at a predetermined interval in the longitudinal direction of the water tank 11. These water feed pipes 61 constitute a water flow forming means.

In the transfer zone 50, a water feed pipe for injecting water obliquely in an upward direction from under the water surface 5 may be provided at a position after a position where the transfer step using the upward and downward movement of the holder 10 is completed, like the water feed pipes 61. By providing such a structure, a residual print layer remaining after completion of the transfer can be forcibly made overflow. Therefore, the flow of the works in the transfer step can be hastened in comparison with the case where such an overflow is attained naturally.

Figure 8:
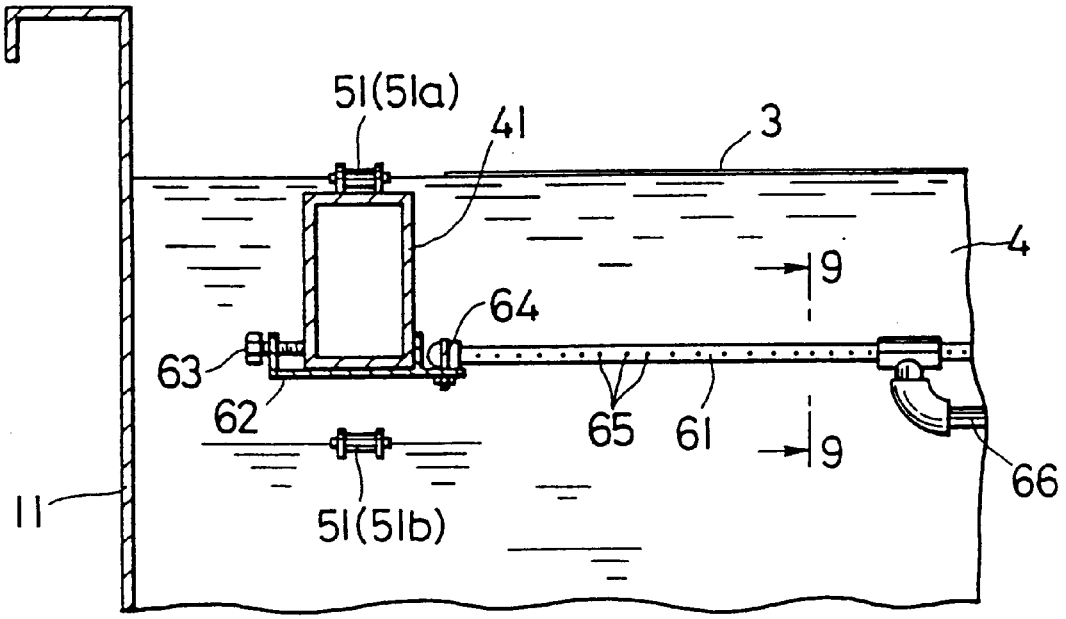
FIG. 8 is a cross-sectional view cut along the line 8—8 in FIG. 5.

As shown in FIG. 8, the water feed pipes 61 are detachably attached to the chain receiver bases 41 by a pipe bracket 62. The pipe bracket 62 is fastened to the chain receiver bases 41 by bolts 63, and the end portions of the water feed pipes 61 are fastened to the pipe bracket 62 by U-shaped bolts 64.

Figure 9:
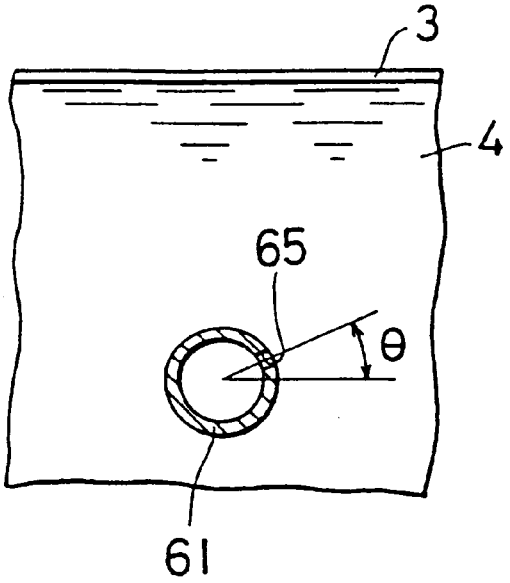
FIG. 9 is a cross-sectional view cut along the line 9—9 in FIG. 8.

A number of water injection holes 65 are formed at a predetermined interval in the water feed pipes 61, and each of the water injection holes 65 is directed upward to the other end portion side, inclined at an angle θ to the horizontal plane as shown in FIG. 9. The inclination angle θ should preferably be 15 to 50°. The water feed pipes 61 are connected with a feed pipe 66 so that water is supplied from a water feed pump not shown.

When water is injected from the water injection holes 65, a flow from an end portion of the left side A of the water tank 11 to the right side B thereof is formed at the surface portion of the water 4. The flow speed of the water surface 5 generated by this flow is about 100 to 400 cm/min. The moving speed of the chains 51 is set to be substantially equal to the flow speed of the water surface 5. However, the flow speed of the water surface 5 and the convey speed of the chains 51 are set to be slightly faster than the speed at which the transfer sheet 3 is fed from the transfer roll 20, and as a result, the transfer sheet 3 is applied with a slight tension force so that the transfer sheet 3 might not be wrinkled.

Figure 10:
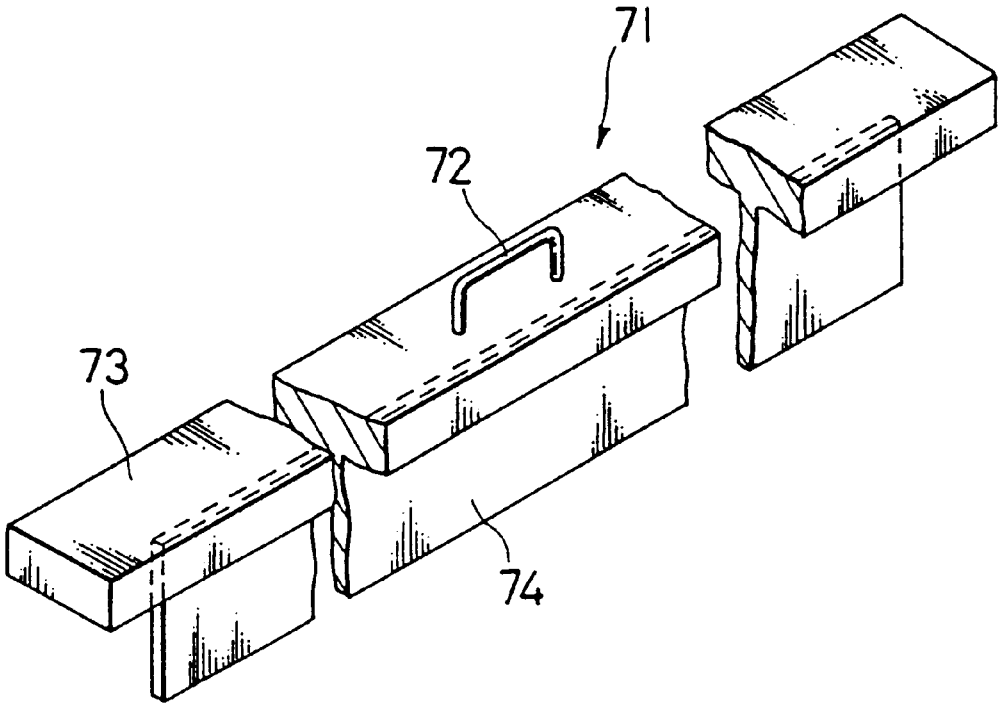
FIG. 10 is a partially omitted perspective view showing a partition member according to an embodiment of the present invention.

FIG. 10 shows a partition member 71 mounted on both the chains 51. The partition member 71 comprises a rod member 73 having a handle 72 provided on its upper surface, and a partition plate 74 provided on the lower surface of the member 73. The length of the rod member 73 is arranged so as to correspond to the distance between the two chains 51, and the partition plate 74 is shorter than the rod member 73.

Figure 11:
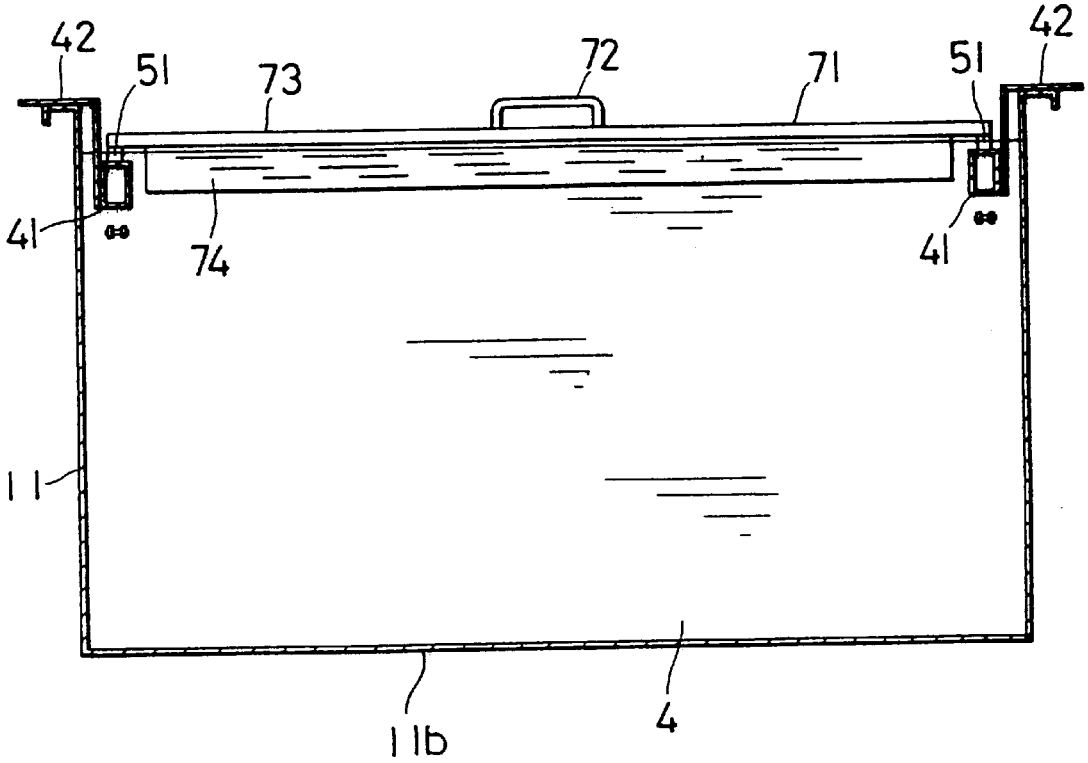
FIG. 11 is a lateral cross-sectional view of a water tank where partition members are provided.
Figure 12A:
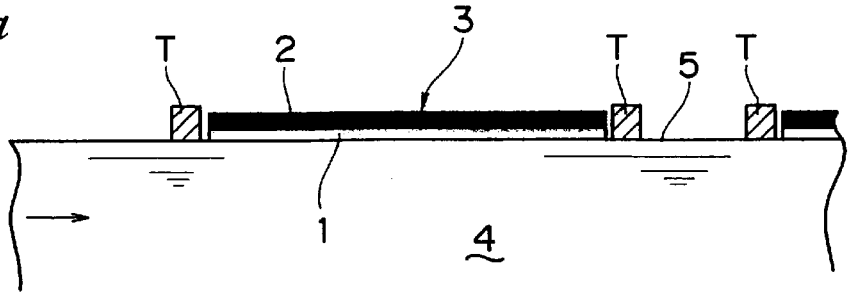
FIGS. 12(*a*)–12(*d*) are views showing printing steps of a printing method according to another embodiment of the present invention.
Figure 12B:
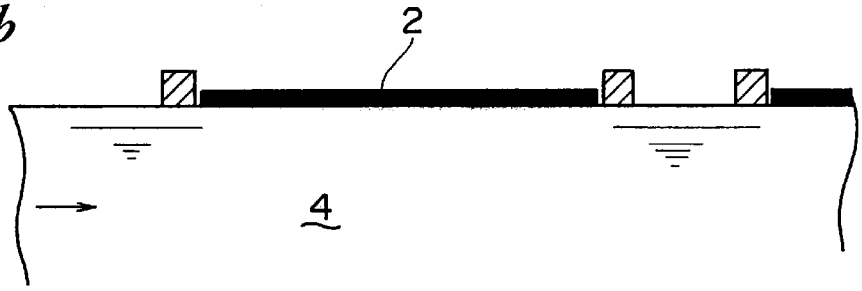
Figure 12C:
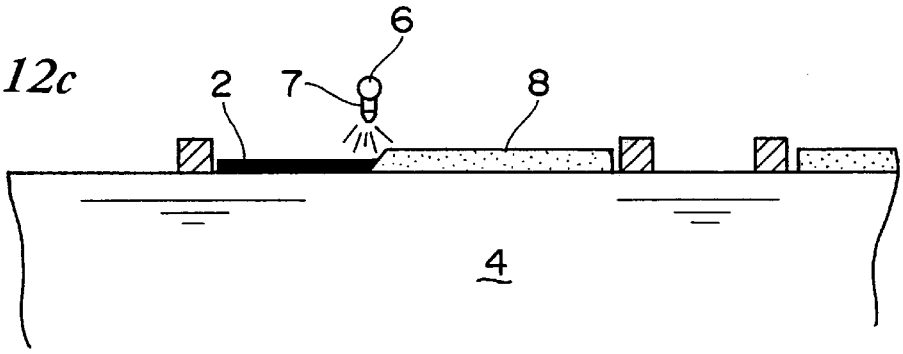
Figure 12D:
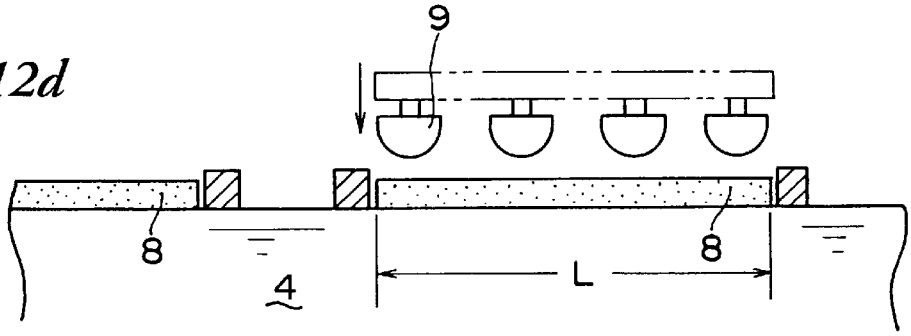

FIG. 11 shows a state where a partition member 71 is mounted on both of the chains 51. If the partition member 71 is thus mounted on the chains 51, the portion of the partition plate 74 enters into the water 4, and the partition member 71 is moved to the downstream side, with their both ends supported on the chains 51 and with the transfer sheet 3 separated at a predetermined length.

Explanation will now be made to operation procedure of performing printing on objects with use of a printing apparatus described above.

By driving the drive motor 34 with the transfer sheet 3 kept fed from the transfer roll 20 and clamped between the drive roller 31 and the tension roller 32, the transfer sheet 3 is fed onto the water surface 5 in the left side A where the water tank 11 has a shallower bottom 11*a*. The transfer sheet 3 floats with the base sheet 1 kept in contact with the water surface or liquid surface 5. Since a slow flow from the upstream side to the downstream side is formed at the water surface 5 in the water tank 11 by water injected from the water injection holes 65 of the water feed pipes 61, the transfer sheet 3 is conveyed slowly toward the downstream side without forming wrinkles by the feed of the transfer sheet 3 by the drive motor 34 and by the flow of the water surface 5 slightly faster than the feed speed of the transfer sheet 3.

By the flow of the water surface 5 to the downstream side, the top end of the transfer sheet 3 reaches a predetermined position and the base sheet 1 is dissolved. Then, the partition member 71 is mounted on the chains 51, at first, in the upstream side of the transfer zone 50, e.g., at a position immediately after the position where the transfer sheet 3 passes the cover plate 11*d* in FIG. 2, or with a semi-fluidal print pattern 8 formed by applying an adhesion when the top end of the transfer sheet 3 reaches a position somewhat in the upstream side of the reference symbol 71*a* in FIG. 2.

The partition member 71 mounted on the chains 51 is conveyed to the downstream side at a speed synchronized with the flow of the water surface 5 by driving the chains 51 by the drive motor 56. Thus, in the step in which the transfer sheet 3 is let flow to the downstream side, the base sheet 1 is dissolved, and an adhesion is applied from nozzles 7 as an adhesion application means to such a portion of the print layer remaining after the step that is used in one time of transfer operation, as shown in FIG. 2. As described above, if the partition member 71 is mounted, slightly deviated to the upstream side from the position indicated by the reference 71*a*, application of the adhesion is carried out in the upstream side before operation of mounting the partition member is completed.

At the same time, if only the center portion of the print layer 2 in the width direction is transferred, the adhesion is applied only to the center portion used for the transfer.

Of the transfer sheet 3, the lower base sheet 1 is gradually dissolved or swelled in the water 4 while it is conveyed and floats on the water surface 5, passing over the left side A of the water tank 11, i.e., the shallow portion of the bottom 11*a*. Application of an adhesion may be carried out while the base sheet 1 is being dissolved or after the dissolving is completed.

By applying an adhesion, the print layer 2 becomes a semi-fluidal print pattern 8 and therefore tends to spread over the water surface 5. However, the downstream side end of the pattern of the print pattern 8 is restricted by the partition member 71, and the left and right sides of the pattern are restricted by the chains 51*a* in the forward sections, so that the spreading of the pattern is restricted. That is, in the upstream side of the portion applied with the adhesion, the spreading is restricted by the portion applied with no adhesion, and in the downstream side thereof, the spreading is restricted by the partition member 71.

Thus, while the spreading of the downstream end of the pattern of the print layer 2 is prevented by the partition member 71, the holder 10 (or object moving means) holding the objects 9 is moved downward toward the water surface 5 to transfer the pattern onto the objects 9 by the water pressure, as is indicated by a two-dot chain line in FIG. 2. The objects 9 are lifted up by moving upward the holder 10 before the objects 9 reach the downstream end of the water tank 11. The objects 9 are conveyed to the outside by a convey means such as a crane or the like, and new objects 9 are conveyed in for transfer operation.

The portion of the print pattern that is not used for the transfer is discharged into the overflow tank 15 over the partition wall 14. Water which has flown into the overflow tank 15 is cleaned by a filter and is thereafter injected again.

The partition member 71 conveyed by the chains 51 to a position 71*a* near the downstream end of the water tank 11 is detached from the water tank 11. In the transfer operation for the second and later time, the partition member 71 is returned to a set position 71*b* shown in FIG. 2 after it is washed and cleaned, and restricts spreading of the downstream end portion of the print layer 2 when an adhesion is applied to the portion in the upstream side of the partition member 71 to perform transfer operation on next objects. Further, transfer operation is performed until the partition member 71 is conveyed to the position 71*a*.

If the partition member 71 is thus mounted at the position indicated by the reference 71*b*, the downstream end or the top end of the print pattern is prevented from spreading, and the portion of the print pattern that is used for next transfer is cut in form of a sharp cut line.

Before the transfer operation for the second and later time, the partition member 71 is returned to the position of the reference 71*b*. However, the position to which the partition member 71 is returned may be situated at an arbitrary position in the upstream or downstream side of the position indicated by the reference 71*b*, depending on the dimensions of the portion of the pattern that is used for every time of transfer. Thus, one partition member 71 is repeatedly used as indicated by one-dot chain line in FIG. 2.

It is also possible to change the positions of the water feed pipes 61 in correspondence with the length of the portion of a pattern that is used for one time of transfer. That is, if the water feed pipes 61 are provided in the downstream side of the position where the partition member 71 is set, the water feed pipes 61 interfere with the partition member 71. A plurality of water feed pipes 61 are therefore provided in the upstream side of the position where the transfer operation is performed.

In the embodiment described above, explanation has been made of a case where transfer is carried out with use of small objects 9. However, transfer of a pattern maybe performed on long large objects. In this case, if the range in the left side A is set to be a minimum range which can dissolve the base sheet 1, a range having a water depth which allows objects 9 to sink can be maintained as the right side B. The step of spraying an adhesion may be carried out in a range outside the left side A.

If it is impossible to obtain a distance which allows an object to move together with the water surface 5 when a pattern is transferred to a large object having a long size, a timer is operated so as to stop feeding the transfer sheet 3 from the transfer roll 20 and so as to stop driving the chains 51. Then, transfer operation maybe performed in such a standstill condition.

However, water may be kept injected from the water injection holes 65 of the water feed pipes 61. Since the region of the print pattern 8 that is used once is separated by the partition member 71, the flow of water is stopped when the movement of the partition member 71 is stopped even if a flow exists at the water surface 5. With respect to a large object, a pattern can be transferred by only moving upward and downward the object without deforming the pattern.

Thus, the pattern of the print layer 2 can be sequentially printed repeatedly at a predetermined time cycle, onto a plurality of objects 9 or a large object having a long size held by the holder 10, without deforming the pattern. In this time, the period of the print cycle maybe the time required to convey the portion used for one time of transfer operation to the transfer zone 50, since the base sheet 1 of the transfer sheet 3 is sufficiently dissolved or swelled in the upstream side of the water tank 11. Thus, the transfer cycle period can be shortened and a high quality pattern can be printed rapidly, so that printing can be performed efficiently on a large number of products particularly in case where mass-products are used as objects.

In addition, since a pattern is printed onto objects with use of the water pressure, the pattern can be printed with high quality without forming wrinkles with respect to an object having concave and convex portions or having a curved surface.

In case of using a transfer sheet having a width different from that shown in the figures as the transfer sheet 3, the brackets 42 are moved and adjusted in the width direction of the water tank 11 to change the distance between two chains 51.

Note that any material can be used as the material forming the base sheet 1 as long as the material is water-soluble, and polyacrylic acid soda, methylcellulose, carboxyl methylcellulose, polyethylene oxide, polyvinyl pyrolidone, or acrylic acid amide can be used in addition to polyvinyl alcohol described before.

In addition, a material obtained by applying starch onto a band-like thin paper sheet and by forming a print layer of a pattern on the starch layer may be used as the material of the base sheet 1. If this type of base sheet 1 is used, starch is dissolved in water and the starch layer of the base sheet 1 is dissolved as the base sheet 1 is conveyed floating on the water surface 5. Therefore, the thin paper sheet is deposited in the water tank 11 so that only the print layer can be made remain and float on the water surface 5.

Next, explanation will be made of a printing apparatus and a printing method according to Embodiment 2 constructed in a structure in which a transfer sheet 3 cut in a predetermined length is conveyed to the water surface.

In this embodiment, the basic steps of printing is almost similar to those in the above Embodiment 1, and the difference is that after the transfer sheet 3 is cut in a predetermined length, it is shifted to the water surface.

In the present embodiment, as shown in FIGS. 12(*a*) to 12(*d*), a print layer 2 having an arbitrary pattern is formed on the surface of a base sheet 1 by print ink or paint, and a transfer sheet 3 is formed by the base sheet 1 and the print layer 2 formed thereon. The base sheet 1 is made of a material which is easily dissolved or swelled in water, and the base sheet 1 is water-soluble. In FIG. 12, a polyvinyl alcohol is used as the material forming the water-soluble base sheet 1. As the print ink, paint obtained by dissolving a vinyl chloride resin in a solvent is used.

The transfer sheet 3 is prepared in a manner in which printing is performed on the surface of the base sheet 1 with print ink or paint by a known printer to form a print layer 2 on the base sheet 1, which is thereafter rolled.

FIG. 12(*a*) shows a state in which transfer sheets 3 each cut at a predetermined length are let float on the water surface 5 of water 4, with the transfer sheets 3 partitioned from each other by partition members T. The transfer sheets 3 float on the water 4 such that the base sheets 1 are kept in contact with the water surface 5 and that the print layers 2 face upward. As shown in the figure, the water 4 flows slowly in the direction indicated by an arrow, and the transfer sheets 3 partitioned by the partition members T and floating on the water surface 5 are moved in the direction indicated by the arrow. Note that the moving speed of the partition members T and the speed of the flow of the water 4 are set to be equal to each other so that the transfer sheets 3 partitioned by the partition members T and cut at a predetermined length are not wrinkled.

FIG. 12(*b*) shows a state in which the base sheet 1 of a transfer sheet 3 is dissolved in the water 4 while the transfer sheet 3 is being moved on the water 4, as in the Embodiment 1 as explained above. The base sheet 1 starts dissolving or swelling upon making contact with the water 4 and is then dissolved gradually as the time is elapsed while being fed to the downstream side. The flow of the water hastens the dissolving of the water-soluble base sheet 1.

FIG. 12(*c*) shows a state in which an adhesion made of an epoxy resin is sprayed onto the print layer 2 floating on the water surface 5 after the base sheet 1 is dissolved in the water.

The adhesion is sprayed in form of a mist from a plurality of nozzles 7 provided on an adhesion feed pipe 6 at a predetermined interval in the width direction of the transfer sheet 3. By moving the nozzles 7 in the horizontal direction, the adhesion is applied uniformly on the surface of the print layer 2 so that the print layer 2 is formed into a semi-fluidal print pattern 8. Note that application of the adhesion may be carried out not only automatically but also manually by an operator.

FIG. 12(*d*) shows a state in which a plurality of objects 9 are held by a holder 10. By moving the objects 9 downward by the holder 10, the objects 9 are pressed against the print pattern 8, so that the print pattern is transferred onto the objects 9.

As shown in FIG. 12(*d*), the transfer sheet 3 is cut into a length L required for the transfer onto the objects 9.

The object 9 having curved surfaces are let sink in the water 4, and then, the print pattern 8 is uniformly pressed against the entire surfaces of the objects 9, so that the pattern is securely transferred and printed onto the curved surfaces.

Also as shown in FIG. 12(*c*), by applying an adhesion to the print layer 2, a print pattern 8 having semi-fluidity and adhesiveness is formed after the print layer 2 is dissolved and softened. Thus, adhesiveness of the print pattern to the objects 9 is obtained. Further, an adhesion may be previously applied to the surfaces of the objects 9, in addition to the print layer 2.

In the present embodiment, the adhesion is applied after the base sheet 1 is sufficiently dissolved in the water 4, as shown in FIG. 12. However, the adhesion may be applied while feeding the transfer sheet 3 halfway in the step in which the base sheet 1 is dissolved by feeding the transfer sheet, i.e., before the base sheet 1 is completely dissolved. In this case, the objects 9 may be pressed against the print layer 2 to transfer the pattern before the base sheet 1 is completely dissolved, i.e., while it is being dissolved.

The thickness of the water-soluble base sheet 1 is about 30 to 50 $\mu$m like in the Embodiment 1 described above. If the base sheet 1 is too thin, it is not easy to print the pattern onto the base sheet 1. If the base sheet 1 is otherwise too thick, the base sheet 1 cannot be dissolved before it reaches to the downstream end, flowing on the water surface 4 in the water tank 11.

Therefore, when a polyvinyl alcohol is used as the material of the base sheet 1, the thickness is set as described above. On the base sheet 1 having the thickness described above, a print layer 2 having a thickness of 5 to 200 $\mu$m is formed with a pattern.

Any kind of adhesion may be used as long as it serves to adhere the print layer 2 onto the objects 9. Like in the Embodiment 1 described above, in case where ink obtained by dissolving a vinyl chloride resin in a solvent is used as print ink as has been described above, thinner is sprayed as an adhesion to soften the print ink, and adhesion to the objects 9 is achieved due to the adhesion and due to the properties of the components of the resin itself.

The printing apparatus according to the present embodiment has a transfer sheet feed section 12 and a water tank 11 which substantially have the same feed mechanism as that shown in FIG. 2 in the Embodiment 1. The transfer sheet feed section 12 is provided apart from an end portion of the water tank 11 whose plane shape is a rectangular, and the transfer sheet feed section 12 and the water tank 11 are both provided on a base 13.

Figure 13:
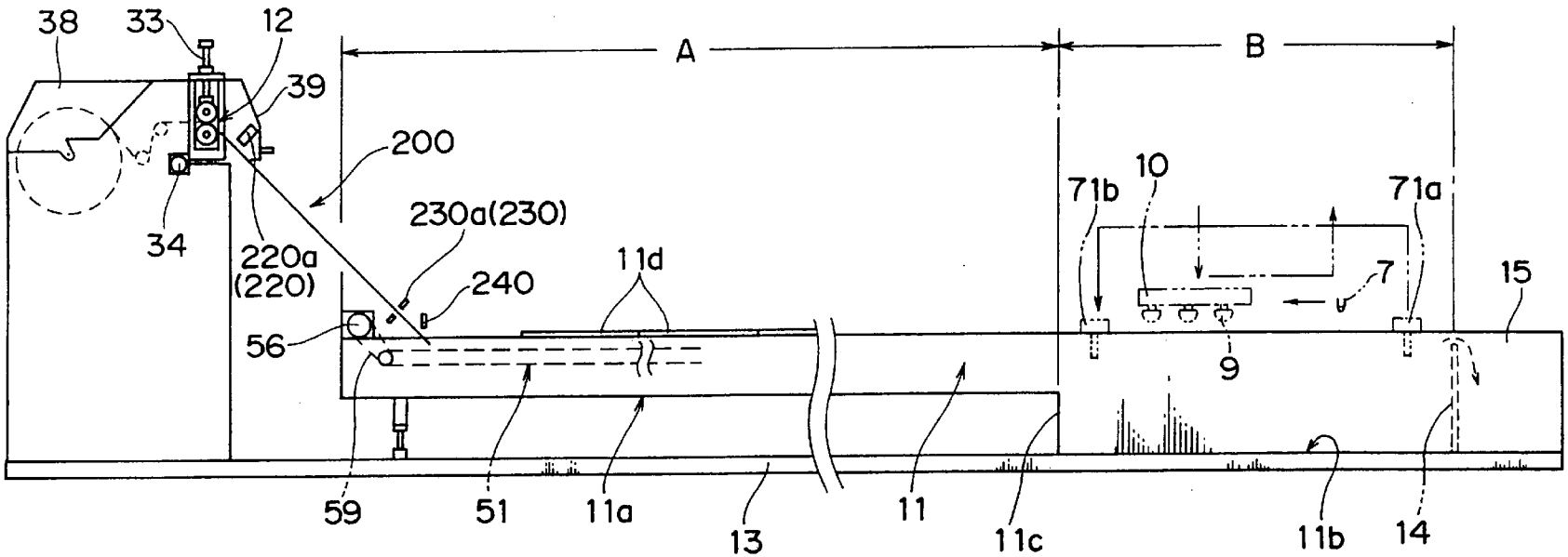
FIG. 13 is a front view showing a printing apparatus for performing the printing method shown in FIG. 12.

As shown in FIG. 13, a cutting section 200 for the transfer sheet 3 is provided close to the transfer sheet feed section 12. The transfer sheet feed section 12 is different from that of the printing apparatus according to the Embodiment 1 shown in FIG. 2, in that the transfer sheet feed section 12 is arranged to an upper position in an oblique direction, apart from the water tank 11, so that a distance is maintained from the transfer sheet feed section 12 to the water surface of the water tank 11.

FIG. 13 shows a case where the transfer sheet feed section 12 is installed separately. The transfer sheet feed section 12 may be constructed to be integral with the water tank 11.

The water tank 11 is arranged to be shallower at a bottom 11*a* thereof in the left side A than at a bottom 11*b* thereof in the right side B where a transfer step described later is performed.

The depth in the left side A is set to be about half of the depth in the right side B. The bottom 11*a* is extended horizontally like a plane to a side plate 11*c* in the right side B having the deeper bottom 11*b*. Note that the bottom 11*a* need not be horizontal as described above but may be formed to have a downward gradient toward the right side B, for example.

Further, an overflow tank 15 is partitioned by a partition wall 14 at the other end portion of the water tank 11. In the water tank 11, water 4 flows from the left side to the right side as the upstream side.

The height of the water surface 5 of the water 4 which is contained in the water tank 11 and flows from the upstream side to the downstream side is set depending on the position of the upper end surface of the partition wall 14. When adjusting the height of the water surface 5, the upper end position of the partition wall 14 is set such that the upper end side of each conveyer chain is slightly higher than the water surface 5, and the both side ends of the transfer sheet 3 floating on the water surface 5 are situated between the conveyer chains 51 running from the left to the right.

The water 4 is set to a predetermined temperature of about 20 to 30° C., for example, so that the base sheet 1 is dissolved in a predetermined time period. An agent which hastens dissolving of the water-soluble base sheet may be mixed into this water.

Thus, in the water tank 11 constructed in the structure described above, since the depth is not arranged to be uniform from the left side A to the right side B, the capacity of the water tank 11 can be decreased to reduce the quantity of water filled in the water tank 11. Accordingly, it is possible to shorten the warm-up period required until the temperature of the water necessary for dissolving the base sheet 1 reaches the temperature set as described above. In addition, the time period required for changing the temperature can be shortened.

The water temperature may be adjusted by heating the entire water to circulate in the water tank 11, or a heater means may be provided in the left side A so that at least the flow of the water in the range of the left side A falls within the temperature range as described above. Such specifications of the structure may be arranged in the same manner as in the Embodiment 1 described before.

The peripheral structure of the transfer sheet feed section 12 of the printing apparatus according to the present embodiment is arranged as follows.

Although the transfer sheet feed section 12 is constructed independently from the water tank 11, this section 12 has a structure basically similar to the Embodiment 1 described above. For example, two support plates 16 parallel with each other are attached vertically to the water tank 11, as shown in FIGS. 4 and 5, and a roll shaft 18 is inserted to grooves 17 respectively formed in the support plates 16. The roll shaft 18 is detachably supported on the support plates 16.

The roll shaft 18 serves to support a transfer roll 20 formed by winding a transfer sheet 3 around a roll core 21, and the transfer roll 20 is attached so as to make the center of the roll correspond to the center of the roll shaft 18 by an aligning member 22 having a tapered portion and detachably attached on the roll shaft 18. A plurality of rollers 23 for supporting the roll shaft 18 are attached on the inner surfaces of the support plates 16 so that rotation of the roll shaft 18 is smoothened.

Two auxiliary rollers 24 and 25 are attached to each of the support plates 16, in parallel with the roll shaft 18. Guide members 26 are respectively attached to the support plates 16, and a drive roller 31 is rotatably attached onto bearings 27 respectively provided for the guide members 26. Further, a bearing 28 is attached to each of the guide members 26 such that the guide members 26 are movable in the vertical direction, and a tension roller 32 is rotatably attached to the bearings 28.

Each of the guide members 26 is equipped with an air-pressure cylinder 33, and the top ends of rods 33*a* which are moved up and down by the air-pressure cylinders 33 are connected to the bearing 28, respectively. By operating the air-pressure cylinders 33, the tension roller 32 is moved to be close to or apart from the drive roller 31.

To rotate the drive roller 31, one of the support plates 16 is equipped with a drive motor 34, and a chain 37 is tensioned between a sprocket 35 attached to the shaft of the drive motor 34 and a sprocket 37 attached to the drive roller 31. Therefore, as the drive roller 31 is rotated by the drive motor 34, the transfer sheet 3 is conveyed toward the cutting section 200, guided by the auxiliary rollers 24 and 25.

The transfer sheet feed section 12 according to the present embodiment is also provided with an open/close cover 38 to attach and detach the transfer roll 20 and an open/close cover 39 used for maintenance, as shown in FIG. 13 like in the Embodiment 1.

Figure 14:
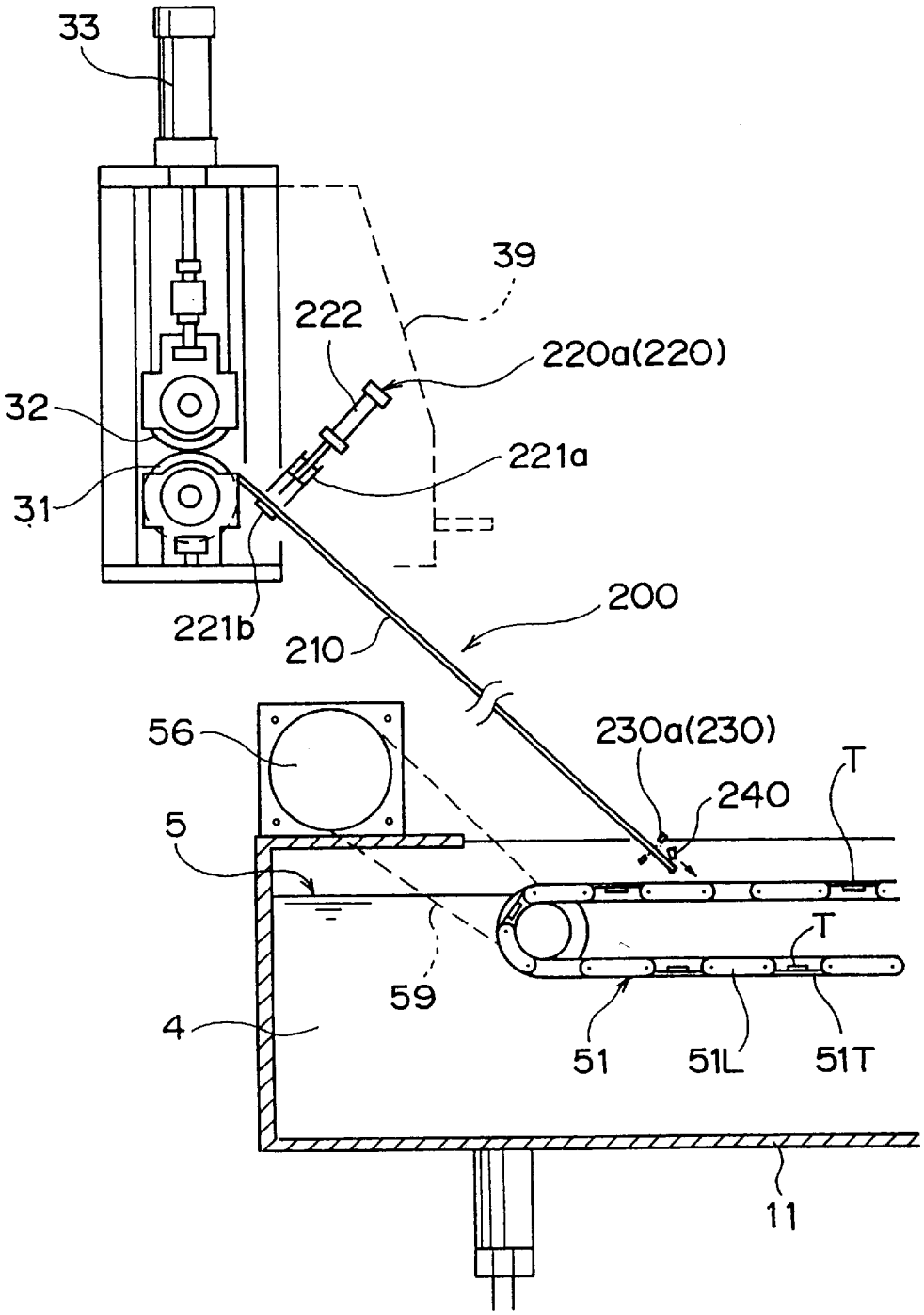
FIG. 14 is a cross-sectional view showing a main part of a cutting section of the printing apparatus shown in FIG. 13.
Figure 15:
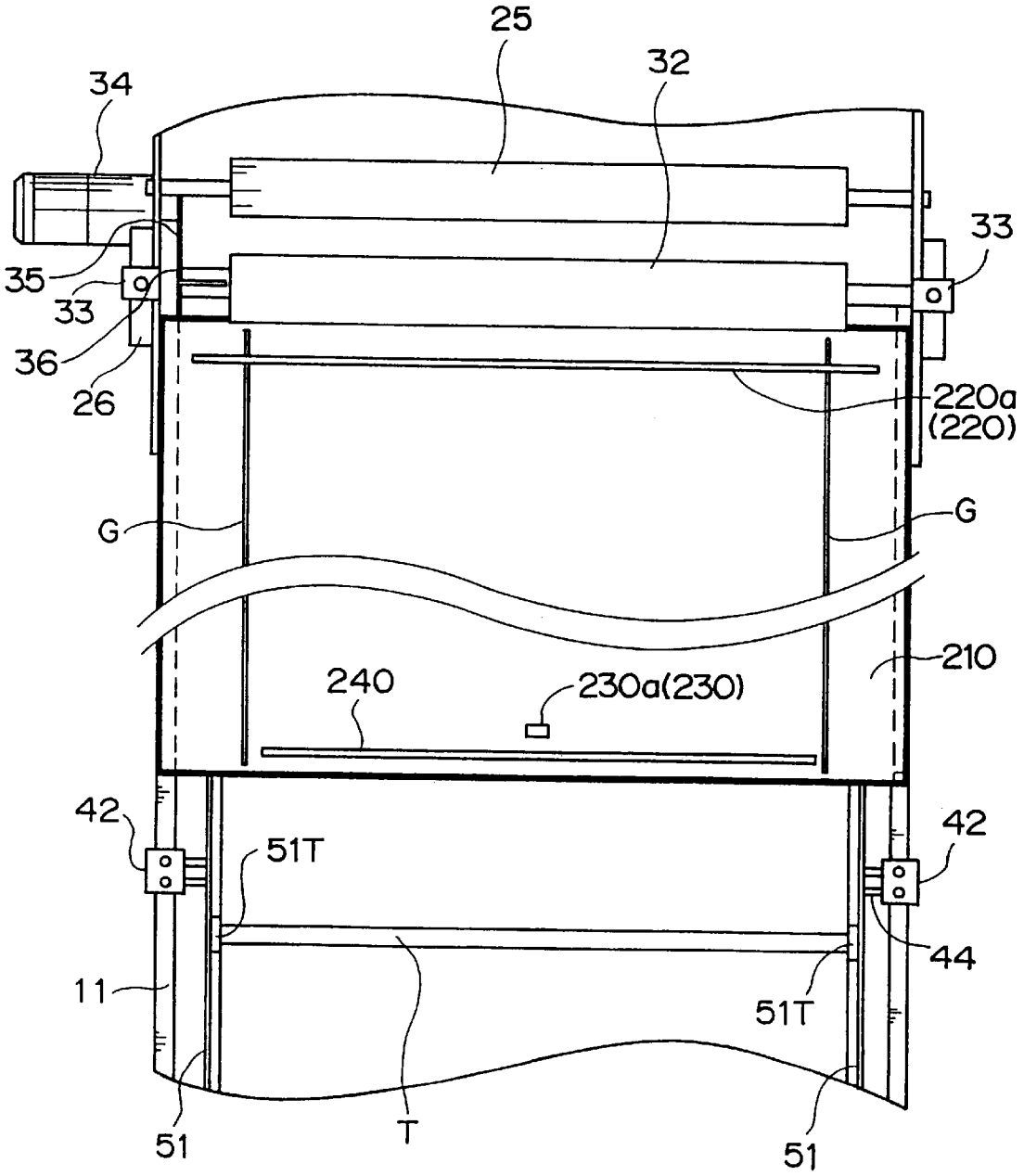
FIG. 15 is a plan view showing the cutting section of the printing apparatus shown in FIG. 13.

Also, in the present embodiment, the cutting section 200 is constructed such that a transfer sheet receiver member 210 formed like a flat plate is arranged to be inclined obliquely from the transfer sheet feed section 12 toward the water surface, as shown in FIG. 14. The transfer sheet receiver member 210 like a flat plate has a surface which is smoothened to such an extent at which the base sheet 1 of the transfer sheet 3 can smoothly moves down without stumbling to stop halfway.

The transfer sheet receiver member 210 is constructed in a rectangular shape wider than the width of the transfer sheet 3. In both sides of the transfer sheet receiver member 210, two parallel guides G are provided and adjusted to be wider than the width of the transfer sheet 3 so that the transfer sheet 3 does not go out of the inclined surface when the transfer sheet 3 moves down on the inclined surface of the transfer sheet receiver member 210.

In addition, the inclination angle of the transfer sheet receiver member 210 may be set such that the sliding speed is slightly faster than the feeding speed of the transfer sheet 3 from the transfer sheet feed section 12, in connection with the slippage of the transfer sheet 3 on the surface of the transfer sheet receiver member 210. As a result of this setting, the transfer sheet 3 is moved on the transfer sheet receiver member 210 with a tension being applied so as to pull the transfer sheet 3 toward the top of the inclined surface, and thus, wrinkling can be prevented.

Figure 16:
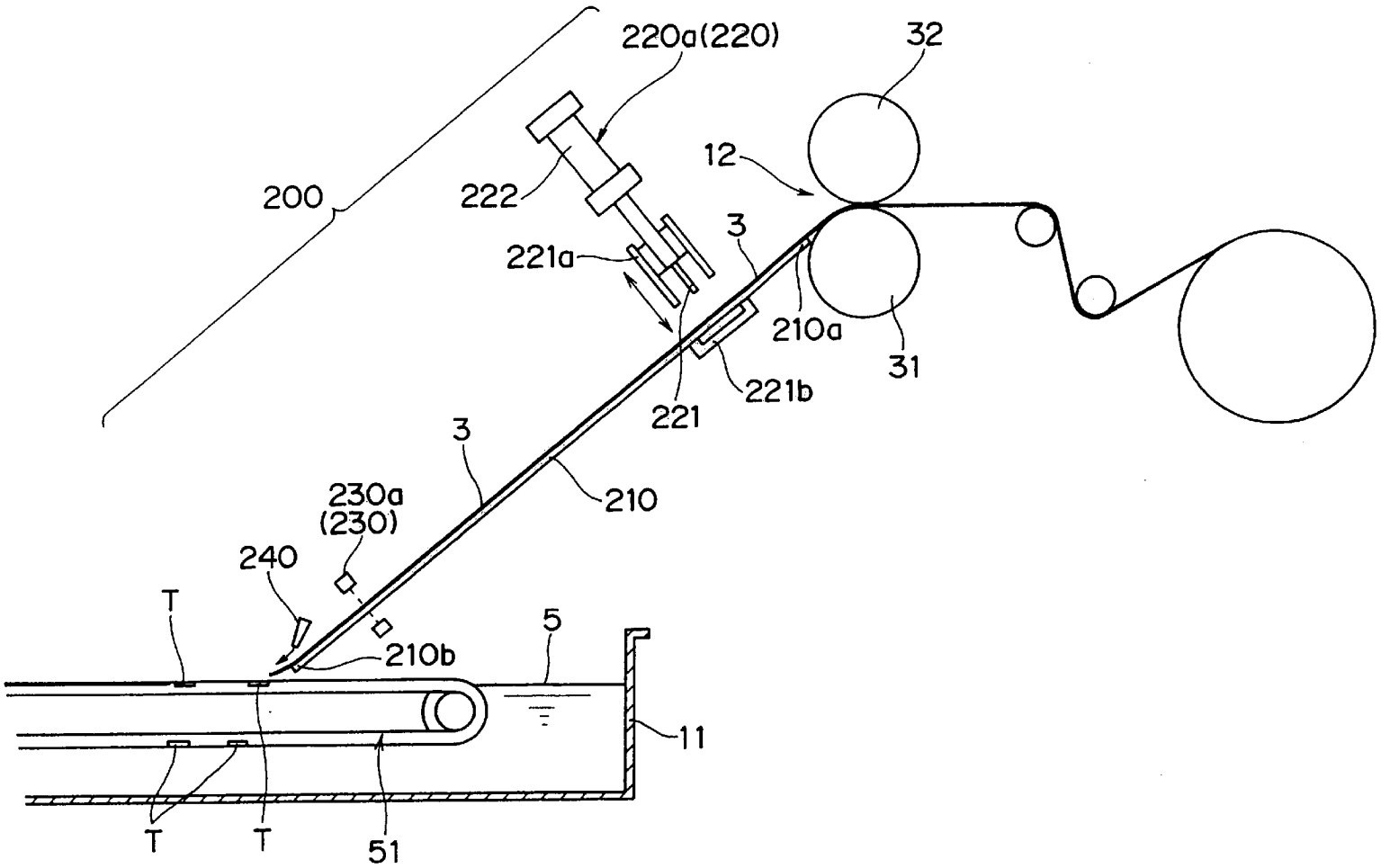
FIG. 16 is a schematic view showing states before and after the cutting step according to the printing method shown in FIGS. 12.

An end 210*a* of the transfer sheet receiver member 210 is formed to be close to the roller surface of the drive roller 31 forming part of the transfer sheet feed section 12, as schematically shown in FIG. 16, so that the top end of the transfer sheet 3 fed from the transfer sheet feed section 12 can be securely received. In the present embodiment, the inclined surface of the transfer sheet receiver member 210 is set so as to correspond to the direction of the tangent line.

In this manner, the transfer sheet 3 can be moved, kept in surface contact with the inclined surface of the transfer sheet receiver member 210, so that cutting of the transfer sheet 3 described later is facilitated.

In addition, the other end 210*b* of the transfer sheet receive member 210 is arranged to be slightly higher than the water surface so that the top end of the transfer sheet 3 moving down on the transfer sheet receiver member 210 can land on the water with the base sheet 1 facing to the water surface.

Note that the top end portion of the transfer sheet receiver member 210 facing the water surface may be divided into front and rear parts, so that the landing angle of the transfer sheet 3 to the water surface can be appropriately adjusted by making the top end portion swing vertically.

Further, in the side of the transfer sheet receiver member 210 that close to the transfer sheet feed section 12, a heat cylinder 220*a* is provided as a cutting means 220 for cutting the transfer sheet 3 such that the heat cylinder 220*a* faces the plate surface of the transfer sheet receiver member 210.

The heat cylinder 220*a* is comprised of a cutting blade 221 for cutting the transfer sheet 3, and a cylinder section 222 for instantly operating the cutting blade 221 vertically. The operation system of the cylinder section 222 may be of a hydraulic system or a pneumatic system.

The cutting blade 221 is constructed as an electrothermal system surrounded by a film press tool 221*a*. When cutting the transfer sheet 3, the film press tool 221*a* moves down slightly earlier than the cutting blade 221 to press the film. Then, the cutting blade 221 moves down and the top end of the blade has a contact with the transfer sheet 3 to cut the base sheet 1 of the transfer sheet 3 by thermal melting instantly.

In addition, a receiver base 221*b* having a flat surface portion provided to be parallel with and opposite to the back surface of the transfer sheet receiver member 210 is further provided as a press tool in the back surface side of the transfer sheet receiver member 210 where the cutting blade 221 of the heat cylinder 220*a* is moved down. By providing the receiver base 221*b*, the cutting blade 221 moved down for cutting the sheet is received from the back surface side to relax the impact and generation of a vibration of the transfer sheet receive member 210 is prevented when the cutting blade 221 has a contact, so that the transfer sheet 3 has a sharp cutting surface.

In addition, at a position apart from the heat cylinder 220*a* toward the top end by a predetermined distance, a photoelectric tube 230*a* is provided as a top end detection means 230 for detecting the transfer sheet. It is thus possible to detect the top end of the transfer sheet 3 which is fed down from the transfer sheet feed section 12 on the inclination surface of the transfer sheet receiver member 210. This photoelectric tube 230*a* and the heat cylinder 220*a* are connected with each other, so that the heat cylinder 220*a* can start cutting operation in association with the photoelectric tube 230*a* when a top end detection signal concerning the transfer sheet 3 from the photoelectric tube 230*a* is supplied to the heat cylinder 220*a*.

The detection signal is also supplied to the control section of the transfer sheet feed section 12, so that feeding of the transfer sheet 3 is stopped when cutting the sheet.

Further, in the top end side closer to the water surface than the photoelectric tube 230*a*, a blower 240 is provided so that the transfer sheet 3 can be smoothly shifted onto the water surface. Air is blown from upside of the print layer 2 toward the water surface by the blower 240, with respect to the top end of the transfer sheet 3 which is cut at a predetermined length and moves down on the transfer sheet receiver member 210. The transfer sheet 3 can be thus landed on the water with the base sheet 1 facing to the water surface, so that the top end of the transfer sheet 3 might not be rounded.

In the above explanation, the heat cylinder 220*a* is set at a rear position which is closer to the transfer sheet feed section 12 than the photoelectric tube 230*a*. However, in case where the transfer sheet receiver member 210 is arranged at an angle which does not correspond to the direction of the tangent line of the roller surface of the drive roller 31 but is a sharp angle unlike the above explanation, a gap is created at first between the transfer sheet 3 and the inclination surface of the transfer sheet receiver member 210. In this case, the heat cylinder 220*a* may be provided at a position where the transfer sheet 3 fed onto the transfer sheet receiver member 210 is brought into surface-contact with the plate surface of the transfer sheet receiver member 210.

Meanwhile, a plurality of partition members T are provided at predetermined intervals between links 51L of the chains 51 provided in the side of the water tank 11, such that each transfer sheet 3 is settled between partition members T which are arranged apart from each other by a distance corresponding to the predetermined length of the transfer sheet 3.

The length of the transfer sheet 3 cut out can be changed as follows. The length can be elongated if the heat cylinder 220*a* is operated with a time delay from the time point when a detection signal is received from the photoelectric tube 230*a*. To shorten the length of the transfer sheet 3 cut out than in the present embodiment, the distance between the photoelectric tube 230*a* and the heat cylinder 220*a* may be shortened.

In the present embodiment, the installation positions of the heat cylinder 220*a* and the photoelectric tube 230*a* can be changed independently from each other, in consideration of changes of the length of the transfer sheet to be cut out.

Figure 17:
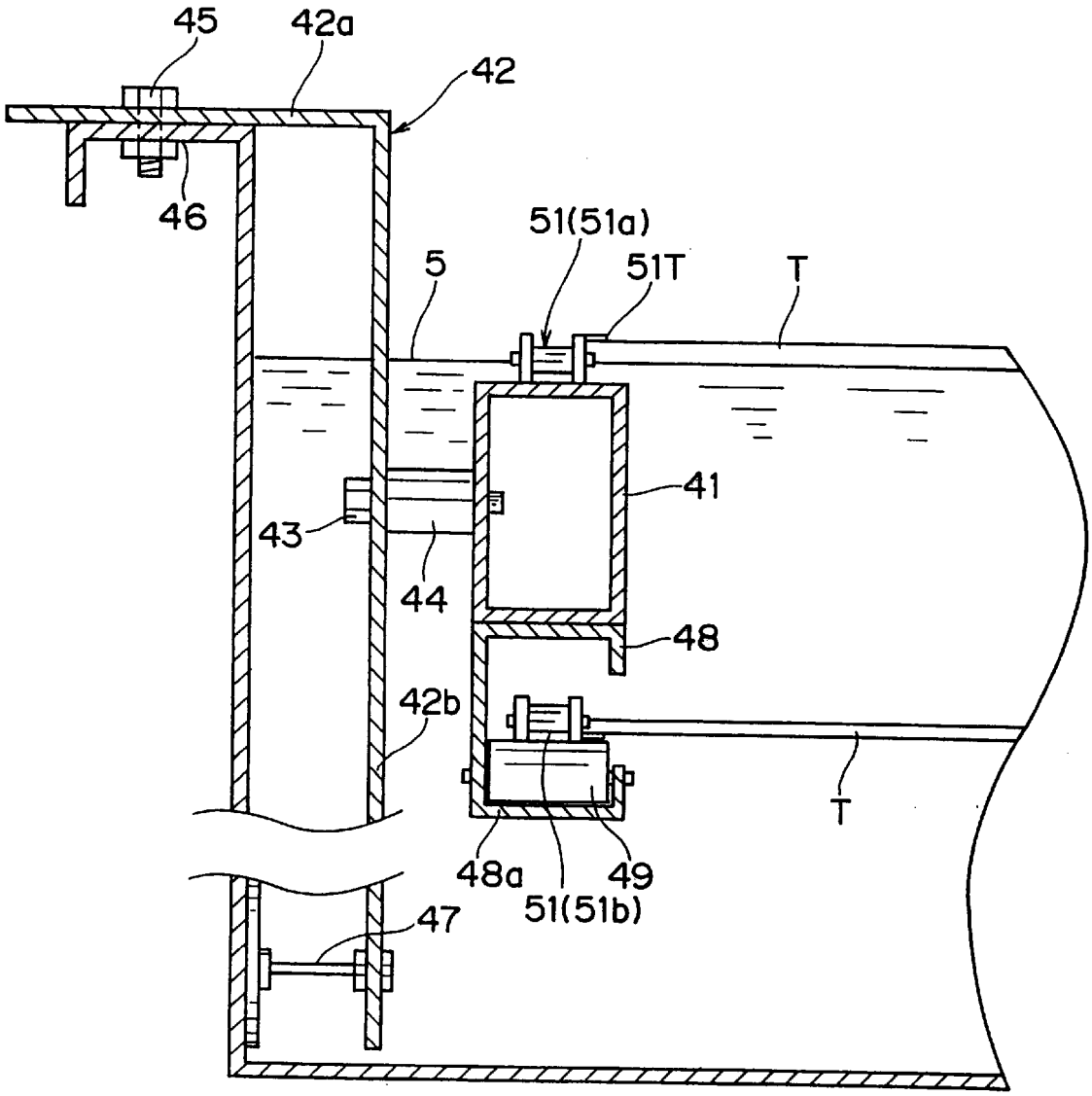
FIG. 17 is a partial cross-sectional view showing a condition where chains are attached in the water tank shown in FIG. 13.

Meanwhile, inside the water tank 11, chain receiver bases 41 are provided along both of the side walls of the water tank 11 like in the Embodiment 1 described above. Each of the chain receiver bases 41 is fixed to the water tank 11 by brackets 42 each having a horizontal portion 42*a* and a vertical portion 42*b*, as shown in FIG. 17. The brackets 42 and the chain receiver bases 41 are fastened by bolts 43.

A plurality of brackets 42 are provided at a predetermined interval in the longitudinal direction of the water tank 11, and the distance between each chain receiver base 41 and the brackets 42 is set by spacers 44 through which the bolts 43 penetrate. Since the water tank 11 is arranged to be shallower at the bottom 11*a* in the left side A than at the bottom 11*b* in the right side B, the lengths of the vertical portions 42*b* of the chain receiver bases 41 are set so as to correspond to the depth of the water tank in the left side A and that in the right side B.

Bolts 45 for fixing the brackets 42 to the water tank 11 are each elongated in the width direction of the water tank 11 and respectively penetrate long holes 46 formed in the horizontal portions 42*a*. By adjusting the positions of the brackets 42, the positions of the chain receiver bases 41 are adjusted in the width wise direction of the water tank 11. The distances between the water tank 11 and the lower ends of the vertical portions 42*b* of the brackets 42 are adjusted by adjust bolts 47.

The chain receiver bases 41 are respectively provided with endless chains 51 for conveyance, and these chains 51 constitute a partition member conveyer means. As shown in FIG. 17, in the forward section 51*a* of each chain 51 where the chain moves forward (the section where the chain moves in the same direction as the water surface 5 moves), the chain is guided by the chain receiver base 41, sliding on the upper surface of the chain receiver base 41. To support the chains 51 in their return sections 51*b*, support rollers 49 are rotatably provided respectively for the brackets 48 provided at a predetermined interval on each chain receiver base 41, and the chains 51 are guided by the support rollers 49 in their return sections 51*b*.

Particularly, in the present embodiment, each of the bracket 48 is formed to have a cross-section having a ]-shaped opening as shown in FIG. 17, unlike in the Embodiment 1 (shown in FIG. 6), such that the opening side faces to the inside of the water tank 11, and a support roller 49 is rotatably provided on a horizontal flange portion 48*a* bent in form of L-shape at the lower end. It is arranged such that the chains 51 returning can pass over the support rollers 49 without making the partition members T have contact with the brackets 48.

Figure 18:
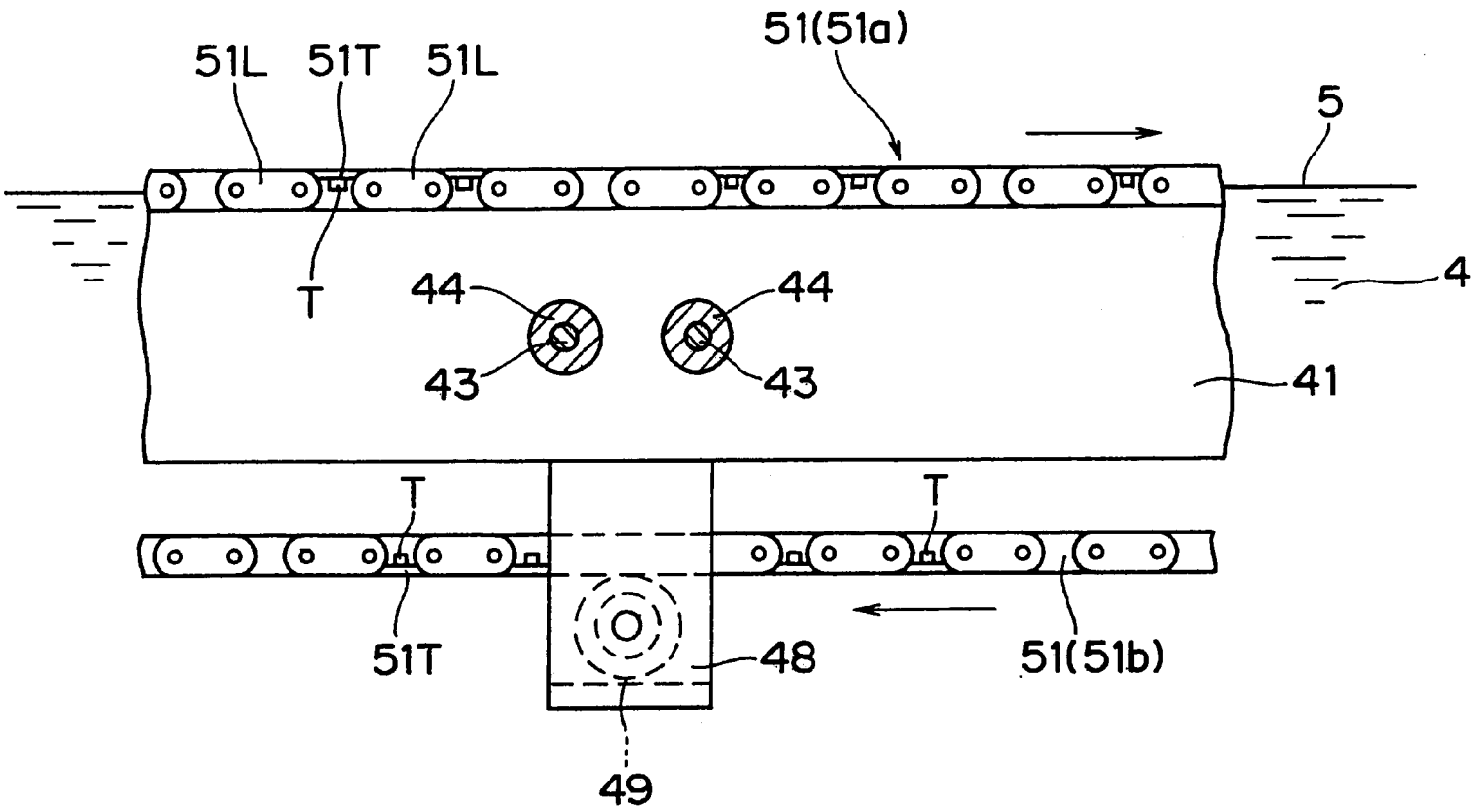
FIG. 18 is a partial cross-sectional view showing a condition where the chains shown in FIG. 17 are attached.
Figure 19:
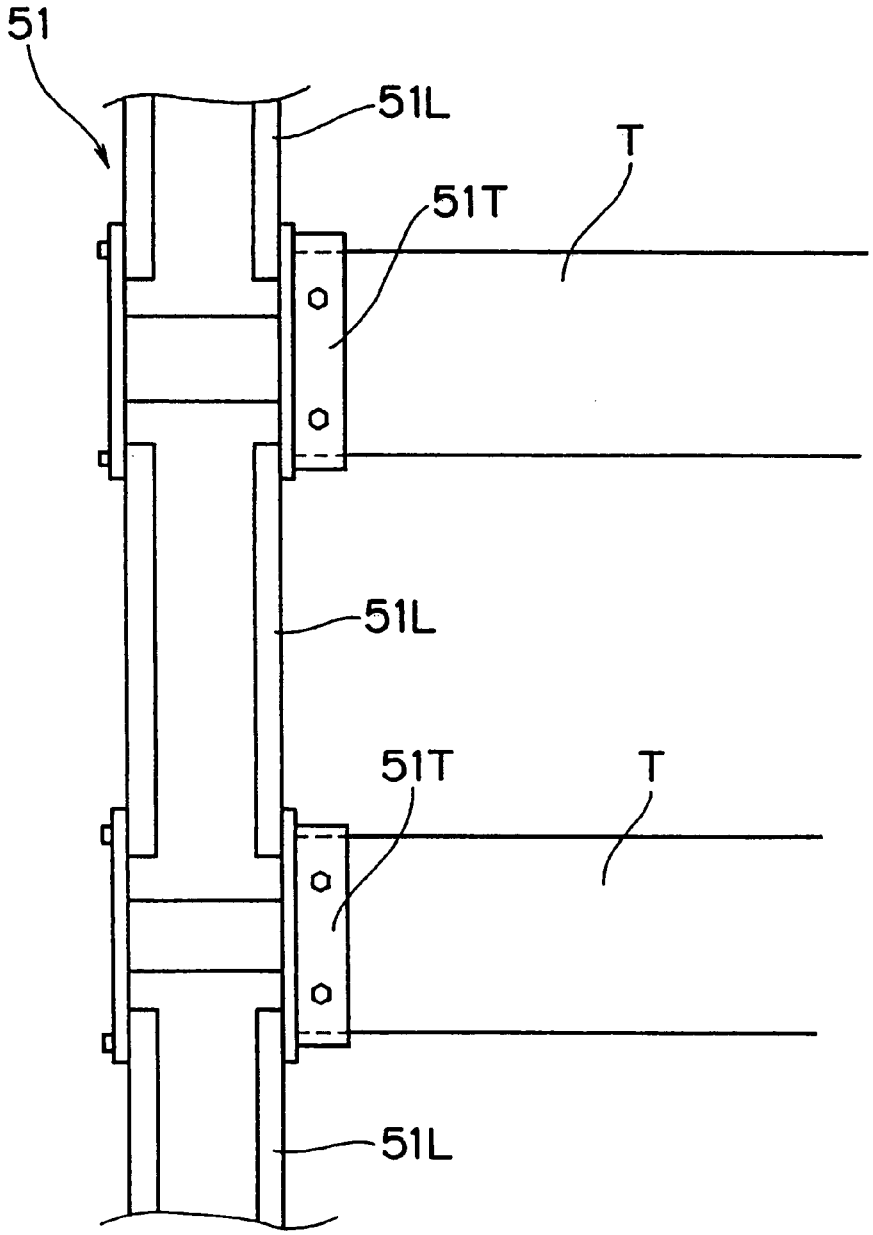
FIG. 19 is a partial plan view showing a condition in which the chains shown in FIG. 18 and the partition members are attached.

Meanwhile, as shown in FIGS. 18 and 19, the present embodiment uses chains 51 each having an attachment 51T, to which an optional component such as a carrier to be conveyed in accordance with feeding of the chains 51 is appropriately attached, between links 51L of the chains 51. In the present embodiment, a partition member T to be horizontally bridged between the chains 51 running in parallel with each other is attached to the attachment 51T.

Figure 20:
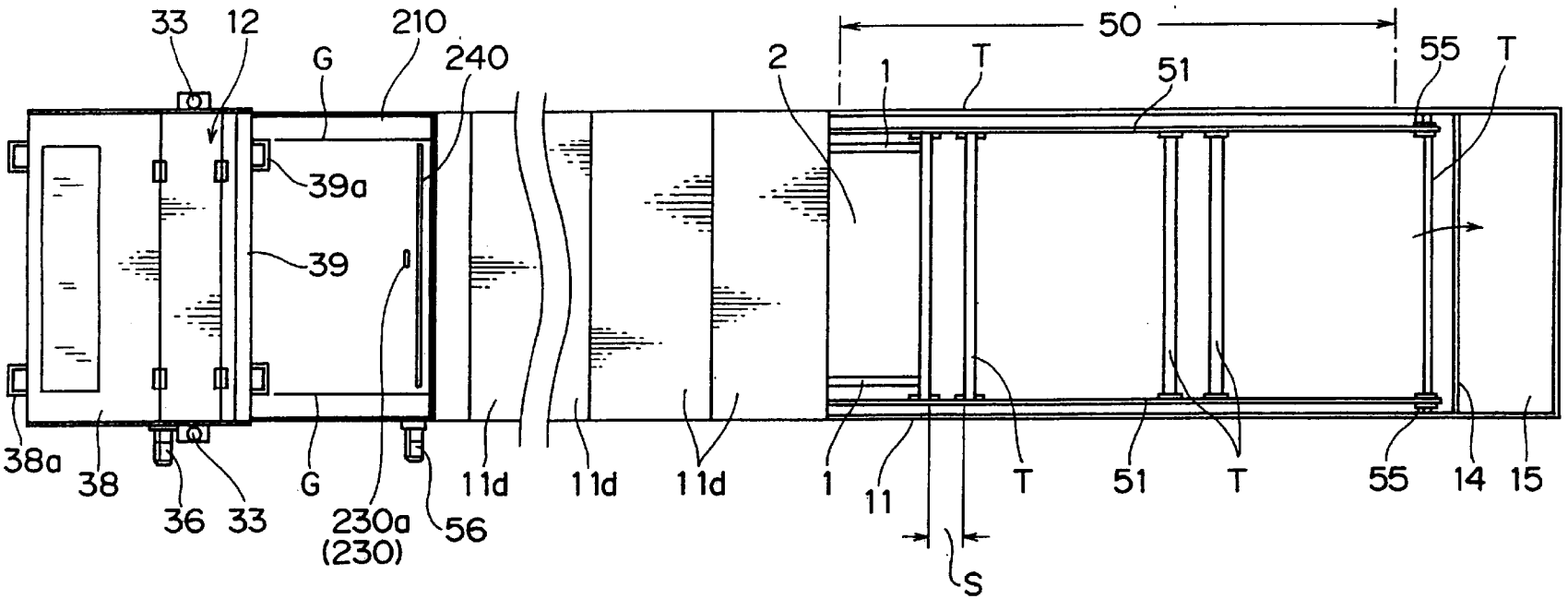
FIG. 20 is a plan view showing the printing apparatus shown in FIG. 13.

The partition members T are attached such that a long interval and a short interval are repeated alternately, and the distance of the long interval is set to be slightly longer than the cutting length of the transfer sheet 3. Thus, as shown in FIG. 20, transfer sheets 3 cut out are set between the partition members T and fed to the transfer area, keeping this condition.

The short interval S is set to a distance which is not influenced by the vibration of the water surface caused by an adjacent transfer sheet 3 during the transfer step described later.

Further, according to the present embodiment, a proximity switch is provided above the water tank, for example, so that the conveyer chains 51 can be stopped when a transfer sheet 3 cut at a predetermined length from the transfer sheet receiver member 210 reaches a position where the sheet is easily settled between partition members T. While the conveyer chains 51 are stopped, the transfer sheet 3 cut at a predetermined length is set between the partition members T, and transferring to objects 9 is carried out.

In the present embodiment, when the partition members T stop, water in the water tank flows. Therefore, the transfer sheet 3 landed on the water from the top end of the transfer sheet receiver member 210 smoothly rides on the water flow and is settled between partition members T in the front and rear sides of the sheet. After the transfer sheet 3 is thus inserted between the partition members T in the front and rear sides, the conveyer chains 51 start moving again.

Figure 21A:
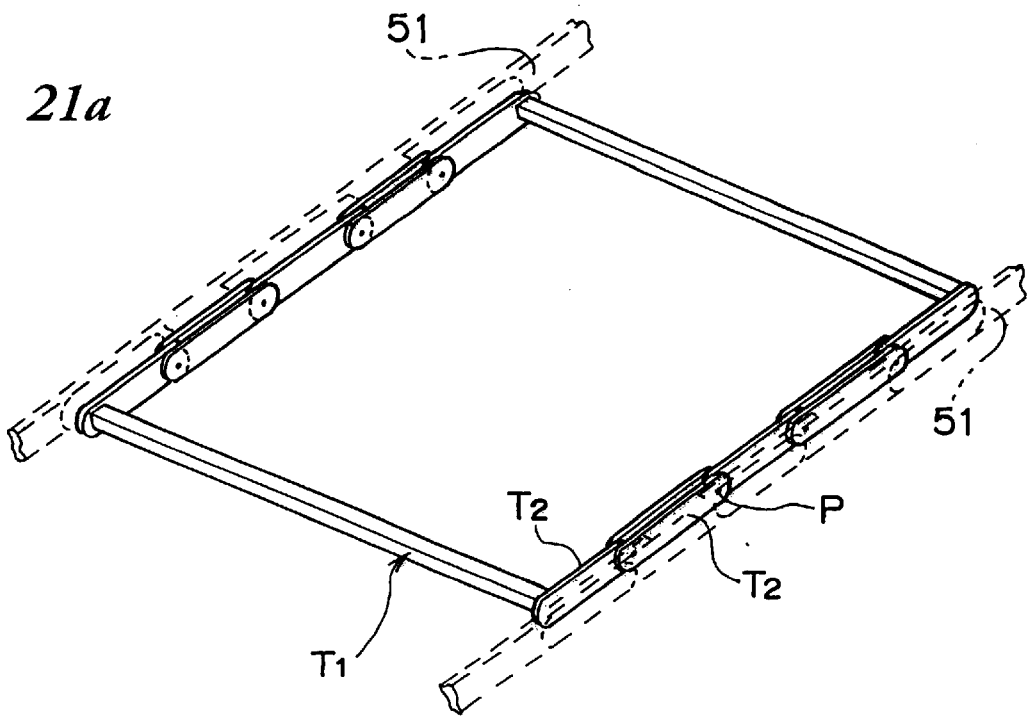
FIGS. 21(*a*) and (*b*) are perspective views showing modification examples of the partition members arranged in form of a frame member.
Figure 21B:
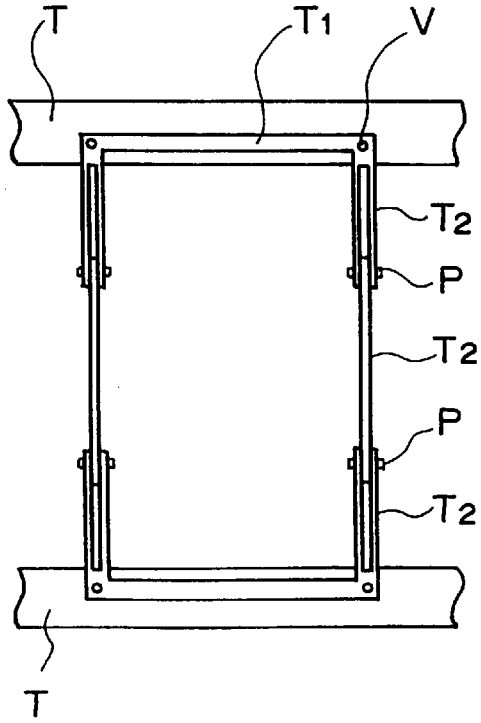

In the present embodiment, rod-like partition members T are bridged between the chains 51 running in parallel with each other in both sides, at predetermined intervals inserted between the members T. Frame members T1 may be previously formed to be matched with the width between the chains 51, as shown in FIG. 21(*a*), and maybe used in place of the partition members T. Such a frame member T1 may be constructed in, for example, a link structure having a pitch equal to the pitch of the chains 51 in the lengthwise direction, so that the frame member T1 can be bent in the lengthwise direction and can be circulated, like the chains 51. If links T2 are connected to each other by pins P, the frame member T1 can be circulated like the chains 51.

In case where such frame members T1 are used in place of partition members T, the width of the frame member T1 is formed to be smaller than the distance between the chains 51 running in both sides of the water tank 11, as shown in FIG. 21(*b*), and such frame members T1 are attached to the partition members T by bolts V. It is thus possible to respond to a transfer sheet 3 having a small width without changing the distance between the chains 51.

Further, according to the present embodiment, the partition members T are arranged to constitute one same plane so that the partition members T do not project from the surfaces of the chains 51, when the partition members T are attached to attachments 51T between links 51L in each of the chains 51, as shown in FIG. 17. Further, the partition members T are arranged so as to move at a level where the partition members T have contact with the water surface. Thus, since the lower ends of the partition members T are arranged so as not to enter deeply under the water surface, waves are not generated when the partition members T are moved by the chains 51.

In addition, since the partition members T can thus move without receiving strong resistance from water, conveyance loads to the conveyer chains 51 can be reduced.

Further, a drive shaft 53 is supported on an end portion of each chain receiver base 41 by a bracket 52. The chains 51 described above are tensioned between sprockets 54 provided on the drive shaft 53, and sprockets 55 rotatably attached to the chain bases 41 or the water tank 11. In place of the chains 51, rubber-made timing belts may be used.

To drive the chains 51, the drive shaft of the chains 51 and the drive motor 56 are connected by a chain 59 through a sprocket, as shown in FIGS. 13 and 14, in a substantially same manner as in the drive mechanism in the Embodiment 1, and the drive motor 56 is subjected to inverter-control. In this manner, the chains 51 can be circulated while adjusting the conveyance speed.

The present embodiment is constructed in a structure in which the cutting section 200 is provided between the transfer sheet feed section 12 and the water tank 11 and the transfer sheet feed section 12 is arranged at an upper position. Therefore, the drive motor 56 for conveying the chains 51 is provided at an upper position at the end portion of the lower water tank 11, apart from the transfer sheet feed section 12.

The water 4 is contained in the water tank 11 such that the water surface 5 is positioned at the center portion of each of the chains 51 in the vertical direction in the forward section of the chain, as shown in FIG. 17 like in the explanation made to the Embodiment 1. That is, in the forward section 51*a* of the chain 51, the upper portion of each chain 51 is exposed from the water surface 5 in the forward section 51*a*.

Also, in the present embodiment, the upstream side of the water tank 11 is covered with a detachable cover plate 11*d* which can be freely detached, as shown in FIG. 13 like the embodiment described before, and dust is thus prevented from sticking to the transfer sheet 3.

In addition, the portion of the water tank 11 that is in the downstream side of the cover plate 11*d* serves as a transfer zone denoted at reference 50 in FIG. 20, or a transfer area. In the present embodiment, the right side B where the bottom 11*b* is deeper is made correspond to the transfer zone 50. However, the ratio between the shallow bottom 11*a* and the deep bottom 11*b* may be appropriately determined, e.g., the bottom 11*a* in the left side A maybe shortened within a range in which the base sheet 1 can be dissolved.

For example, the range of the right side B can be shortened within a range in which the step of pressing the objects 9 against the print layer 2 by upward and downward movement of the holder 10 shown in FIG. 13.

The surface portion of the water 4 contained in the water tank 11 forms a flow in the direction from an end portion of the water tank to the other end portion thereof, e.g., a flow from the left end portion in FIG. 13 toward the overflow tank 15 at the right end portion. To form this flow, a plurality of water feed pipes 61 extending in the width direction of the water tank 11 are provided at a predetermined interval in the longitudinal direction of the water tank 11 in the present embodiment, in the manner shown in FIG. 4 of the Embodiment 1 described above. These water feed pipes 61 are provided at a predetermined interval in the longitudinal direction of the water tank 11 and constitute a water flow forming means.

In the transfer zone 50, a water feed pipe for injecting water obliquely in an upward direction from under the water surface 5 may be provided at a position after a position where the transfer step using the upward and downward movement of the holder 10 is completed, like the water feed pipes 61. By providing such a structure, a residual print layer remaining after completion of the transfer can be forcibly made overflow. Therefore, the flow of the works in the transfer step can be hastened in comparison with the case where such an overflow is attained naturally.

Figure 22:
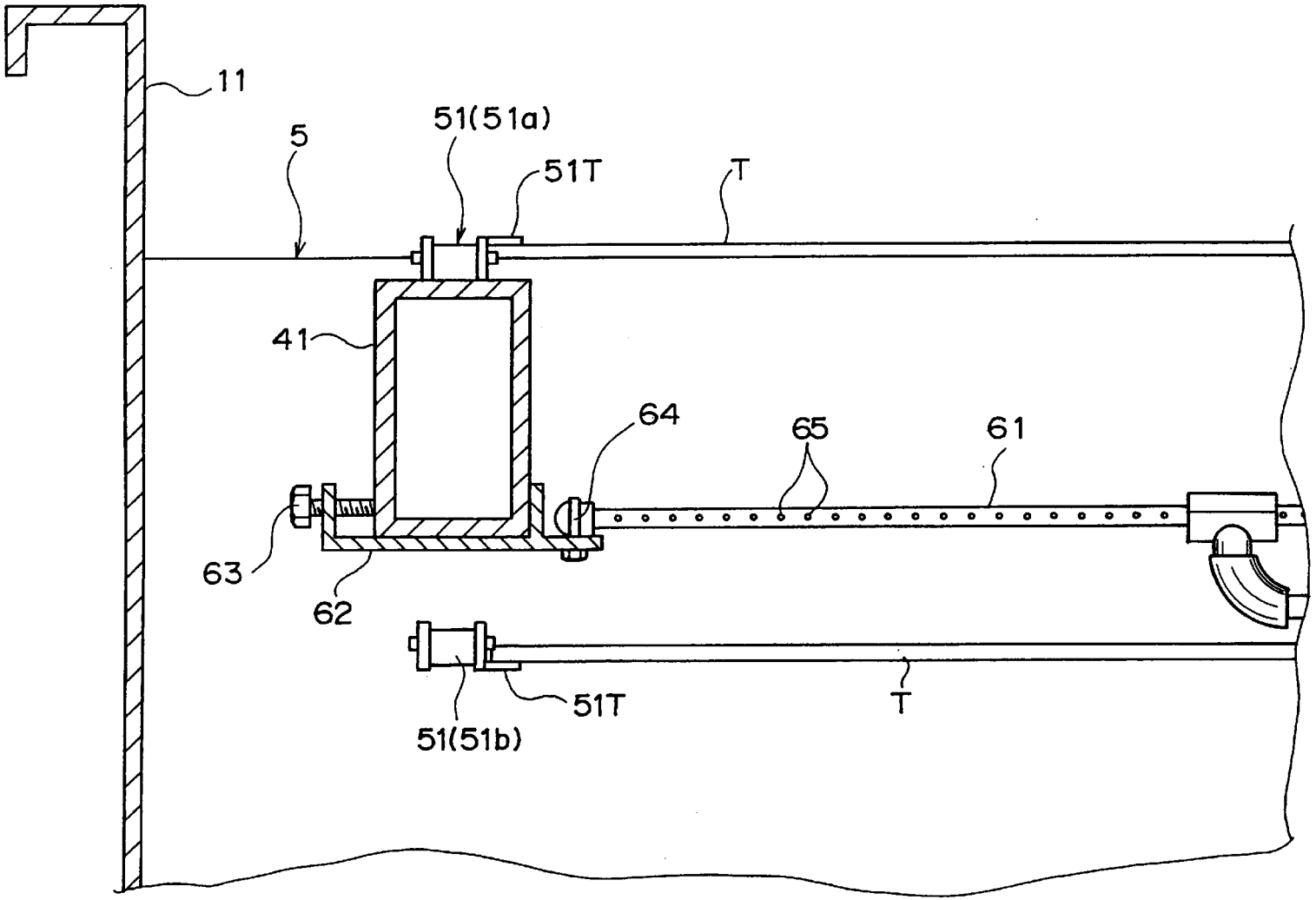
FIG. 22 is a partial cross-sectional view showing how water feed pipes are attached in the water tank of the printing apparatus shown in FIG. 13.

Also, in the present embodiment, as shown in FIG. 22, the water feed pipes 61 are detachably attached to the chain receiver bases 41 by a pipe bracket 62. The pipe bracket 62 is fastened to the chain receiver bases 41 by bolts 63, and the end portions of the water feed pipes 61 are fastened to the pipe bracket 62 by U-shaped bolts 64.

A number of water injection holes 65 are formed at a predetermined interval in the water feed pipes 61, and each of the water injection holes 65 is directed upward to the other end portion side and is inclined at an angle θ to the horizontal plane. The inclination angle θ should preferably be 15 to 50° toward the water surface in the obliquely upward direction. The water feed pipes 61 are connected with a feed pipe 66 so that water is supplied from a water feed pump not shown.

When water is injected from the water injection holes 65, a flow from an end portion of the left side A of the water tank 11 to the right side B thereof is formed at the surface portion of the water 4. The flow speed of the water surface 5 generated by this flow is about 100 to 400 cm/min. The moving speed of the chains 51 is set to be substantially equal to the flow speed of the water surface 5.

However, the flow speed of the water surface 5 and the convey speed of the chains 51 are set to be slightly faster than the speed at which the transfer sheet 3 is fed from the transfer sheet receiver member 210 of the cutting section 200 constructed in the structure as described above, and as a result, the transfer sheet 3 is slightly tensioned when the transfer sheet 3 is shifted onto the water surface so that the transfer sheet 3 might not be wrinkled.

Explanation will now be made to operation procedure of performing printing on objects with use of a printing apparatus described above.

By driving the drive motor 34 with the transfer sheet 3 kept fed from the transfer roll 20 and clamped between the drive roller 31 and the tension roller 32, the transfer sheet 3 is fed to the transfer sheet receiver member 210 of the cutting section 200, as schematically shown in FIG. 16.

The inclination angle of the transfer sheet receiver member 210 is set to such an angle that makes the transfer sheet 3 move down at a speed faster than the feeding speed thereof from the transfer sheet feed section 12. Therefore, the transfer sheet 3 moves down on the transfer sheet receiver member 210, kept slightly tensioned such that the top end of the sheet is pulled.

The transfer sheet 3 moves on the surface of the transfer sheet receiver member 210 toward the water surface.

The transfer sheet 3 passes over the portion of the heat cylinder 220*a* and reaches the portion of the photoelectric tube 230*a*. Passing of the top end is detected by the photoelectric tube 230*a*.

A passing detection signal indicating the passing of the top end is supplied to the heat cylinder 220*a* provided with a distance maintained from the photoelectric tube 230*a* to the back side of the tube. Then, the heat cylinder 220*a* is operated. The cutting blade 221 is moved down on the surface of the transfer sheet 3 moving on the transfer sheet receiver member 210 and thermally cuts the transfer sheet at a predetermined length.

In the present embodiment, when the heat cylinder 220*a* thus cuts the sheet, feeding of the transfer sheet 3 is stopped. In this respect, the detection signal from the photoelectric tube 230*a* may be simultaneously supplied to both the heat cylinder 220*a* and the drive roller control section.

However, if the cutting speed of the cutting blade 221 of the heat cylinder 220*a* can be arranged to be sufficiently faster than the feeding speed of the transfer sheet 3 from the transfer sheet feed section 12, feeding of the transfer sheet 3 need not be stopped every time when cutting the sheet, but cutting can be performed instantly while sequentially feeding the transfer sheet.

Meanwhile, the partition members T conveyed by the chains 51 provided for the water tank 11 are circulated at times synchronized with the speed of shifting of the transfer sheet 3 thus cut from the transfer sheet receiver member 210.

Figure 23A:
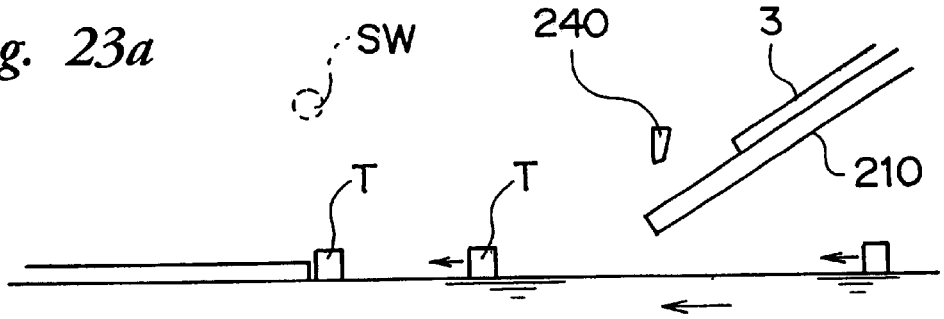
FIGS. 23(*a*), (*b*), and (*c*) are process views showing steps in which a transfer sheet is shifted onto the water surface after cutting according to the printing method shown in FIG. 12.
Figure 23B:
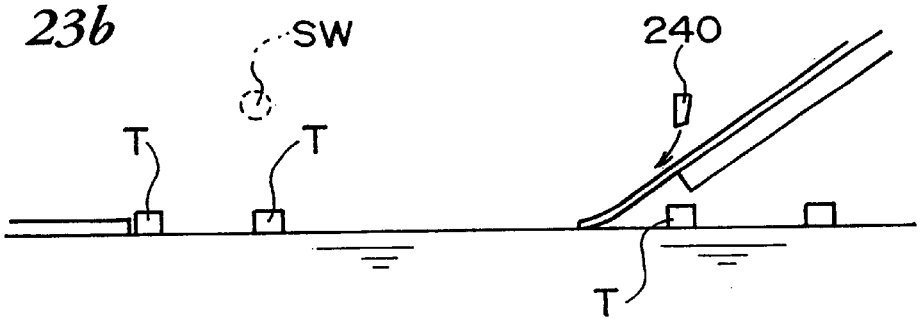
Figure 23C:
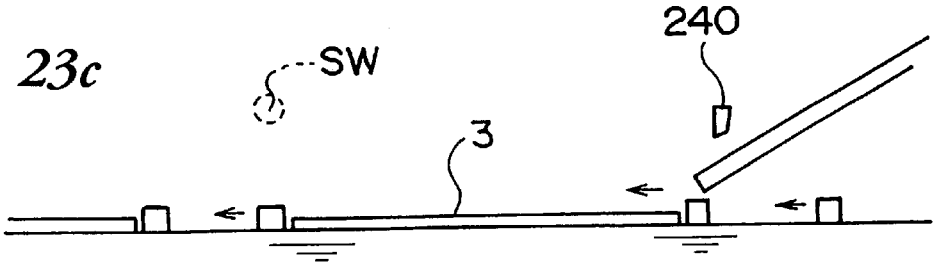

For example, as shown in FIGS. 23(*a*), (*b*), and (*c*), a partition member T is detected by a proximity switch SW and the transfer sheet 3 is just inserted between partition members T in the front and rear sides of the sheet, which are arranged apart from each other by a distance slightly longer than the cutting length of the transfer sheet 3.

Partition members T are conveyed by the conveyer chains 51, as shown in FIG. 23(*a*). Among the partition members T in the front and rear sides, which are apart from each other by a predetermined distance described above, the partition member T in the rear side reaches a position below the top end of the transfer sheet receiver member 210. At this time point, the partition member T in the front side is detected by the proximity switch SW, and the conveyer chain 50 of the partition members T is stopped by a detection signal thereof.

Thus, at the time point when the partition members T in the front and rear sides are stopped under the top end of the transfer sheet receiver member 210 such that the transfer sheet 3 is easily inserted, the transfer sheet 3 cut at a predetermined length is inserted between the partition members T in the front and rear sides, as shown in FIG. 23(*b*).

Since a water flow is generated toward the downstream side in the water tank 11 even while the partition members T are stopped, the transfer sheet 3 landed on the water surface 5 is situated between the partition members T, with the top end of the sheet 3 pulled by the water flow, as shown in FIG. 23(*c*).

After the transfer sheet 3 is thus situated between the partition members T, the conveyer chains 51 starts moving again.

While the conveyer chains 51 are stopped and the partition members T are also stopped as in the structure described above, transfer of a pattern to objects 9 is carried out.

In the structure described above, while the partition members T are stopped by stopping the conveyer chains 51, the transfer sheet 3 is situated between the partition members T and transfer of a pattern to objects is carried out. However, this operation may be sequentially performed without stopping the partition members T.

In this case, for example, timings are arranged such that the top end of the transfer sheet 3 is landed onto the water surface immediately after the partition member T in the front side among the partition members T in the front and rear sides attached at a distance corresponding to the cutting length of the transfer sheet 3 to the chains 51 passes over the top end portion of the transfer sheet receiver member 210 in the water surface side.

Further, if the moving speed of the partition members T and the speed of the water flow are matched with each other, and the speeds thus matched are set to be slightly faster than the shifting speed at which the transfer sheet 3 is shifted from the transfer sheet receive member 210 to the water surface, the transfer sheet 3 is shifted to the water surface such that the top end of the sheet 3 landed on the water surface is tensioned to be slightly pulled by the water flow.

Immediately after the rear end of the transfer sheet 3 cut at a predetermined length is shifted onto the water surface, the partition member T in the rear side, which is apart from the partition member T going ahead by a distance matched with the cutting length of the transfer sheet, is conveyed by the chains 51. Thus, shifting of the transfer sheet 3 may be carried out in a sequential step by arranging the timings such that the transfer sheet 3 cut at a predetermined length is just situated between two partition members T maintaining a long distance interposed therebetween.

In the present embodiment, a blower 240 is provided in the side of the transfer sheet receiver member 210 facing the water surface, and therefore, the top end of the transfer sheet 3 cut out smoothly slides down onto the water surface with the base sheet 1 facing the water surface, while air is blown from upside to the water surface.

The blower 240 need not always be provided if the transfer sheet 3 smoothly slides down on the transfer sheet receiver member 210 at a certain speed and is smoothly landed on the water.

Thus, the transfer sheet 3 is cut at a predetermined length while being moved on the transfer sheet receiver member 210, and fed onto the water surface 5 in the left side where the bottom 11*a* of the water tank 11 is shallow. The transfer sheet 3 cut at a predetermined length floats with the base sheet 1 kept in contact with the water surface 5.

A slow flow from the upstream side to the downstream side is formed in the water tank 11 at the portion of the water surface 5 by water injected from the water injection holes 65 of the water feed pipes 61, and the speed of the flow is set to be slightly faster than the feeding speed of feeding the transfer sheet 3 from the transfer sheet receiver member 210. Therefore, the transfer sheet 3 is landed between partition members T on the water surface 5 without being wrinkled.

Of the transfer sheet 3, the lower base sheet 1 is gradually dissolved or swelled in the water 4 while it is conveyed and floats on the water surface 5, passing over the left side A of the water tank 11, i.e., the shallow portion at the bottom 11*a*.

Meanwhile, in the step in which the transfer sheet 3 cut at a predetermined length is let flow to the downstream side, partitioned by partition members T, and in which the base sheet 1 is dissolved, an adhesion is applied from nozzles 7 (shown in FIG. 1) as an adhesion application means to such a portion of the print layer remaining that is used in one time of transfer operation.

Application of the adhesion may be carried out in a stage in which the base sheet 1 of the transfer sheet 3 is dissolved. As for the application operation of the adhesion, the adhesion may be automatically sprayed uniformly from the nozzles or manually sprayed.

In the present embodiment, since the transfer sheet 3 is cut by the cutting section into a size which is necessary for transfer of a pattern, it is necessary to spray an adhesion uniformly onto the entire surface of the transfer sheet 3.

Application of the adhesion is carried out while the base sheet 1 is being dissolved or after the base sheet 1 is completely dissolved.

By applying an adhesion, the print layer 2 becomes a semi-fluidal print pattern 8 and therefore tends to spread over the water surface 5. However, the front and rear sides of the pattern are restricted by the partition members T, and the left and right sides of the pattern are restricted by the chains 51 in the forward sections 51*a*, so that the spreading of the pattern is restricted any more.

Thus, with the pattern partitioned by the partition members T, the holder 10 (or object moving means) holding the objects 9 is moved downward toward the water surface 5 so that the pattern stopped is transferred onto the objects 9 by the water pressure, as is indicated by a two-dot chain line in FIG. 13.

In the present embodiment, by pressing objects against the pattern at a sufficiently higher speed than the speed of the pattern moving on the water surface 5 and by lifting up the objects, transfer of the pattern can be efficiently performed. In addition, the objects may be pressed against the pattern and lifted up while moving the objects 9 at a speed matched with the moving speed of the pattern. In this case, the objects 9 are lifted up by moving up the holder 10 before the objects 9 reach the downstream end of the water tank 11.

In addition, the objects 9 are conveyed to the outside by a convey means such as a crane or the like and new objects 9 are conveyed in for transfer operation.

The portion of the pattern that is not used for the transfer is discharged into the overflow tank 15 over the partition wall 14. Water which has flown into the overflow tank 15 is cleaned by a filter and is thereafter injected again.

In the present embodiment, the transfer sheet 3 is cut to an extent necessary for the transfer, and thus, the portion of the pattern that is not used for the transfer is reduced in comparison with a conventional printing method. Consequently water is easily cleaned by the filter, the life of which is thus elongated.

The partition members T conveyed by the chains 51 to a position near the downstream end of the water tank 11 is returned in association with the returning of the chains 51. In the transfer operation onto the objects 9 is performed between the positions 71*a* and 71*b* as shown in FIG. 13, like in the Embodiment 1 described before.

Also, in the present embodiment, since partition members 71 as shown in FIG. 11 in the embodiment described before are not used, it is needless to consider interference with water flow fed from the water feed pipes 61 due to partition plates 74 of such partition members 71 which enter into the water below the water surface.

Further, in the method according to the present embodiment, the transfer sheet 3 with the base sheet 1 is previously cut into a size of a predetermined length and is then shifted onto the water surface, and thereafter, the base sheet 1 is dissolved and an adhesion is then applied, because the transfer sheet 3 tends to shrink if an adhesion is sprayed under existence of the base sheet 1. In case where such shrinkage of the transfer sheet 3 is not caused, it will be efficient that an adhesion is applied when the transfer sheet 3 passes through the cutting section 200.

However, the adhesion used in such a case must be an adhesion which is capable of maintaining its adhesiveness until the base sheet 1 of the transfer sheet 3 is dissolved and transfer to objects 9 is smoothly carried out thereafter.

In a structure in which an adhesion is applied before dissolving the base sheet 1, for example, the adhesion can be applied onto the print layer 2 of the transfer sheet 3 without moving a nozzle in compliance with the adhesion range, if an adhesion application nozzle capable of spraying an adhesion in the width direction of the transfer sheet 3 is provided between the heat cylinder 220*a* and the photoelectric tube 230*a*.

In addition, it is possible to replace the adhesion application nozzle with the blower 240 so that the adhesion is applied and the shifting of the transfer sheet 3 to the water surface can be hastened.

In the present embodiment, as shown in FIG. 13, explanation has been made to a case where transfer is carried out with use of small objects 9. However, transfer can be performed on a long large object.

In case of transferring a pattern onto a large object having a long size, the partition members T may be attached to the chains 51 at elongated intervals matched with a cutting length. Also, in the present embodiment, since partitioning by the partition members 71 is not utilized, unlike in the Embodiment 1, the transfer sheet 3 is fed forward thereby causing wrinkles in a frame if the water flow is kept generated. Therefore, in this case, it is necessary to stop the water flow.

Further, if the cutting length of the transfer sheet is longer than the transfer sheet receiver member 210, the transfer sheet may be cut at a time point when the transfer sheet reaches a predetermined length while shifting the top end of the transfer sheet 3 from the transfer sheet receiver member 210 to the water surface. For example, if the shifting speed is constant, the heat cylinder 220*a* maybe operated so as to cut the transfer sheet after a predetermined time elapsed from detection of passing of the top end of the transfer sheet 3 by the photoelectric tube 230*a*.

Thus, the pattern of the print layer 2 can be sequentially printed repeatedly at a predetermined time cycle, onto a plurality of objects 9 (including a large object having a long size) held by the holder 10, without deforming the pattern.

In this time, the time of the print cycle may be the time required to convey the portion used for one time of transfer operation to the transfer zone 50, since the base sheet 1 of the transfer sheet 3 is sufficiently dissolved or swelled in the upstream side of the water tank 11. Thus, the transfer cycle time can be shortened and a high quality pattern can be printed rapidly, so that printing can be performed efficiently on a large number of products particularly in case where mass-products are used as objects onto which the pattern is transferred.

In addition, since a pattern is printed onto objects with use of the water pressure, the pattern can be printed with high quality without forming wrinkles with respect to an object having concave and convex portions or having a curved surface.

Note that any material can be used as the material forming the base sheet 1 as long as the material is water-soluble, like in the Embodiment 1 described before, and polyacrylic acid soda, methylcellulose, carboxyl methylcellulose, polyethylene oxide, polyvinyl pyrolidone, or acrylic acid amide can be used in addition to polyvinyl alcohol described before.

Further, a material obtained by applying starch onto a band-like thin paper sheet and by forming a print layer of a pattern on the starch layer may be used as the material of the base sheet 1.

If this type of base sheet 1 is used, starch is dissolved in water and the portion of the starch in the base sheet 1 is dissolved as the base sheet 1 is conveyed floating on the water surface 5. Therefore, the thin paper sheet is deposited in the water tank 11 so that only the print layer can be made remain and float on the water surface 5.

Next, explanation will be made of a printing apparatus and a printing method according to Embodiment 3.

In the printing apparatus according to the present embodiment, the transfer sheet receiver member 210 forming part of the cutting section 200 is constructed as a belt conveyer 300, and the transfer sheet 3 is actively shifted to the water surface. Although the mechanism may be complicated in comparison with the Embodiment 2, the transfer sheet 3 can be actively conveyed to the water surface without taking much consideration into the inclination angle or the smoothness of the flat plate surface.

In the present embodiment, the transfer sheet receiver member 210 is constructed by a belt conveyer 300 arranged to be inclined obliquely like the Embodiment 2 described before.

The belt conveyer 300 is provided to be inclined obliquely toward the water surface of the water tank 11 from the transfer sheet feed section 12 such that an end 300*a* of the belt conveyer 300 is situated at a position just below the portion of the transfer sheet feed section 12 where the transfer sheet is fed out.

The belt conveyer 300 is arranged such that the surface of the belt 310 is flat so that the transfer sheet 3 is set thereon and can be conveyed to the water surface without wrinkling its base sheet 1.

Figure 24:
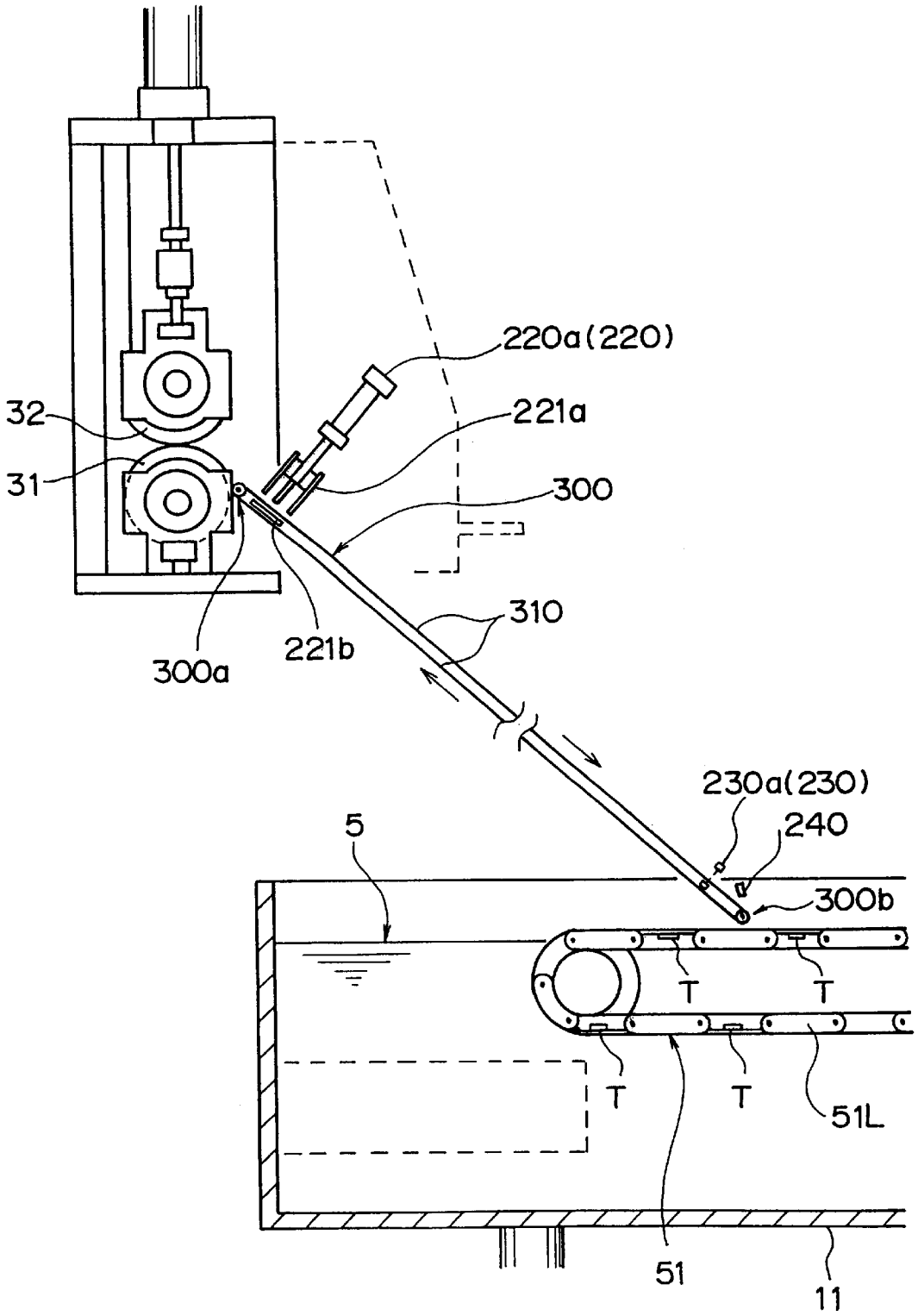
FIG. 24 is a partial front view showing a state where a belt conveyer is used for the cutting section of the printing apparatus shown in FIG. 13.

The belt conveyer 300 is driven by a small drive motor, as shown in FIG. 24. To drive the belt conveyer 300, the conveying speed of the belt 310 is set to be slightly faster than the feeding speed of the transfer sheet of the transfer sheet feed section 12 so that the transfer sheet is fed onto the surface of the belt 310 without wrinkling the transfer sheet.

Further, the flow speed of the water in the water tank 11 is set to a speed slightly faster than the conveying speed of the belt conveyer 310, so that no wrinkle might not be formed when the transfer sheet is shifted onto the water surface. The transfer sheet 3 thus fed from the transfer sheet feed section 12 is conveyed by the belt conveyer 300 of the cutting section 200 and is shifted smoothly onto the water surface of the water tank 11.

In addition, at an upper position opposed to the surface of the belt 310 of the belt conveyer 300, a heat cylinder 220*a* is provided as a cutting means 220 for the transfer sheet 1, like in the Embodiment 2 described before.

In addition, a receiver base 221*b* having a flat surface portion provided to be parallel with and opposite to the back surface of the belt 310 with a slight distance maintained therebetween is further provided in the back surface side of the belt 310 where the cutting blade 221 of the heat cylinder 220*a* is moved down. By providing the receiver base 221*b*, the cutting blade 221 moved down when cutting the sheet does not bite into the surface of the belt 310, but the transfer sheet 3 can be cut out sharply.

In addition, at the top end of the belt conveyer 300, a photoelectric tube 230*a* is provided as a top end detection means 230 for detecting the transfer sheet, like in the Embodiment 2 described before. By the photoelectric tube 230*a* (230), it is possible to detect the top end of the transfer sheet 3 which is fed down on the belt conveyer 300 toward the water surface. The heat cylinder 220*a* is operated in response to a detection signal from the photoelectric tube 230*a*, so that the transfer sheet 3 is cut at a predetermined length.

Further, in the present embodiment, a blower 240 may be provided in the water surface side of the belt conveyer 300 such that its flowing direction is directed in a downward direction which is slightly oblique to the surface of the belt 310, like in the Embodiment 2 described before.

In this case, the blower 240 serves to blow the top end of the transfer sheet 3 conveyed to the water surface, toward the water surface, so that the transfer sheet 3 is smoothly landed on the water with the base sheet 1 facing the water surface.

A printing method using the apparatus as described above will be explained below. Basic procedure of printing is the same as that in the Embodiment 2. However, the end of the transfer sheet 3 fed out from the transfer sheet feed section 12 is received on the belt conveyer 300 provided close to the roller surface of the drive roller 31.

The transfer sheet 3 is fed onto the surface of the belt 310 of the belt conveyer 300, along the direction of the line tangent to the roller surface of the drive roller 31 of the transfer sheet feed section 12. The transfer sheet 3 fed onto the inclined surface of the belt 310 is moved along the inclined surface toward the water surface at a speed slightly faster than the feeding speed from the transfer sheet feed section 12, and is moved to the water surface with the transfer sheet 3 tensioned straightly (without making wrinkles).

The transfer sheet 3 passes near the heat cylinder 220*a* and further moves by a predetermined length from the heat cylinder 220*a*. Then, the top end of the transfer sheet 3 is detected by a photoelectric tube 230*a*, and the heat cylinder 220*a* distant from the photoelectric tube 230*a* by a predetermined length operates so that the transfer sheet 3 is cut out.

After the upper surface of the top end of the transfer sheet thus cut at a predetermined length passes the photoelectric tube 230*a*, the transfer sheet is fed toward the water surface from the belt conveyer 300. In the present embodiment, natural slide and fall of the transfer sheet 3 is not utilized but the transfer sheet 3 is conveyed by the belt conveyer 300, unlike the Embodiment 2 described before. Therefore, the blower 240 for hasting landing of the sheet need not be provided.

Meanwhile, partition members T constructed as described before provided at the chains 51 in the water tank 11 are arranged to be matched with the timing of shifting the transfer sheet 3 to the water surface, like in the Embodiment 2. Therefore, the transfer sheet 3 sandwiched between partition members T in the front and rear sides is shifted to the right side B as if it flows on the water surface without being influenced by waves on the water surface. Thereafter, the transfer sheet 3 is shifted to the transfer step side, and objects 9 are pressed from upside of the transfer sheet 3 to transfer a pattern.

Next, a printing apparatus and a printing method according to Embodiment 4 will be explained below.

In the present embodiment, unlike the Embodiments 2 and 3 described before, the cutting section 200 is arranged horizontally, and the transfer sheet 3 is fed onto a horizontal plate 500 of the cutting section 200. The transfer sheet 3 is cut at a predetermined length on the surface of the horizontal plate 500, and the transfer sheet 3 thus cut at a predetermined length is let fall down on the water surface.

Figure 25:
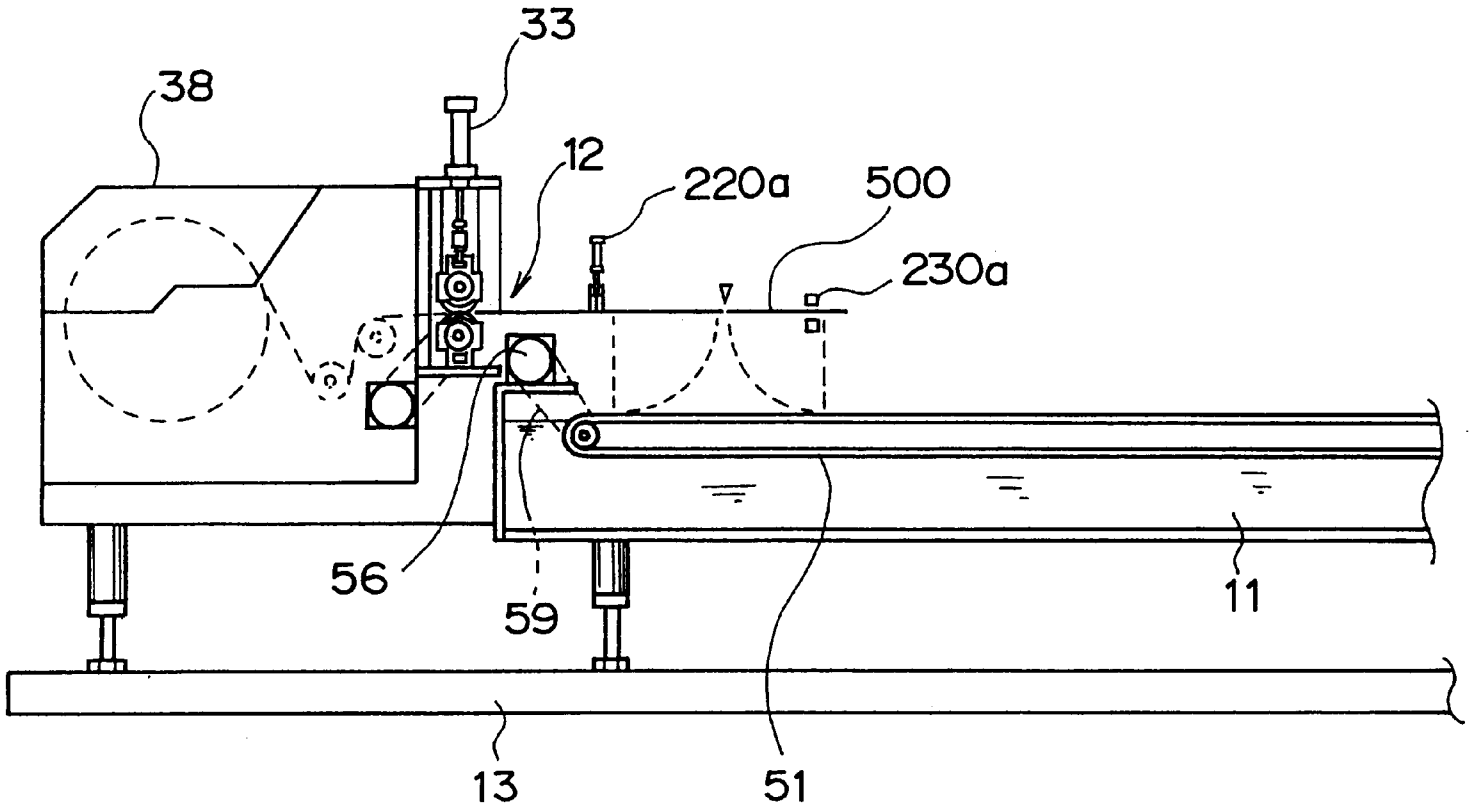
FIG. 25 is a partial front view showing a printing apparatus in case where the cutting section is arranged to be horizontal in order to perform the printing method shown in FIG. 12.
Figure 26:
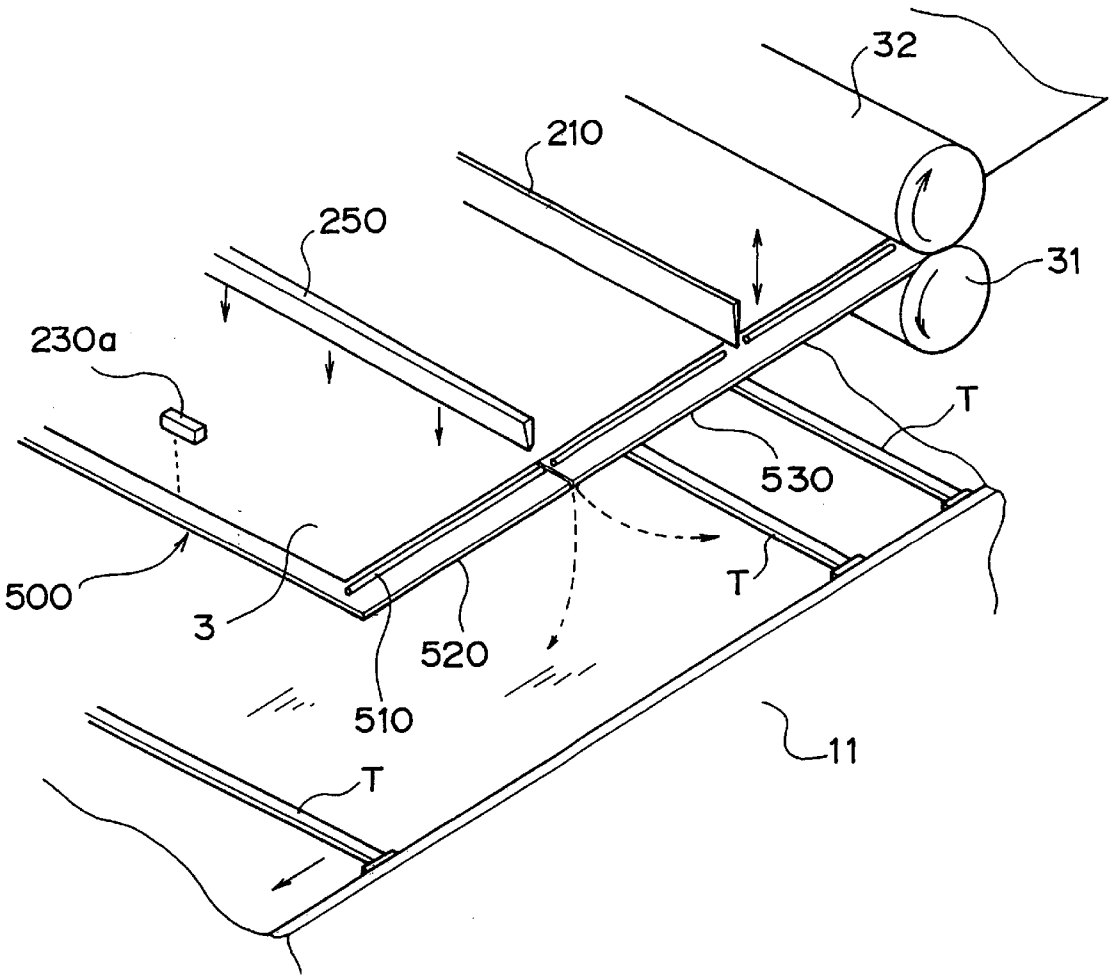
FIG. 26 is a partial perspective view showing a state of the cutting section of the printing apparatus shown in FIG. 25.

In the cutting section 200 according to the present embodiment, the horizontal plate 500 is arranges such that its plate surface is extended horizontally and opposed in parallel to the water surface 5 of the water tank 11 at a predetermined height, as shown in FIGS. 25 and 26.

The upper surface of the horizontal plate 500 is formed to be flat and smooth so that the base sheet 1 of the transfer sheet 3 can be smoothly pushed out without stumbling halfway. The horizontal plate 500 is formed in a rectangular shape wider than the width of the transfer sheet 3, and guides 510 which are parallel to and apart from each other by a distance substantially matched with the width of the transfer sheet 3 are provided in both side of the horizontal plate 500 so that the transfer sheet 3 might not go out of the horizontal plate 500, as shown in FIG. 26.

Figure 27:
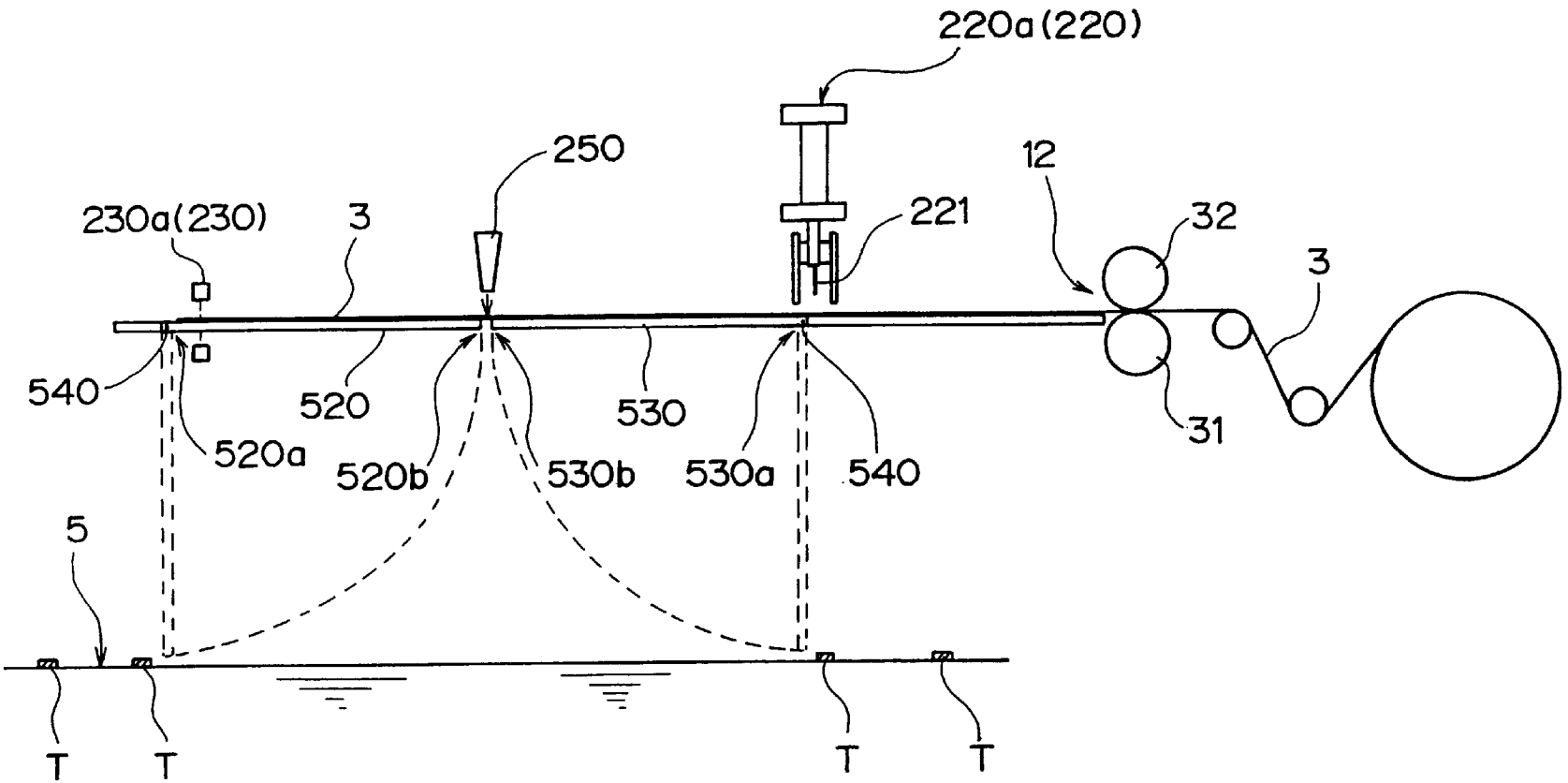
FIG. 27 is a cross-sectional view showing a double-doors mechanism of the cutting section shown in FIG. 25.

An end 500*a* of the horizontal plate 500 is formed such that the plate surface extends in the direction of the horizontal tangent line of the uppermost end portion of the roller surface of the drive roller 31 forming part of the transfer sheet feed section 12, as show in FIG. 27, in order to receive securely the end of the transfer sheet 3 fed out from the transfer sheet feed section 12. Since the plate surface is thus matched with the tangent line direction, wrinkles are much less formed.

The transfer sheet 3 is fed forward on the horizontal plate 500 such that it is fed on such a flat smooth plate surface from the transfer sheet feed section 12. If necessary, a lubricant may be thinly applied if such a lubricant does not cause any problem concerning dissolving of the base sheet 1 in the stage after the transfer sheet 3 is shifted onto the water surface, in order that the base sheet 1 of the transfer sheet 3 smoothly slide on the flat plate surface.

Further, a heat cylinder 220*a* having the same structure as described in the foregoing embodiments is provided in the side of the horizontal plate 500 close to the transfer sheet feed section 12, to cut cutting the transfer sheet 3, such that the heat cylinder is opposed to the plate surface of the horizontal plate 500, as shown in FIGS. 25 and 27.

In addition, at a position apart from the heat cylinder 220*a* toward the top end by a predetermined distance, a photoelectric tube 230*a* is provided so that the top end of the transfer sheet 3 which is fed on the horizontal plate 500 can be detected.

That is, the transfer sheet 3 fed out from the transfer sheet feed section 12 passes the heat cylinder 220*a* toward the photoelectric tube 230*a*. The top end of the transfer sheet 3 is detected by the photoelectric tube 230*a*, and the heat cylinder 220*a* is operated in response to a detection signal therefrom, to cut the transfer sheet 3.

A blower 250 for blowing air downward vertically is provided above the plate surface of the horizontal plate 500 at a middle position between the heat cylinder 220*a* and the photoelectric tube 230*a*.

Meanwhile, as shown in FIG. 27, the horizontal plate 500 is divided into open/close pieces 520 and 530 in the front and rear sides, so that the horizontal plate 500 can be opened downward like double doors from the blowing portion of the blower 250 as a boundary.

An end portion 520*a* of the open/close piece 520 is supported such that an end portion 520*b* thereof can be rotated by the rotation of a rotation shaft 540 provided at a position slightly closer to the top end than the position of the photoelectric tube 230*a*, as shown in FIG. 27. Rotation of the rotation shaft 540 is controlled by a small motor such that the open/close piece 520 can be rotated from a horizontal position to a lower open position about the rotation shaft 540 as the center of rotation, as shown in FIG. 27.

The open/close piece 520 can be rotated to be closed about the rotation shaft 540 from the lower open position to the horizontal position after this piece is opened.

The open/close piece 530 is constructed in the same manner as the open/close piece 520, and an end portion 530*a* can be rotated between a horizontal position and a lower open position about a rotation shaft 540 as the center of rotation, whose rotation is controlled by a small motor, so that opening and closing of this piece can be switched appropriately.

When feeding the transfer sheet 3, the open/close pieces 520 and 530 are situated to be horizontal by opposing their own end portions 520*b* and 530*b* horizontally to each other, so that the transfer sheet 3 can be fed through the horizontal plate 500.

Meanwhile, the small motor is operated so as to open the open/close pieces 520 and 530 downward about the rotation shafts 540 like double doors in a state in which the transfer sheet 3 fed out has been cut by the heat cylinder 220*a* on the basis of a detection signal depending on the photoelectric tube 230*a*.

Figure 28A:
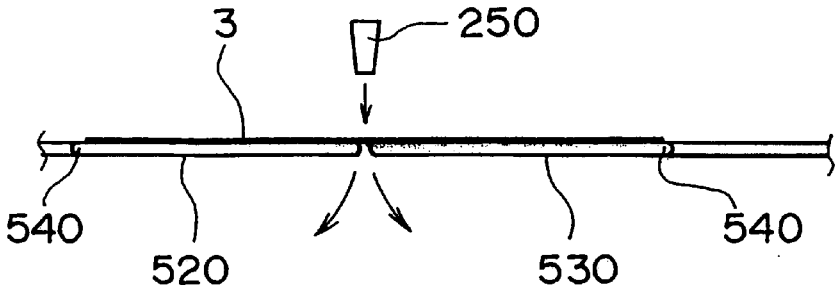
FIGS. 28(*a*), (*b*), and (*c*) are process views showing steps in which a transfer sheet is shifted to the water surface by the double-doors mechanism of the cutting section shown in FIG. 27.
Figure 28B:
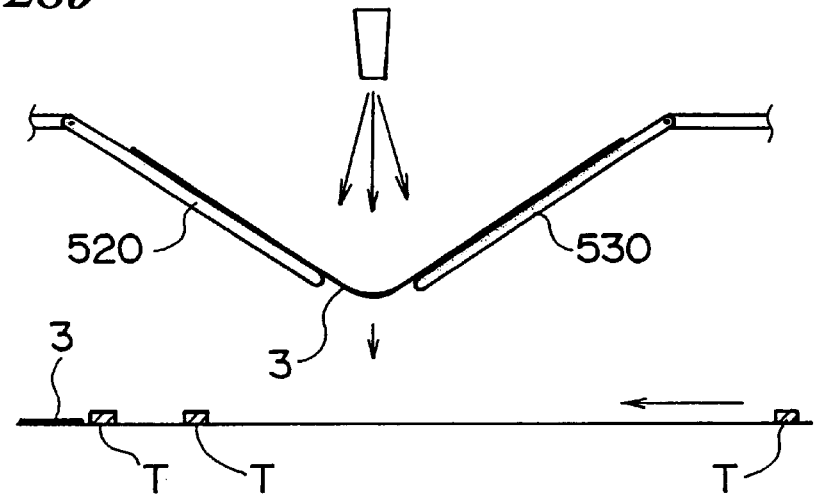
Figure 28C:
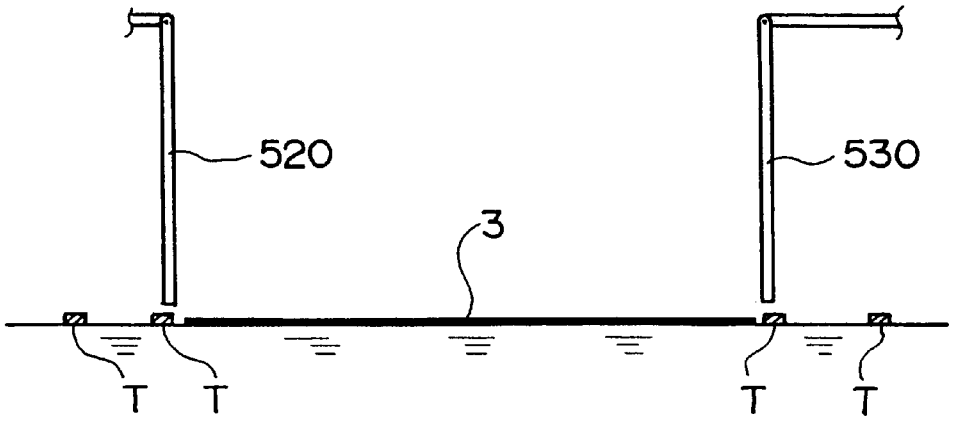

By thus opening the pieces like double doors, the transfer sheet 3 cut at a predetermined length and mounted on the pieces is let fall down on the water surface parallel to the horizontal plate 500 below, such that the center portion of the sheet 3 falls down forming an inverse triangle, as shown in FIGS. 28(*a*), (*b*), and (*c*).

After the transfer sheet 3 falls down on the water surface below by opening the open/close pieces like double doors, both the open/close pieces 520 and 530 are immediately rotated to be closed horizontally by rotation control by the small motor and are thus brought into a standby state for responding to a next transfer sheet 3.

The height of the horizontal plate 500 from the water surface maybe set such that the open/close pieces 520 and 530 do not make contact with the water surface or the partition members T when they are opened downward vertically like double doors.

Further, the blower 250 blows downward the center portion of the transfer sheet 3 in association with opening of the open/close pieces 520 and 530 like double doors, so that the center portion falls down like an inverse triangle and the transfer sheet 3 is landed on the water surface below, as shown in FIG. 28.

In the present embodiment, since the transfer sheet 3 can be landed on the water surface below with the center portion of the sheet 3 dropped like an inverse triangle, air between the back side of the transfer sheet 3 and the water surface is pushed out in the forward and backward directions from the transfer sheet 3. When the transfer sheet 3 is landed on the water, the sheet 3 can therefore make surface contact with the water surface without air sandwiched between the sheet 3 and the water surface, so that the base sheet 1 can be dissolved with improved uniformness and the pattern is prevented from being broken.

Meanwhile, a plurality of partition members T are provided at predetermined intervals between links 51L of the chains 51 provided at the water tank 11, like in the Embodiments 2 and 3 described before, and the transfer sheet 3 can be situated just between partition members T which are arranged apart from each other by a distance matched with the cutting length of the transfer sheet 3.

Both of partition members T attached to attachments 51T between links 51L of the chains 51 at an interval matched with the cutting length of the transfer sheet 3 are operated in association with operation of cutting the transfer sheet 3 on the horizontal plate 500, and is arranged such that both partition members T come and stop at positions below the transfer sheet 3 at the time point when the transfer sheet 3 is let fall down.

In the above explanation, both the open/close pieces 520 and 530 are set to have an equal length and can be opened from the center like double doors. However, as shown in FIG. 29(*a*), one of the open/close pieces 520 and 530 may be shorter than the other.

Figure 29A:
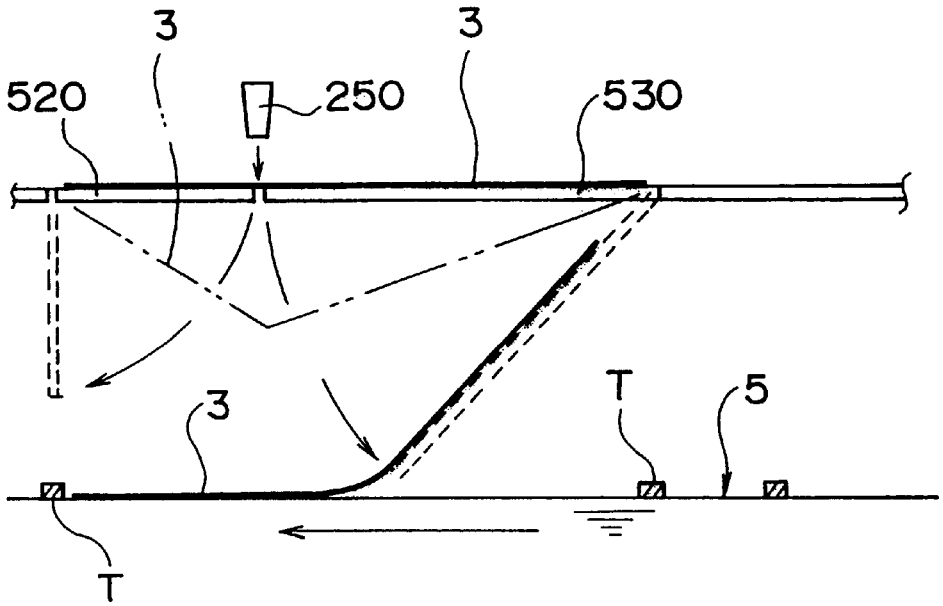
FIGS. 29(*a*) and (*b*) are cross-sectional views showing a modification of the cutting section having a double-doors mechanism.
Figure 29B:
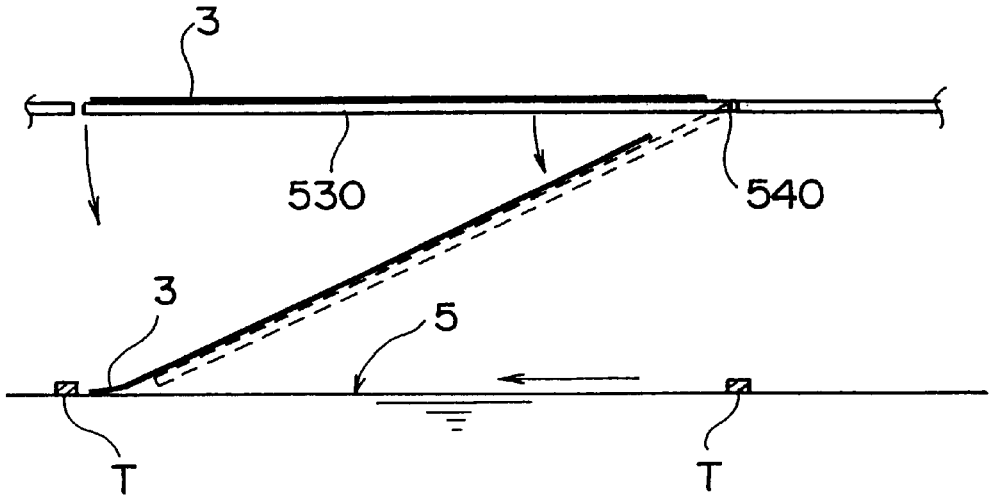

For example, in case where the open/close piece 520 is shorter than the other, the open/close piece 520 may be opened perfectly while the other longer open/close piece 530 may be opened to be stopped at a position slightly higher than the water surface, as shown in FIG. 29(*a*). In this case, the transfer sheet 3 falls down on the water surface in the manner as described before.

In addition, the portion of the transfer sheet 3 on the shorter open/close piece 520 is landed on the water earlier than the longer open/close piece 530. If the partition members T are moved in the direction of the water flow at the time point when the transfer sheet 3 is landed on the water, the transfer sheet 3 is just situated between the partition members T arranged in compliance with the cutting length.

Also, as shown in FIG. 29(*b*), a structure like a single swing door may be used. In this case, unlike in the structure like double doors, the partition members T need not be stopped when the transfer sheet 3 is landed on water, but the partition members T may be moved along the water flow direction.

Explanation will now be made of a printing method using the apparatus constructed in a structure as described above.

The flow of the operation concerning the transfer sheet 3 up to the transfer sheet feed section 12 is the same as that described in the Embodiment 1 described above.

The end of transfer sheet 3 fed out from the transfer sheet feed section 12 is received by the horizontal plate 500 provided close to the upper end of the roller surface of the drive roller 31.

The transfer sheet 3 is fed onto the plate surface of the horizontal plate 500 along the direction of the line tangent to the upper end surface of the roller surface of the drive roller 31 of the transfer sheet feed section 12. The transfer sheet 3 fed onto the plate surface of the horizontal plate 500 is fed forward as if it slides in accordance feeding from the transfer sheet feed section 12. The plate surface of the horizontal plate 500 is formed as a smooth surface on which the base sheet 1 of the transfer sheet 3 smoothly slides, so that the transfer sheet 3 is fed in a horizontal direction without forming wrinkles.

The transfer sheet 3 passes near the heat cylinder 220*a* and further moves by a predetermined length from the heat cylinder 220*a*. Then, arrival of the top end of the transfer sheet 3 is detected by a photoelectric tube 230*a*, and the heat cylinder 200*a* distant from the photoelectric tube 230*a* by a predetermined length operates so that the transfer sheet 3 is cut out.

After cutting the transfer sheet 3, the open/close pieces 520 and 530 forming part of the horizontal plate 500 are opened downward like double doors, as shown in FIG. 27, and the blower 250 blows down the transfer sheet 3 from its upper surface side, so that the transfer sheet 3 is let fall down onto the water surface below with the center portion of the sheet 3 lowered like an inverse triangle.

Meanwhile, the partition members T provided on the chains 51 of the water tank 11 and constructed as described above are synchronized with the timing of the fall of the transfer sheet 3 onto the water surface, so that the transfer sheet 3 can be landed on the water between partition members T which are attached to the chains 51 and are apart from each other by a distance matched with the cutting length of the transfer sheet 3.

Thus, the transfer sheet 3 sandwiched between the partition members T in the front and rear sides is shifted to the right side B, flowing on the water surface without being influenced by waves on the water surface, and the base sheet 1 is dissolved while being thus shifted. After the base sheet 1 is dissolved, an adhesion is applied to form a semi-fluidal pattern which is then shifted to the side where the transfer step is performed, and thereafter, objects 9 are pressed against the pattern from upside to transfer the pattern.

In the present embodiment, the portion of the horizontal plate 500 where the transfer sheet 3 cut out is mounted is constituted by open/close pieces 520 and 530 which can be opened like double doors. However, as shown in FIG. 30(*a*), the open/close pieces 520 and 530 which can thus be opened like double doors may be constructed as a belt conveyer so that the transfer sheet 3 can be easily fed out.

Figure 30A:
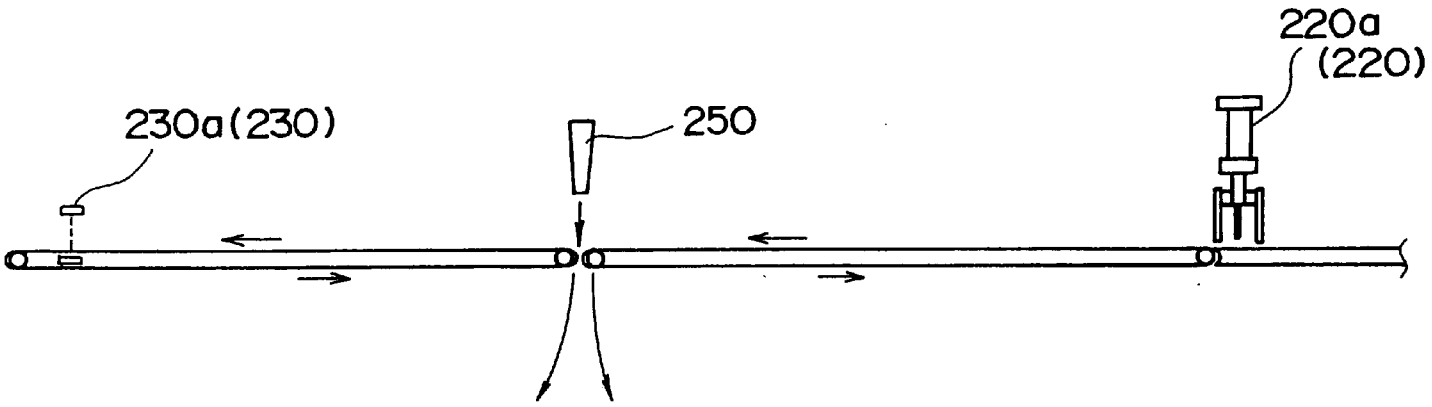
FIGS. 30(*a*) and (*b*) are cross-sectional views showing a modification using a belt conveyer for the cutting section.
Figure 30B:
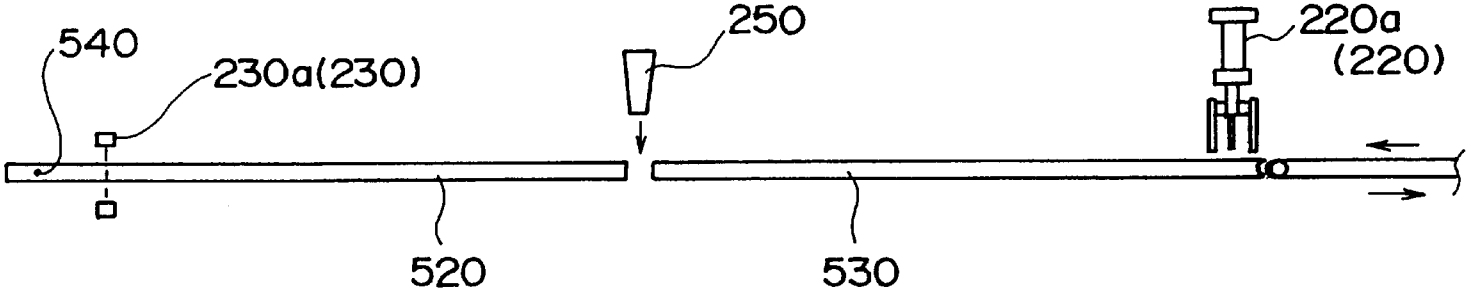

Otherwise, the portion between the open/close piece 530 and the transfer sheet feed section 12 may be constructed as a belt conveyer, as shown in FIG. 30(*b*).

Figure 31:
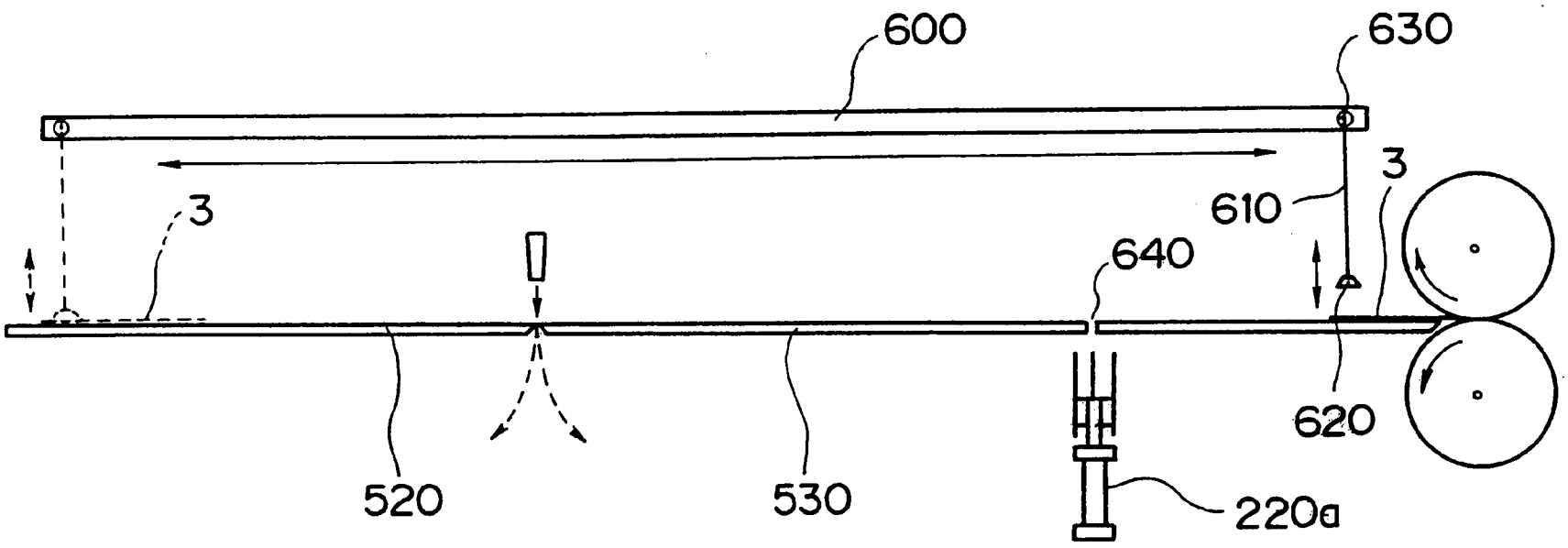
FIG. 31 is a side view showing a state in which a conveyer mechanism for a transfer sheet using acetabula for the cutting section is provided.
Figure 32A:
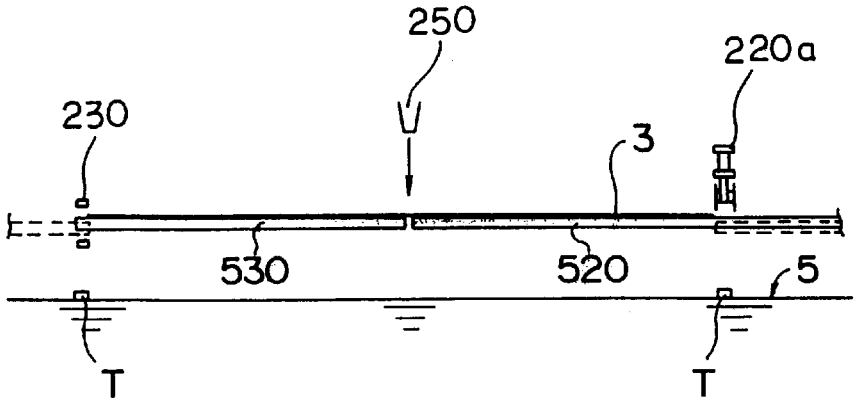
FIGS. 32(*a*), (*b*), (*c*), and (*d*) are cross-sectional views in case where the cutting section is provided to be horizontal.
Figure 32B:
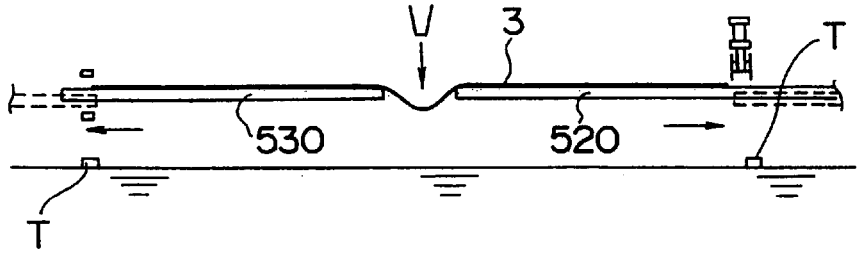
Figure 32C:
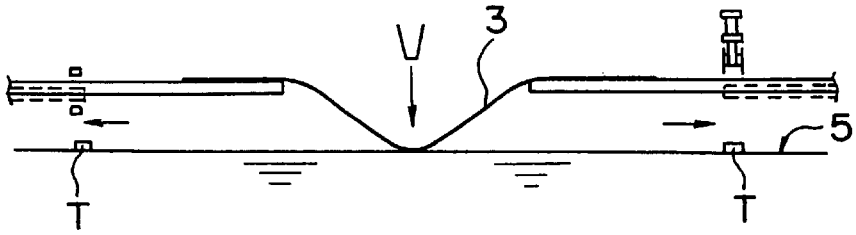
Figure 32D:
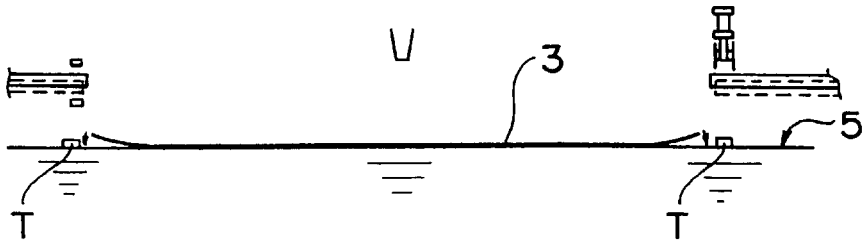
Figure 33A:
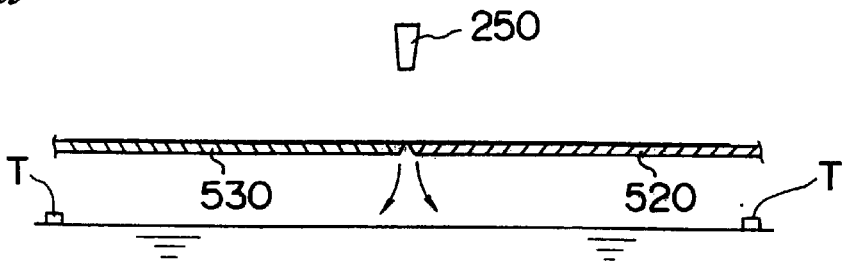
FIGS. 33(*a*), (*b*), (*c*), and (*d*) are cross-sectional views showing modification examples of an opening method in case where the opening pieces shown in FIG. 32 are arranged to be opened downward like a single swing door and to be moved horizontally.
Figure 33B:
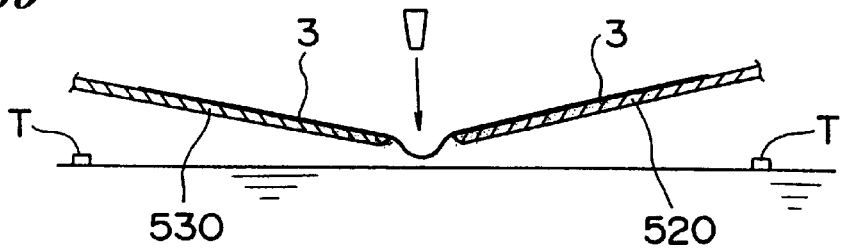
Figure 33C:
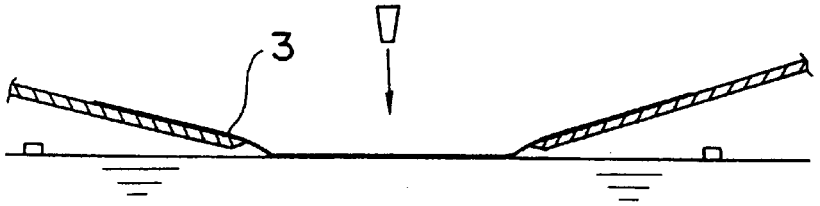
Figure 33D:
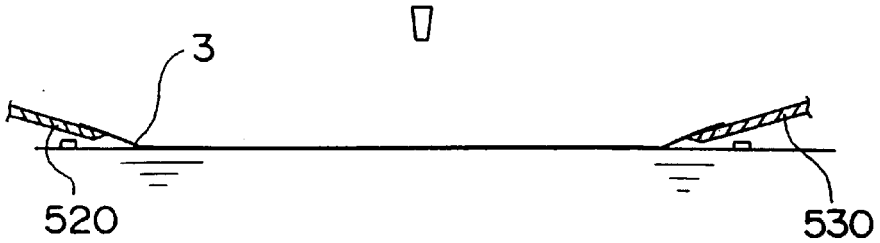

Otherwise, as shown in FIG. 31, an acetabulum conveyer mechanism for conveying the transfer sheet 3 by suctioning its top end may be provided at the section between a portion close to the transfer sheet feed section 12 and the top end of the horizontal plate 500.

Such an acetabulum conveyer mechanism is arranged as follows. For example, two horizontal guides 600 are provided above the plate surface of the horizontal plate 500 in the section described above. These two horizontal guides 600 are set to have a width slightly narrower than the width of the transfer sheet 3. The width between the horizontal guides 600 is arranged such that the width distance can be adjusted so as to match with various widths of transfer sheets 3 to be used.

Meanwhile, each of the horizontal guides 600 is provided with an acetabulum 620 by a suspend member 610. The upper ends of the suspend members 610 are guided by the horizontal guides 600 through pulleys 630 such that the suspend members 610 are capable of running horizontally.

The acetabula 620 are provided at the lower ends of the suspend members 600 such that the heights of the acetabula can be elevated up and down along the direction in which the acetabula are suspended from the suspend members 610. Further, each acetabulum 620 is piped to an air pressure control device (not shown) by a flexible pipe. If necessary, the internal pressure of the acetabulum 620 can be set to such a negative pressure at which the transfer sheet 3 is suctioned or can be returned to a normal pressure.

When the transfer sheet 3 is fed out from the transfer sheet feed section 12 to the acetabula standby portion of the acetabulum conveyer mechanism in the side of the surface of the horizontal plate 500, the arrival of the transfer sheet 3 is detected by a detection sensor such as a photoelectric tube or the like, and then, the acetabula are moved down onto the upper surface of the transfer sheet 3. The acetabula 620 are controlled to have internally a negative pressure and suction the transfer sheet 3 to their own surfaces.

The transfer sheet 3 is thus brought into a condition in which both side ends are suctioned by two acetabula 620 with a distance narrower than the width of the transfer sheet 3 maintained therebetween. In this condition, two acetabula 620 are slightly lift upward along the suspend members 600, such that the back surface of the transfer sheet 3 is slightly lifted up from the horizontal plate 500.

In this manner, while the top end of the transfer sheet 3 fed from the transfer sheet feed section 12 is suctioned to the acetabula 620 and is slightly lifted up from plate surface of the horizontal plate 500, the pulleys 630 are horizontally moved, guided by the horizontal guides 600, and the transfer sheet 3 is thus pulled to the predetermined top end of the horizontal plate 500. At the time point when the sheet 3 reaches the predetermined top end, the acetabula 620 are moved down along the suspend members 610 until the back surface of the transfer sheet 3 reaches the plate surface of the horizontal plate 500. At the time point when the transfer sheet 3 is thus moved down, the heat cylinder 220*a* is operated to cut the transfer sheet 3 at a predetermined length.

Further, at the time point when the transfer sheet 3 is cut, the internal pressure of the acetabula is returned to a normal pressure, so that the transfer sheet 3 thus suctioned is released.

At the time point when the transfer sheet 3 is thus released, the acetabula 620 are moved up along the suspend members 610, and further, the pulleys 630 are moved along the horizontal guides 600 to return to predetermined standby positions in the side of the transfer sheet feed section 12. The mechanism then waits there until the top end of another transfer sheet 3 is detected by the detection sensor.

By making the acetabula 620 repeat the series of operation described above, conveyance of the transfer sheet 3 can be efficiently performed along the plate surface of the horizontal plate 500.

In the structure as described above, the installation position of the heat cylinder 220*a* may be set in the back side of the horizontal plate 500, as shown in FIG. 31, in order that the acetabula 620 might not hindered from moving forward or backward. The horizontal plate 500 is previously provided with a slit for the cutting blade 210 of the heat cylinder 220*a*. When cutting the transfer sheet 3, the cutting blade 210 pass through the slit 640 and makes contact with the back surface of the transfer sheet 3.

Also, in the structure described above, the acetabula 620 which move forward and backward along the plate surface of the horizontal plate 500 are provided with a width distance narrower than the width of the transfer sheet 3 maintained therebetween. Therefore, the width of the blower 250 may be set such that the blower 250 is positioned between the two acetabula 620.

By thus constructing the structure, the transfer sheet 3 can be fed out smoothly even if the transfer sheet receiver member 210 is constructed to be horizontal.

Further, in the structure as described above, the photoelectric tube 230*a* is set to a position between two acetabula 620 at standby positions thereof, and detects the arrival of the transfer sheet 3, so that the downward movement of the acetabula 620 can be started in association with the detection of the arrival. FIG. 31 does not show the photoelectric tube 230*a* hindered by the acetabula 620.

The acetabulum conveyer mechanism as described above may be applied to a structure in which the transfer sheet receiver member 210 is inclined as explained in the Embodiment 2 described before, so that the transfer sheet can be actively conveyed.

Also, in the structure as described above, the horizontal plate 500 is opened downward like double doors in the front and rear sides or like a single swing door. However, the open/close pieces 520 and 530 may be arranged in the left and right sides with respect to the lengthwise direction of the horizontal plate 500, i.e., maybe arranged in the width direction. In this case, even if the transfer sheet 3 is cut into a long size, the height of the horizontal plate 500 from the water surface 5 can be lower compared with the case where the horizontal plate 500 is opened like double doors in the front and rear sides. In this structure, the blower 250 may be provided at a position above the joint between the open/close pieces 520 and 530 extending along the lengthwise direction of the horizontal plate 500.

Further, in the above embodiment, the horizontal plate 500 is opened downward like double doors in the front and rear sides or like a single swing door. However, the open/close pieces 520 and 530 forming part of the horizontal plate 500 maybe arranged to be pulled in the horizontal direction, so that the center portion of the plate can be opened.

FIG. 32 show procedure of landing the transfer sheet 3 on water by opening the open/close pieces 520 and 530.

FIG. 32(*a*) shows a state in which the open/close pieces 520 and 530 are closed horizontally and constitute the horizontal plate 500. A transfer sheet 3 cut at a predetermined length is set on the open/close pieces 520 and 530 thus closed horizontally.

FIGS. 32(*b*), (*c*), and (*d*) shows a step in which the open/close pieces 520 and 530 on which the transfer sheet 3 thus cut at a predetermined length is set are simultaneously pulled horizontally in opposite directions, respectively, and the center is gradually opened. Also shown in the figures is a step in which the blower 250 starts blowing down the transfer sheet 3 from upside at the same time when the center is opened, and the sheet 3 gradually moves down onto the water surface with the center of the sheet 3 recessed along the opening. Note that the blower 250 stops blowing at the time when the center portion of the transfer sheet 3 reaches the water surface, so that vibration of the water surface 5 is reduced as much as possible.

In the above-mentioned structure in which the open/close pieces 520 and 530 are opened downward like double doors, it is necessary to maintain a height equivalent to the length of the pieces 520 and 530 from the water surface 5 in consideration of rotation of the open/close pieces 520 and 530. However, in the present structure in which the open/close pieces 520 and 530 are pulled in horizontal directions to open the center portion, the horizontal plate 500 consisting of the open/close pieces 520 and 530 can be close to the water surface 5.

Therefore, the transfer sheet 3 is let fall down from a lower position in the present structure so that the sheet 3 can be landed on water more rapidly, compared with the case where the transfer sheet 3 is let fall down from a position much higher than the water surface.

Also, since the height from the level where the transfer sheet 3 is landed on water can be reduced, it is needless to consider that the thin transfer sheet 3 may vibrate or may be reversed due to a delicate air flow caused by air-conditioning in a factory, for example, and therefore, the transfer sheet 3 can be landed on water stably and securely.

In addition, in the above explanation, the structure is arranged such that the open/close pieces 520 and 530 are directly pulled in the horizontal direction from a state in which the open/close pieces 520 and 530 are closed horizontally, thereby to form an opening in the center, and the transfer sheet 3 is let fall down from the opening portion with the center of the sheet recessed. However, the center portion may be opened in a manner in which the open/close pieces 520 and 530 are slightly opened downward and are pulled obliquely upward at the same time while the top ends of the open/close pieces arranged to be close to the water surface.

Otherwise, the open/close pieces 520 and 530 may be opened downward and the center portion may be opened by shifting these pieces horizontally to the left and right sides with their top ends kept close to the water surface. In this structure, the center portion of the transfer sheet 3 is landed on the water surface at a position much close to the water surface, and thereafter, both ends of the transfer sheet 3 are then be landed onto the water, sliding on the open/close pieces 520 and 530 inclined. Therefore, the transfer sheet 3 can be smoothly landed on the water without air remaining in the back side of the transfer sheet 3. This operation is orderly shown in FIGS. 33(*a*) to (*d*). Note that the heat cylinder 220*a* is omitted from FIG. 33.

Figure 34:
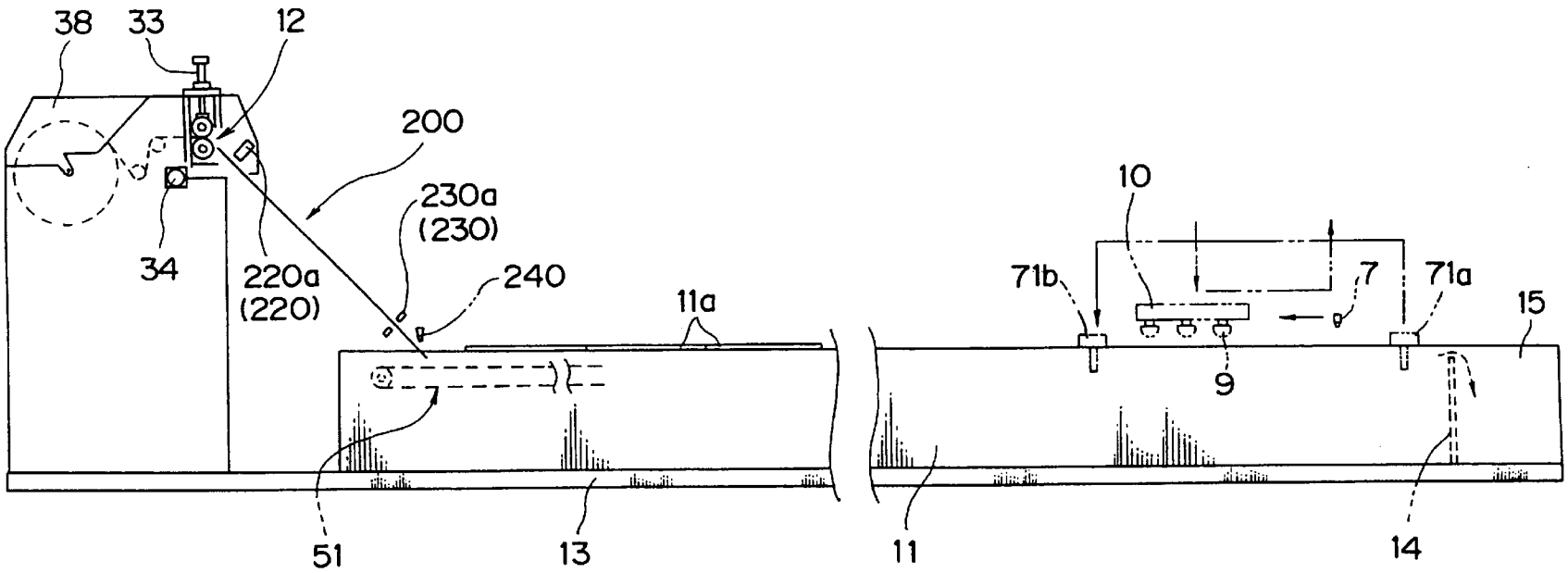
FIG. 34 is a side view showing a structure using a water tank which is not shallow in the left side in the printing apparatus shown in FIG. 13.

In the Embodiments 2, 3, and 4 described before, the left side A of the water tank 11 is arranged to be shallower than the right side B as shown in FIG. 13. However, the water tank 11 may be arranged to have an uniform depth from the left side A to the right side B, as shown in FIG. 34.

Also, in the Embodiments 2, 3, and 4 described before, explanation has been made of a structure in which the cutting blade 221 of the heat cylinder 220*a* is used as the cutting means 220. However, it is possible to perform contactless cutting by means of a laser beam. Particularly, in case where a conveyer mechanism using acetabula is provided as shown in a modification of the Embodiment 4, such cutting by means of a laser beam realizes a mechanism having a structure which does not hinder movement of the acetabula, and therefore, the heat cylinder 220*a* need not be positioned in the back side of the horizontal plate 500.

Further, in the Embodiments 2, 3, and 4 described before, explanation has been made of a structure in which the cutting means 220 is arranged in the rear side of the detection means 230. However, if the moving speed of the transfer sheet 3 on the transfer sheet receive member 210 can be controlled to be constant, the photoelectric tube 230*a* may be provided at a position closer to the transfer sheet feed section 12 than the heat cylinder 220*a*, for example. In this case, it is possible to cut the transfer sheet 3 at a predetermined length if cutting operation is started a predetermined time after a top end detection signal is supplied to the heat cylinder 220*a*.

Figure 35A:
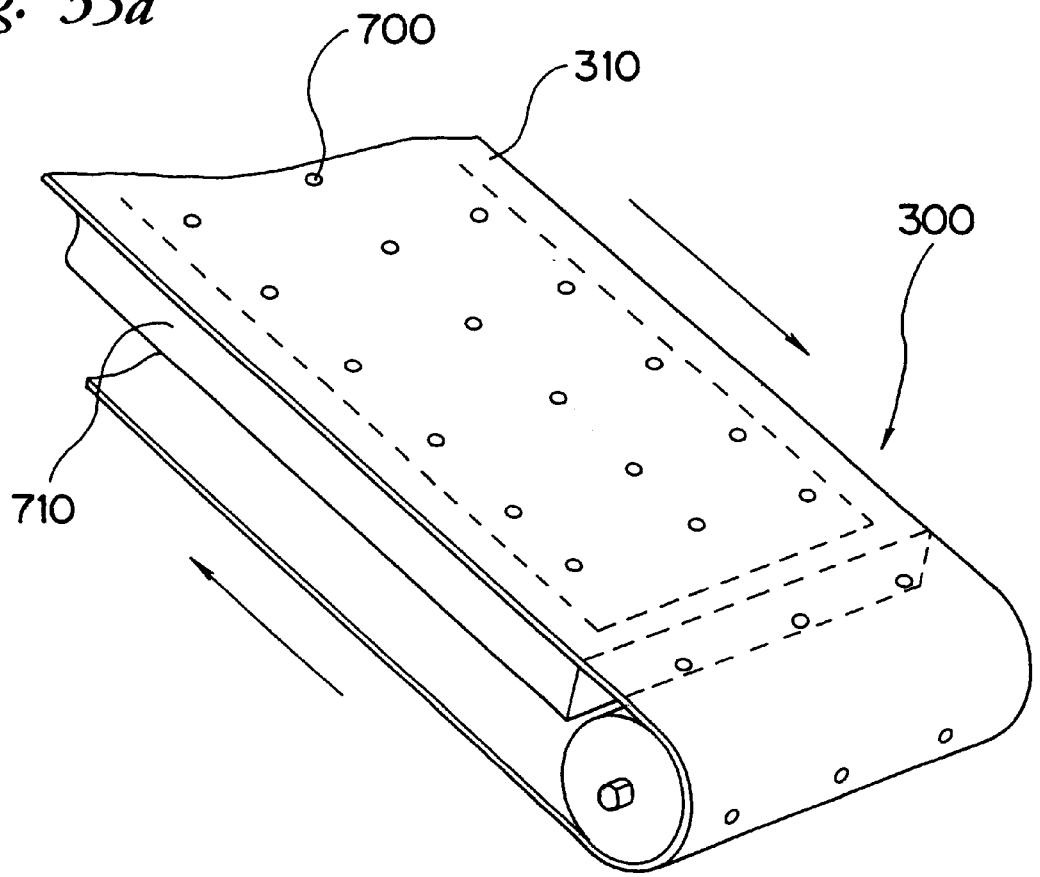
FIG. 35(*a*) is a perspective view showing a modification example of a conveyer mechanism for a transfer sheet in case where a belt conveyer is used for the cutting section.
Figure 35B:
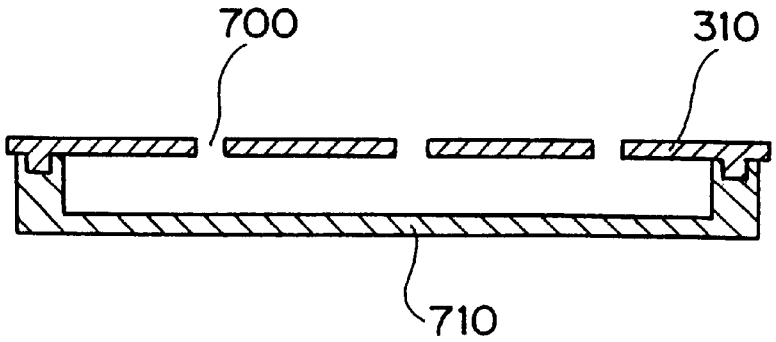

In addition, as for the open/close pieces 520 and 530 constructed in the belt conveyer 300 according to the Embodiment 3 or the belt conveyer 300 according to the Embodiment 4, a number of pores 700 or lines of pores 700 with a predetermined interval therebetween may be formed in the surface of the belt 310, as shown in FIG. 35, and the pressure in the back side of the belt 310 may be arranged to be slightly negative, so that the transfer sheet 3 is conveyed with its back side suction thereto.

In this structure, the belt 310 is conveyed with its surface facing upward so as to mount the transfer sheet 3, and is made run with the porous back surface of the belt 310 brought into surface contact with a suction duct 710, as shown in FIG. 35.

The suction duct 710 is formed as a thin rectangular duct having a rectangular area having short edges substantially equal to the belt width, and each of upper end portions of both side surfaces thereof is constructed to have a concave cross-section. Meanwhile, a convex portion which is just engaged in the concave portion of the suction duct 710 is provided at each of both sides of the back surface of the belt. By engaging the concave and convex portions with each other, the belt can be moved and guided with sealing maintained between the suction duct 710 and the back surface of the belt.

In addition, the suction duct 710 is arranged to be stopped slightly before the top end of the belt. As for the base end of the suction duct, for example, a simple structure such as a scirocco fan is used to obtain suctioning so that the inside of the suction duct 710 has a slightly negative pressure. The level of the negative pressure maybe set such that the back surface of the transfer sheet 3 can be suctioned through the pores 700 with a negative force slightly smaller than the force with which the transfer sheet 3 is conveyed by the belt conveyer.

In the structure constructed as described above, the transfer sheet 3 mounted on the belt conveyer from the transfer sheet feed section 12 is immediately suctioned by the pores 700 on its back surface and is thus conveyed toward the top end.

Meanwhile, when the transfer sheet 3 thus suctioned reaches the top end which is out of the suction duct 710, the back surface leaves the pores 700 and the transfer sheet 3 is shifted to a step of landing on water. If the negative pressure is too high, the transfer sheet 3 maybe stopped temporarily at the portion which is out of the suction duct 710, which may causes formation of wrinkles. Therefore, the negative pressure maybe set to a level at which the transfer sheet 3 is suctioned with a force slightly weaker than the force with which the sheet is conveyed.

In the above, the invention made by the present inventor has been specifically explained on the basis of embodiments. Needless to say, the present invention is not limited to the Embodiments 1 to 4 described above but may be variously modified without deviating from the subject matter of the invention.

POSSIBILITY OF THE INDUSTRIAL UTILITY

As has been explained above, the printing method and the printing apparatus according to the present invention is suitable for printing onto a portion having a curved surface, e.g., various industrial products such as a curved surface of furniture, components of a car, or the like, and is particularly suitable for printing of a sequential pattern such as a moire pattern or the like.

I claim:

1. A printing method for performing printing by transferring a pattern formed on a base sheet, onto an object, comprising steps of:

cutting a water-soluble base sheet having a surface on which a print layer of the pattern is provided, at a predetermined length;

floating the base sheet cut at the predetermined length onto a surface of water in a water tank, with the print layer facing upward, while partitioning the cut base sheet from another cut base sheet;

dissolving the cut base sheet, while conveying the cut base sheet kept floated on the surface of the water by making a water flow in a constant direction in the water tank;

applying an adhesion onto the print layer after or while the cut base sheet is dissolved; and transferring the print layer onto the object by pressing the object against the print layer, wherein the step of dissolving the cut base sheet is carried out in a water tank having a bottom shallower than a water tank in which the step of transferring the print layer is carried out.

2. A printing method for performing printing by transferring a pattern formed on a base sheet, onto an object, comprising steps of:

cutting a water-soluble base sheet having a surface on which a print layer of the pattern is provided, at a predetermined length;

floating the base sheet cut at the predetermined length onto a surface of water in a water tank, with the print layer facing upward, while partitioning the cut base sheet from another cut base sheet;

applying an adhesion onto the print layer, while conveying the cut base sheet kept floated on the surface of the water by making a water flow in a constant direction in the water tank;

dissolving the cut base sheet, while conveying the cut base sheet kept floated on the water; and transferring the print layer onto the object by pressing the object against the print layer after the cut base sheet has been dissolved, wherein the step of dissolving the cut base sheet is carried out in a water tank having a bottom shallower than a water tank in which the step of transferring the print layer is carried out.

3. A printing method for performing printing by transferring a pattern formed on a base sheet, onto an object, comprising steps of:

cutting a water-soluble base sheet having a surface on which a print layer of the pattern is provided, at a predetermined length;

floating the base sheet cut at the predetermined length onto a surface of water in a water tank, with the print layer facing upward, while partitioning the cut base sheet from another cut base sheet;

applying an adhesion onto the print layer, while conveying the cut base sheet kept floated on the surface of the water by making a water flow in a constant direction in the water tank; and transferring the print layer onto the object by pressing the object against the print layer, while dissolving the cut base sheet while conveying the cut base sheet kept floated on the water, wherein the steps before the step of transferring are carried out in a water tank having a bottom shallower than a water tank in which the step of transferring is carried out.

4. A printing apparatus for performing printing by transferring a pattern formed on a base sheet, onto an object, comprising:

a water tank having an upstream end and a downstream end, for containing water such that the water flows from the upstream end to the downstream end;

water flow forming means provided at the water tank, for forming a water flow at the water surface from the upstream end to the downstream end;

a transfer sheet feed section provided adjacent to the water tank, for feeding a transfer sheet toward a cutting section, the transfer sheet comprising a water-soluble base sheet which is dissolved in the water and a print layer of the pattern formed on a surface of the base sheet;

a cutting section for cutting the transfer sheet at a predetermined length while shifting the transfer sheet from the transfer sheet feed section to the water surface;

adhesion application means for applying an adhesion onto the print layer shifted from the cutting section to the water surface; and object moving means for holding the object and for pressing the object against the print layer to transfer the print layer onto a surface of the object, wherein the water tank is formed to be shallower in an upstream side of the object moving means for transferring the print layer, than in a side of the object moving means.

5. A printing apparatus according to claim 4, wherein the cutting section comprising:

a transfer sheet receiver member provided at a top in a feeding direction of the transfer sheet feed section;

top end detection means for detecting a top end of the transfer sheet shifted on the transfer sheet receiver member to the water surface; and cutting means for cutting the transfer sheet in association with the top end detection means.

6. A printing apparatus according to claim 5, wherein the transfer sheet receiver member is arranged to be oblique from the transfer sheet feed section to the water surface such that a top end of the transfer sheet receiver member is positioned slightly above the water surface, the transfer sheet receiver member is provided with cutting means and top end detection means which are apart from each other, and the transfer sheet cut at the predetermined length from the top end of the transfer sheet receiver member is shifted from the top end of the transfer sheet receiver member to the water surface.

7. A printing apparatus according to claim 6, wherein a blower is provided at an upper position above a top end portion of the transfer sheet receiver member which is close to the water surface, with its blowing direction directed from upside of the top end portion to the water surface.

8. A printing apparatus according to claim 5, wherein the transfer sheet receiver member is arranged to be opposed to the water surface, at an upper position, the transfer sheet receiver member is provided with cutting means and top end detection means which are apart from each other, and a portion of the transfer sheet receiver member where the transfer sheet cut at the predetermined length from a top end of the transfer sheet receiver member is mounted can be opened and closed so that the transfer sheet is let fall down onto the water surface.

9. A printing apparatus according to claim 8, wherein a blower is provided at an upper position above the portion of the transfer sheet receiver member which can be opened and closed, with its blowing direction directed from upside to the water surface.

* * * * *